United States Patent [19]

Ueda et al.

[11] Patent Number: 5,059,514

[45] Date of Patent: Oct. 22, 1991

[54] METHOD FOR PROCESSING SILVER HALIDE COLOR PHOTOGRAPHIC LIGHT-SENSITIVE MATERIALS

[75] Inventors: Shinji Ueda; Tetsuro Kojima; Tohru Kitahara; Tomokazu Yasuda; Yoshihiro Fujita; Takatoshi Ishikawa, all of Minami-Ashigara, Japan

[73] Assignee: Fuji Photo Film Co., Ltd., Minami-Ashigara, Japan

[21] Appl. No.: 415,266

[22] PCT Filed: Dec. 24, 1988

[86] PCT No.: PCT/JP88/01328

§ 371 Date: Aug. 23, 1989

§ 102(e) Date: Aug. 23, 1989

[87] PCT Pub. No.: WO89/06380

PCT Pub. Date: Jul. 13, 1989

[30] Foreign Application Priority Data

Dec. 25, 1987 [JP] Japan ..... 62-329263
May 31, 1988 [JP] Japan ..... 63-133735

[51] Int. Cl.[5] ..... G03C 7/28

[52] U.S. Cl. ..... 430/393; 430/398; 430/400; 430/430; 430/461; 430/963

[58] Field of Search ..... 430/393, 398, 400, 430, 430/461, 963

[56] References Cited

U.S. PATENT DOCUMENTS 3,869,383 3/1975 Shimamura et al. ..... 210/32
4,043,907 8/1977 Shimamura et al. ..... 210/32
4,204,930 5/1980 Ono et al. ..... 204/180
4,256,559 3/1981 Ono et al. ..... 204/180
4,756,918 7/1988 Ueda et al. ..... 430/393
4,762,774 8/1988 Kishimoto et al. ..... 430/393

FOREIGN PATENT DOCUMENTS 53-60371 5/1978 Japan .
54-155924 5/1978 Japan .
59-116654 11/1982 Japan .
62-71954 4/1987 Japan .
62-91952 4/1987 Japan .
62-92950 4/1987 Japan .
2132635 7/1984 United Kingdom .

*Primary Examiner*—Charles L. Bowers, Jr.
*Assistant Examiner*—Janis L. Dote
*Attorney, Agent, or Firm*—Burns, Doane, Swecker & Mathis

[57] ABSTRACT

The present invention relates to a method for bleaching a silver halide photographic light-sensitive material having at least one silver halide emulsion layer containing silver iodobromide after color-developing it. The object of the present invention is to speed up the bleaching treatment in the aforesaid method and to reduce the amount of waste liquor from the bleaching treatment. The present invention is characterized in that the bleaching is performed in the presence of a bleaching accelerator and that it is carried out while a bleaching solution is brought into contact with an anion-exchange resin.

16 Claims, No Drawings

METHOD FOR PROCESSING SILVER HALIDE COLOR PHOTOGRAPHIC LIGHT-SENSITIVE MATERIALS

TECHNICAL FIELD

The present invention relates to a method for processing silver halide color photographic light-sensitive materials having silver halide emulsion layers containing silver iodobromide and more specifically to a method for processing such photographic light-sensitive materials comprising a desilvering step in which the light-sensitive materials are rapidly bleached while reducing the amount of waste liquor derived from the bleaching treatment.

TECHNICAL BACKGROUND

In general, the basic processes for processing color light-sensitive materials are a color developing process and a desilvering process. In the color developing process, the silver halide exposed to light is reduced with a color developing agent to form elemental silver and simultaneously the oxidized color developing agent reacts with a coloring agent (coupler) to form dye images. In the subsequent desilvering process, the elemental silver formed during the color developing process is oxidized by the action of an oxidizing agent (in general, referred to as "bleaching agent") and then is dissolved by the action of a complexing agent for silver ions generally referred to as "fixing agent". Only the dye images remain on the color light-sensitive materials after the desilvering process.

The desilvering process described above generally comprises two processing baths, one of which is a bleaching bath containing a bleaching agent and the other of which is a fixing bath containing a fixing agent; or only one bath simultaneously containing a bleaching agent and a fixing agent.

The practical development processing further comprises, in addition to the foregoing basic processes, a variety of auxiliary processes for the purposes of maintaining photographic and physical properties of images, enhancing storability of images or the like. Examples of such auxiliary processes are a film hardening bath, a stopping bath, an image stabilizing bath and a water washing bath.

The bleaching agents used in the desilvering process are in general red prussiate of potash, bichromates, ferric chloride, ferric complexes of aminopolycarboxylic acids and persulfates.

However, a problem of environmental pollution arises when red prussiate of potash and bichromates are employed and the use thereof requires a specific installation for processing the same. In addition, if the ferric chloride is used, it accompanies the formation of iron hydroxide and the generation of stains during the subsequent water washing process. Thus, it is difficult to practically use such bleaching agents because of various practical obstacles mentioned above. Regarding the persulfates, the bleaching ability thereof is very weak and it takes a long period of time for bleaching. To eliminate this problem, there is proposed a method in which a bleaching accelerator is simultaneously used for enhancing the bleaching ability. However, the persulfates per se is specified as dangerous materials in accordance with the Fire Services Act. The use thereof is restricted, it is needed to take various steps in storing the same and thus practical use thereof is very difficult.

One the other hand, ferric complexes of aminopolycarboxylic acids, in particular ferric complex of ethylenediaminetetraacetic acid and ferric complex of diethylenetriaminepentaacetic acid have widely been used as a bleaching agent since they cause no environmental pollution and no problem of storage as in the case of persulfates. However, the ferric complexes of aminopolycarboxylic acids do not exhibit sufficient bleaching ability. A low sensitive silver halide color light-sensitive material mainly composed of a silver chlorobromide emulsion can be bleached with a solution containing such a ferric complex as a bleaching agent. But, if it is intended to process a highly sensitive color light-sensitive material which is mainly composed of a silver chloroiodobromide or silver iodobromide emultion and which is sensitized with a color sensitizer, in particular a photographic color reversal light-sensitive material and a photographic color negative light-sensitive material in which an emulsion having a high silver content is used, the desilvering is insufficient and it takes a long time for performing bleaching.

For instance, if a photographic color negative light-sensitive material is bleached with a bleaching solution containing a ferric complex of aminopolycarboxylic acid, the required bleaching time is at least 4 minutes and complicated operations such as the control of the pH value of the bleaching solution and aeration process are necessary to hold the bleaching ability thereof. Even when such complicated operations are practically performed, insufficient bleaching is often observed.

Moreover, the bleaching process must be followed by processing with a fixing solution for at least 3 minutes, which leads to further elongation of the desilvering process. Therefore, there is a demand for reducing the processing time.

Particularly, minilab processing has recently spread and, therefore, reduction of processing time is quite important to improve the efficiency of the minilab and to provide users with quick services. However, it is found that the reduction of time required for a desilvering step causes difficulties on improvement of the desilvering speed and raises stain (Dmin) of processed light-sensitive materials. Among them, increase in the magenta stain is remarkable.

It is also required to reduce the amount of waste liquor derived from photographic processing from the viewpoint of preventing environmental pollution and, in the desilvering process, it becomes an important subject to reduce the amount of waste liquor or to reduce the amount of a bleach-fixing solution to be replenished.

German Patent No. 866,605 discloses a bleach-fixing solution containing a ferric complex of aminopolycarboxylic acid and a thiosulfate in one solution to make the disilvering process more rapid. However, if a ferric aminopolycarboxylate which inherently exhibits low oxidation ability (bleaching ability) coexists with a thiosulfate having reducing ability, the bleaching ability thereof is extremely lowered and thus it cannot practically be used as a bleach-fixing solution for sufficiently desilvering highly sensitive photographic color light-sensitive materials having a high silver content. There has been proposed various methods for eliminating such drawbacks of the bleach-fixing solution, for instance, a method in which an iodide or bromide is added thereto as disclosed in U.K. Patent No. 926,569 and Japanese Patent Publication for Opposition Purpose (hereunder referred to as "J.P. KOKOKU") No. 53-11854; a method in which a ferric aminopolycarboxylate is contained in a high content using a triethanolamine as disclosed in Japanese Patent Unexamined Publication (hereunder referred to as "J.P. KOKAI") No. 48-95834. However, these methods do not provide sufficient effects and, therefore, they cannot practically be employed.

In addition to the insufficient desilvering, the bleach-fixing solution has a further severe problem that cyan dyes formed during color development are reduced by the solution to form leuco dyes and to thus impair color reproduction of the light-sensitive material. As discussed in the specification of U.S. Pat. No. 3,773,510, it is known that this problem can be solved by increasing the pH value of the bleach-fixing solution. However, as pH increases, the bleaching ability on the contrary is extremely lowered and thus the increase in the pH value cannot practically be adopted. U.S. Pat. No. 3,189,452 discloses a method for oxidizing the leuco dyes with a bleaching solution containing red prussiate of potash to convert them into cyan dyes, after the bleach-fixing process. However, the use of red prussiate of potash causes the environmental pollution and even if the light-sensitive materials are additionally bleached after the bleach-fixing process, it is almost impossible to reduce the amount of silver.

By the way, there have been conducted various studies to develop a means for recovering silver as a valuable noble metal from bleach-fixing and/or fixing solutions, for instance, a method for recovering silver by introducing a bleach-fixing solution in an electrolytic cell and then electrolyzing it; a method for recovering silver by diluting the bleach-fixing solution to lower the solubility of a silver salt to precipitate the same; a method for recovering silver by adding sodium sulfide to those solutions in order to form silver sulfide; or a method for recovering silver, in the form of ions, by passing the bleach-fixing solution through a column packed with a large amount of an ion-exchange resin. Such means for recovering silver are detailed in, for instance, Kodak Publication, J-10 (Recovering Silver From Photographic Materials), issued by Kodak Industrial Division; J.P. KOKOKU No. 58-22528; J.P. KOKAI No. 54-19496; Belgian Patent No. 869,087; and DEOS No. 2,630,661.

However, these methods are developed to recover silver from bleach-fixing solutions, but not to reuse the solutions obtained after the recovery of silver. Therefore, there are various obstacles to reuse such bleach-fixing solutions after desilvering. For instance, the bleach-fixing solutions obtained after desilvering cannot be reused or it is necessary to add components which are lost during the recovery of silver to reuse the same (addition of a regenerant). As described above, it has not yet been realized to simultaneously reduce the amount of waste liquor and rapidly carry out the desilvering process while recovering silver.

Accordingly, an object of the present invention is to provide a method for processing silver halide color photographic light-sensitive materials, which comprises a rapid bleaching process capable of reducing the amount of waste bleaching solution.

Further, an object of the present invention is to provide a method for processing silver halide color photographic light-sensitive materials, which comprises a rapid bleaching process capable of reducing the stain.

The aforementioned objects of the present invention can effectively be achieved by providing a method which comprises the steps of color developing a silver halide color photographic light-sensitive material having at least one silver halide emulsion layer containing silver bromoiodide on a substrate and then desilvering the same. The method is characterized in that the bleaching process is carried out in the presence of a bleaching accelerator and that the bleaching process is carried out while a part or whole of a bleaching solution is brought into contact with a strong basic anion-exchange resin.

The inventors of this invention have conducted various studies and have found that a bleaching solution deteriorated due to processing of photographic light-sensitive materials containing silver iodide comprises a large amount of silver ions and a small amount of iodide ions and that the bleaching ability thereof is extremely lowered due to the presence of both these ions. However, if silver ions present in the deteriorated bleaching solution are recovered by any means for recovering silver as described above, the thiosulfate serving as a fixing agent or sulfite ions serving as a preservative thereof are decomposed or removed during the recovery of silver.

Contrary to this, the inventors of this invention have found that the bleaching ability of the solution can be recovered by removing iodide ions present in a small amount, although silver ions are still present therein and that the iodide ions can selectively be removed from the deteriorated bleaching solution by bringing it into contact with an anion-exchange resin.

It has been un-expected that the bleach-accelerating action is extremely improved by using a bleaching accelerator, particularly an organic bleaching accelerator when iodide ions in the bleaching solution are reduced by the method of the present invention. This effect is remarkable when the amount of iodide ions is 0.5 g/l or less, particularly 0.3 g/l or less, expressed in the amount of KI.

As mentioned above, the amount of iodide ions can be reduced and as a result, the replenishing amount of the bleaching solution can be reduced and, at the same time, the amount of the waste solution can be reduced. Whereby it becomes possible to provide a rapid bleaching processing with low-cost and low probability of environmental pollution.

The light-sensitive materials which are processed by the method of the present invention comprises at least one silver halide emulsion layer containing at least one mole % of silver iodide, preferably 5 to 25 mole % and more preferably 7 to 20 mole %.

Therefore, in the method of this invention, there may be processed a color light-sensitive material comprising a substrate provided thereon with at least one layer of silver halide emulsion which contains at least one silver iodide selected from the group consisting of silver iodide, silver iodobromide, silver chloroiodobromide and silver chloroiodide. In this respect, silver chloride and silver bromide may optionally be used in addition to the foregoing silver iodide.

The silver halide grains used in the color photographic light-sensitive materials processed by the method of the invention may be in any crystalline forms such a regular crystalline form as a cubic, octahedral, rhombododecahedral or tetradecahedral form; such an irregular form as a spheric or tabular form; or a composite form thereof. In addition, they may be tabular grains having an aspect ratio of not less that 5 as disclosed in Research Disclosure, Vol. 225, pp. 20–58 (January, 1983).

The silver halide grains may be those having epitaxial structure or those having a multilayered structure whose internal composition (such as halogen composition) differs from that of the surface region.

The average grain size of silver halide is preferably not less than 0.5μ, more preferably in the range of 0.7 to 5.0μ.

The grain size distribution thereof may be either wide or narrow. The emultions comprising a silver halide having a narrow grain size distribution is known as so-called monodisperse emulsions whose dispersion coefficient is preferably not more than 20% and more preferably not more than 15%. The "dispersion coefficient" herein means the standard deviation divided by the average grain size.

The photographic emulsions may comprise any combination of silver chloride, silver bromide, silver iodide, silver iodobromide, silver chloroiodobromide and silver chloroiodide.

The coated amount of silver in the light-sensitive materials processed by the invention is generally 1 to 20 $g/m^2$, preferably 2 to 10 $g/m^2$, provided that the total amount of iodine (AgI) present in the silver halide light-sensitive materials is preferably not less than $4\times10^{-3}$ $mole/m^2$ and more preferably $6\times10^{-3}$ to $4\times10^{-2}$ $mole/m^2$.

The effect of the invention is insufficient when the amount of silver coated on a light-sensitive material is less than 2 $g/m^2$. The use of more than 10 $g/m^2$ of silver makes the bleaching power (desilvering) insufficient and may give an unsatisfactory result.

The silver halide emulsions may contain other salts or complexes such as cadmium salts, zinc salts, lead salts, thallium salts, iridium salts or complex salts thereof, rhodium salts or complex salts thereof and iron salts or complex salts thereof, which are added thereto during the formation of silver halide grains or a physical ripening process.

The bleaching accelerators, preferably organic bleaching accelerators, which are added to a bleaching bath, the bath preceeding it or the light-sensitive layer may be selected from compounds having mercapto groups or disulfide bonds; thiazolidine derivatives, thiourea derivatives and isothiourea derivatives, so far as they show a bleaching acceleration effect and preferred examples thereof are those represented by the following general formula (IA) to (VIA):

$$R^{1A}—S—M^{1A} \qquad \text{(IA)}$$

In the general formula, $M^{1A}$ represents a hydrogen atom, an alkali metal atom or an ammonium residue; and $R^{1A}$ represents an alkyl, alkylene, aryl or heterocyclic group. Preferably the alkyl group has 1 to 5, more preferably 1 to 3 carbon atoms. The alkylene group preferably has 2 to 5 carbon atoms. Examples of the aryl group include phenyl and naphthyl groups, preferably phenyl group. Preferred examples of the heterocyclic groups include nitrogen atom-containing 6-membered rings such as pyridine and triazine; and nitrogen atom-containing 5-membered rings such as azole, pyrazole, triazole and thiazole. Particularly groups containing at least two nitrogen atoms as ring-forming atoms are more preferred. $R^{1A}$ may be substituted with substituents. Examples of such substituents are alkyl, alkylene, alkoxy, aryl, carboxyl, sulfo, amino, alkylamino, dialkylamino, hydroxyl, carbamoyl, sulfamoyl and sulfonamido groups.

Preferred compounds represented by the general formula (IA) are those represented by the following general formulas (IA-1) to (IA-4):

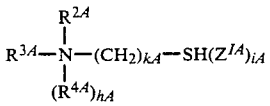

(IA-1)

In the formula, $R^{2A}$, $R^{3A}$ and $R^{4A}$ may be the same or different and each represents a hydrogen atom, a substituted or unsubstituted lower alkyl group (preferably those having 1 to 5 carbon atoms, in particular a methyl, ethyl or propyl group) or an acyl group (preferably those having 1 to 3 carbon atoms, such as an acetyl or propionyl group) and kA is an integer of 1 is 3. $Z^{1A}$ represents an anion such as chloride ion, bromide ion, nitrate ion, sulfate ion, p-toluenesulfonate ion or oxalate ion. hA is 0 or 1 and iA is 0 or 1.

$R^{2A}$ and $R^{3A}$ may be bonded together to form a ring. Particularly preferred group $R^{2A}$, $R^{3A}$ or $R^{4A}$ is a substituted or unsubstituted lower alkyl group.

Examples of substituents of $R^{2A}$, $R^{3A}$ and $R^{4A}$ are hydroxyl, carboxyl, sulfo and/or amino groups.

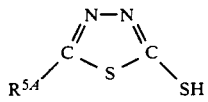

(IA-2)

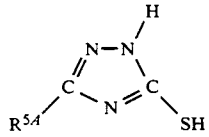

(IA-3)

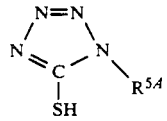

(IA-4)

In the general formulas, $R^{5A}$ represents an hydrogen atom, a halogen atom such as a chlorine or bromine atom, an amino group, a substituted or unsubstituted lower alkyl group preferably having 1 to 5 carbon atoms (particularly, a methyl, ethyl or propyl group), an amino group having alkyl group(s) such as a methylamino, ethylamino, dimethylamino or diethylamino group, or a substituted or unsubstituted alkylthio group.

Examples of substituents of $R^{5A}$ are a hydroxyl group, a carboxyl group, a sulfo group, an amino group, or an amino group having an alkyl group.

$$R^{1A}—S—S—R^{6A} \qquad \text{(IIA)}$$

In the formula, $R^{1A}$ is the same as that in the general formula (IA) and $R^{6A}$ has the same meaning as that of $R^{1A}$. $R^{1A}$ and $R^{6A}$ may be the same or different.

Preferred compounds represented by formula (IIA) are those represented by the following general formula (IIA-1):

(IIA-1)

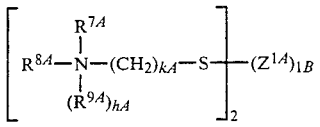

In the formula, $R^{7A}$, $R^{8A}$ and $R^{9A}$ have the same meanings as $R^{2A}$, $R^{3A}$ and $R^{4A}$ defined above. hA, kA and $Z^{1A}$ are the same as those in formula (IA-1). iB is 0, 1 or 2.

(III)

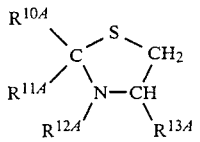

In formula (III), $R^{10A}$ and $R^{11A}$ may be the same or different and each represents a hydrogen atom, an alkyl group optionally having substituents, preferably a lower alkyl group such as a methyl, ethyl or propyl group, a phenyl group optionally having substituents, a heterocyclic group optionally having substituents, more specifically a heterocyclic group including at least one hetero atom selected from the group consisting of nitrogen, oxygen, sulfur atoms or the like, such as a pyridine ring, a thiophene ring, a thiazolidine ring, a benzoxazole ring, a benzotriazole ring, a thiazole ring and an imidazole ring; $R^{12A}$ represents a hydrogen atom or a lower alkyl group optionally having substituents such as a methyl or ethyl group, preferably those having 1 to 3 carbon atoms. Examples of substituents of $R^{10A}$ to $R^{12A}$ are a hydroxyl group, a carboxyl group, a sulfo group, an amino group and a lower alkyl group. $R^{13A}$ represents a hydrogen atom, an alkyl group or a carboxyl group.

(IVA)

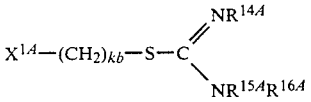

In formula (IVA), $R^{14A}$, $R^{15A}$ and $R^{16A}$ may be the same or different and each represents a hydrogen atom or a lower alkyl group such as a methyl or ethyl group, preferably those having 1 to 3 carbon atoms. kB is an integer of 1 to 5.

$X^{1A}$ represents an amino group optionally having substituents, a sulfo group, a hydroxyl group, a carboxyl group or a hydrogen atom. Examples of the substituents include substituted or unsubstituted alkyl groups (e.g., methyl, ethyl, hydroxyalkyl, alkoxyalkyl and carboxyalkyl groups) and two alkyl groups may be bonded together to form a ring. $R^{14A}$, $R^{15A}$ and $R^{16A}$ may be bonded together to form a ring. Preferred examples of $R^{14A}$ to $R^{16A}$ are a hydrogen atom, a methyl group or an ethyl group; those of $X_{1A}$ include an amino group or a dialkylamino group.

(VA)

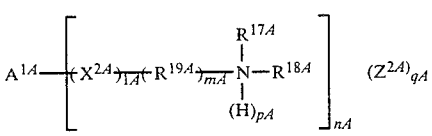

In formula (VA), $A^{1A}$ is an aliphatic linking group, an aromatic linking group or a heterocyclic linking group with a valency of n, wherein $A^{1A}$ is simply an aliphatic, aromatic or heterocyclic group when n is 1.

Alkylene groups having 3 to 12 carbon atoms such as trimethylene, hexamethylene, cyclohexylene are exemplified as the aliphatic linking group represented by $A^{1A}$.

Examples of the aromatic linking groups include arylene groups having 6 to 18 carbon atoms such as phenylene and naphthylene groups.

Examples of the heterocyclic linking groups include heterocyclic groups comprising at least one hetero atom such as oxygen, sulfur and nitrogen atom (e.g., thiophene, furantriazine, pyridine and piperidine).

Generally, the aliphatic, aromatic or heterocyclic linking group comprises a single group, but they may be those comprising two or more of these bonded together directly or through a bivalent linking group (e.g., —O—, —S—, $R^{20A}N<$, $—SO_2—$, —CO— or those formed by combining these groups; $R^{20A}$ represents a lower alkyl group).

These aliphatic, aromatic and heterocyclic linking groups may have substituents.

Examples of such substituents are alkoxy groups, halogen atoms, alkyl groups, hydroxyl group, carboxyl group, sulfo group, sulfonamido group and sulfamoyl group.

$X^{2A}$ represents —O—, —S—, $R^{21A}—N<$ (wherein $R^{21A}$ is a lower alkyl group such as a methyl or ethyl group); $R^{17A}$ and $R^{18A}$ each represents a substituted or unsubstituted lower alkyl group (e.g., methyl, ethyl, propyl, isopropyl or pentyl group) and preferred examples of the substituents are hydroxyl, lower alkoxy groups such as methoxy, methoxyethoxy and hydroxyethoxy groups, amino groups such as unsubstituted amino, dimethylamino and N-hydroxyethyl-N-methylamino groups. If there are two or more substituents, they may be the same or different.

$R^{19A}$ represents a lower alkylene group having 1 to 5 carbon atoms such as methylene, ethylene, trimethylene and methylmethylene; $Z^{2A}$ represents an anion such as a halide ion (e.g., a bromide or chloride ion), a nitrate ion, a sulfate ion, p-toluenesulfonate ion or an oxalate ion.

$R^{17A}$ and $R^{18A}$ may be linked through a carbon or hetero atom (such as oxygen, nitrogen or sulfur atom) to form a 5- or 6-membered heterocyclic ring such as a pyrrolidine, piperidine, morpholine, triazine or imidazolidine ring.

$R^{17A}$ (or $R^{18A}$) and A may be linked through a carbon or hetero atom (such as an oxygen, nitrogen or sulfur atom) to form a 5- or 6-membered heterocyclic ring such as a hydroxyquinoline, hydroxyindole or isoindoline ring.

Moreover, $R^{17A}$ (or $R^{18A}$) and $R^{19A}$ may be linked through a carbon or hetero atom (such as oxygen, nitrogen or sulfur arom) to form a 5- or 6-membered heterocyclic ring such as a piperidine, pyrrolidine or morpholine ring.

lA is 0 or 1; mA is 0 or 1; nA is 1, 2 or 3; pA is 0 or 1; and qA is 0, 1, 2 or 3.

(VIIA)

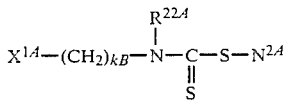

In the formula, $X^{1A}$ and kB are the same as those in the general formula (IVA).

$M^{2A}$ represents a hydrogen atom, an alkali metal atom, an ammonium or —S—CS—$NR^{22A}$—$(CH_2)$-kB—$X^{1A}$ wherein $R^{22A}$ represents a hydrogen atom or a lower alkyl group which has 1 to 5 carbon atoms and may be substituted.

Specific examples of the compounds represented by formulas (IA) to (VIA) are as follows:

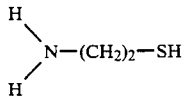
(IA)-(1)

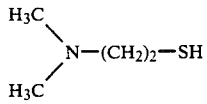
(IA)-(2)

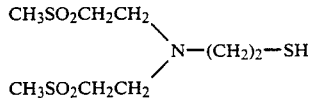
(IA)-(3)

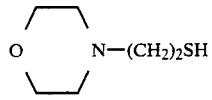
(IA)-(4)

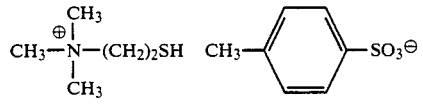
(IA)-(5)

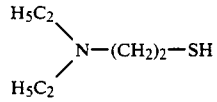
(IA)-(6)

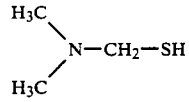
(IA)-(7)

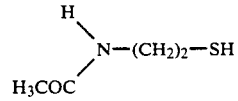
(IA)-(8)

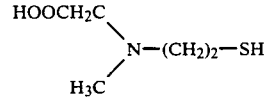
(IA)-(9)

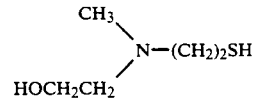
(IA)-(10)

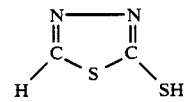
(IA)-(11)

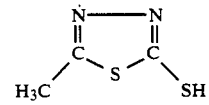
(IA)-(12)

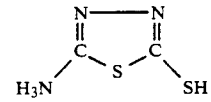
(IA)-(13)

-continued
(IA)-(14)
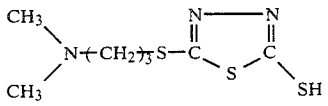
(IA)-(15)
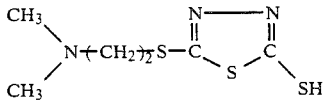
(IA)-(16)
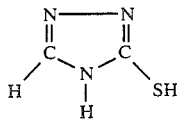
(IA)-(17)
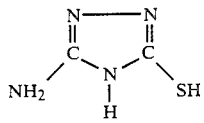
(IA)-(18)
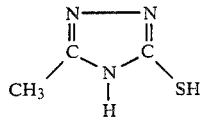
(IA)-(19)
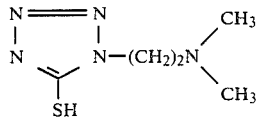
(IA)-(20)
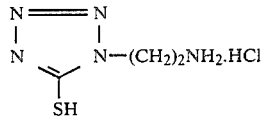
(IA)-(21)
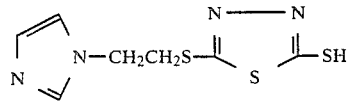
(IIA)-(1)
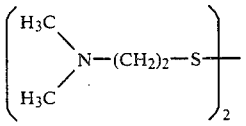
(IIA)-(2)
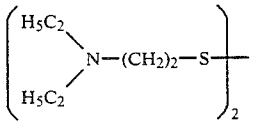
(IIA)-(3)
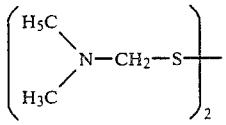
(IIA)-(4)
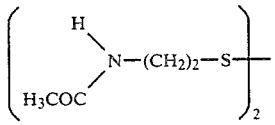

-continued
(IIA)-(5)
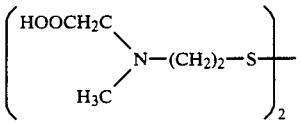
(IIA)-(6)
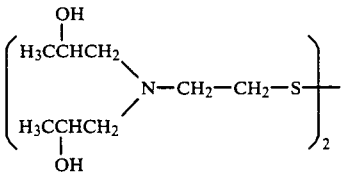
(IIA)-(7)
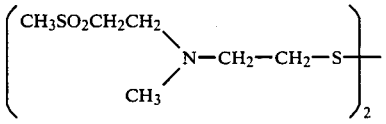
(IIA)-(8)
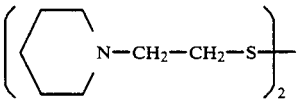
(IIA)-(9)
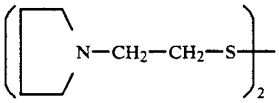
(IIA)-(10)
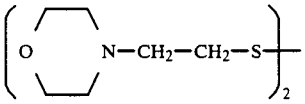
(IIA)-(11)
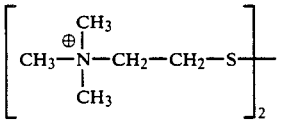
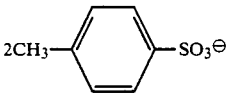
(IIA)-(12)
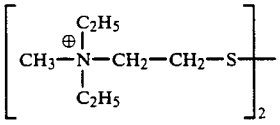
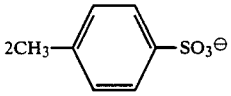
(IIIA)-(1)
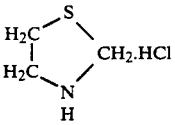
(IIIA)-(2)
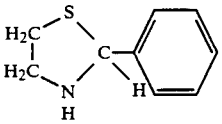

-continued
(IIIA)-(3)
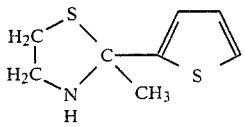
(IIIA)-(4)
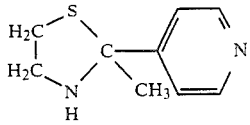
(IIIA)-(5)
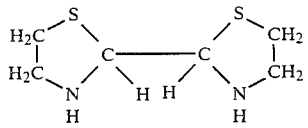
(IIIA)-(6)
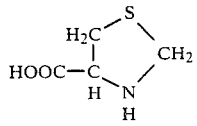
(IVA)-(1)
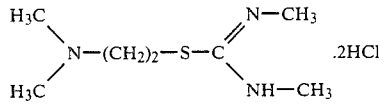
(IVA)-(2)
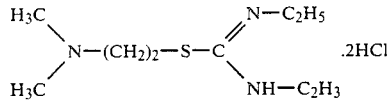
(IVA)-(3)
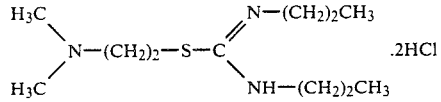
(IVA)-(4)
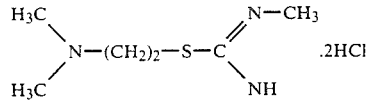
(IVA)-(5)
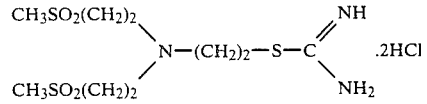
(IVA)-(6)
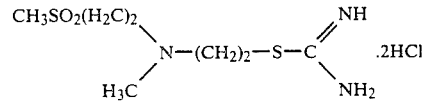
(IVA)-(7)
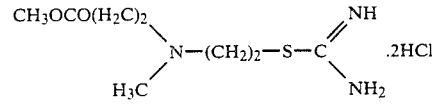
(IVA)-(8)
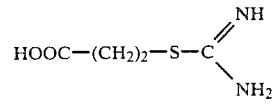
(IVA)-(9)
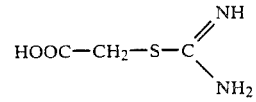

-continued
(IVA)-(10)
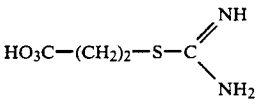
(IVA)-(11)
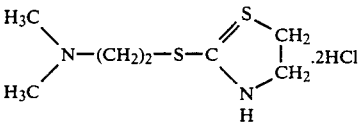
(VA)-(1)
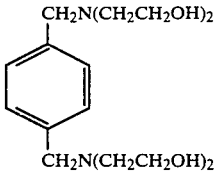
(VA)-(2)
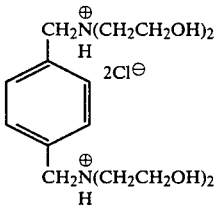
(VA)-(3)
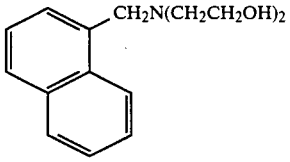
(VA)-(4)
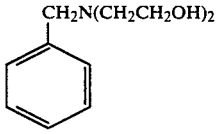
(VA)-(5)
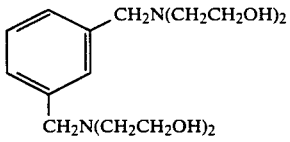
(VA)-(6)
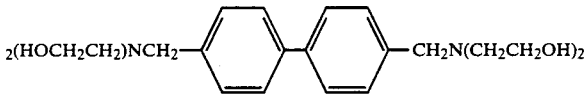
(VA)-(7)
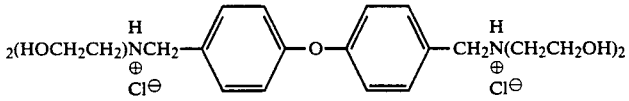
(VA)-(8)
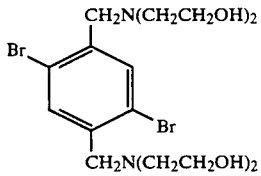

-continued
(VA)-(9)
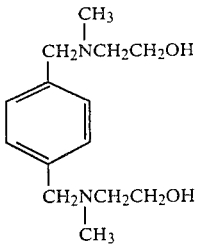
(VA)-(10)
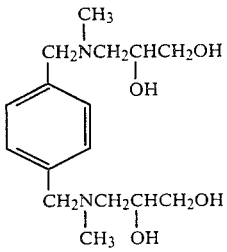
(VA)-(11)
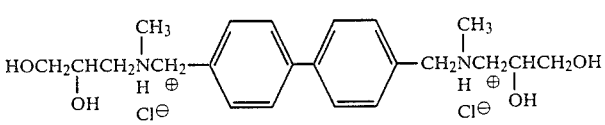
(VA)-(12)
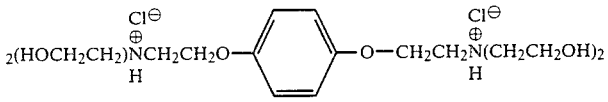
(VA)-(13)
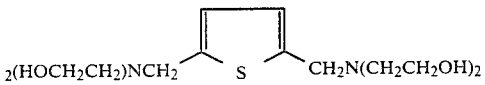
(VA)-(14)
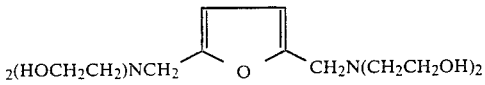
(VA)-(15)
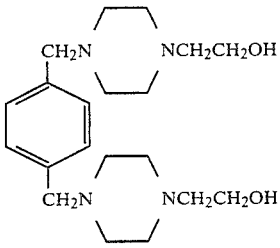
(VA)-(16)
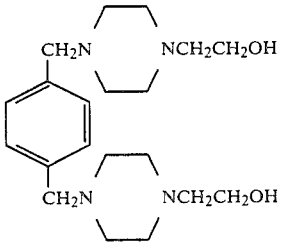

-continued
(VA)-(17)
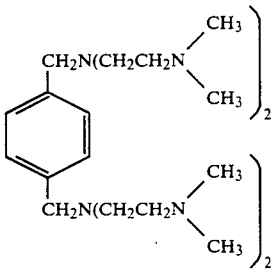
(VA)-(18)
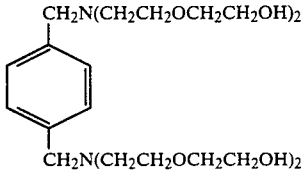
(VA)-(19)
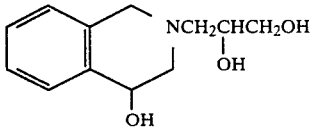
(VA)-(20)
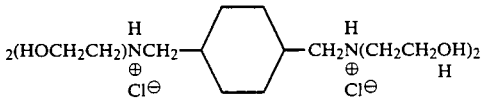
(VA)-(21)
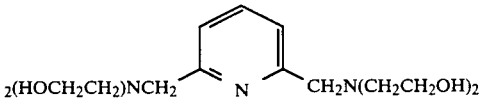
(VA)-(22)
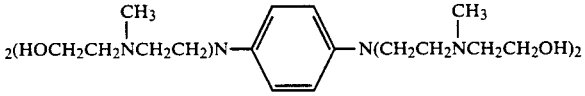
(VA)-(23)
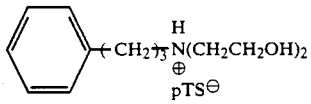
(VA)-(24)
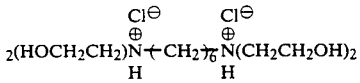
(VA)-(25)
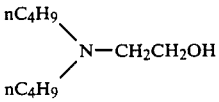
(VA)-(26)
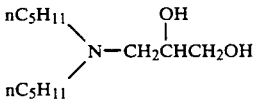
(VIA)-(1)
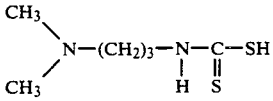
(VIA)-(2)
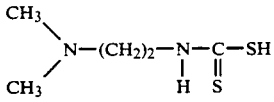

-continued (VIA)-(3)

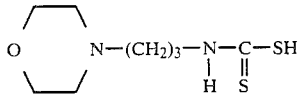

(VIA)-(4)

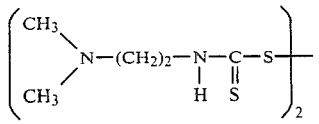

(VIA)-(5)

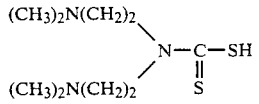

Biscations and bisamines as disclosed in J.P.A. (Japanese Patent Application Serial) Nos. 62-143467, 62-185030, 62-185031, 62-274094, 62-274095 and 62-277580 can be used as bleaching accelerators in addition to the foregoing compounds.

The above listed compounds may be prepared according to any known methods. More specifically, compounds (I) may be prepared by the method disclosed in U.S. Pat. No. 4,285,984; G. Schwarzenbach et al., Helv. Chim. Acta, 1955, Vol. 38, p. 1147; and R. O. Clinton et al., J. Am. Chem. Soc., 1948, Vol. 70, p. 950; compounds (II) by the method disclosed in J.P. KOKAI No. 53-95630; compounds (III) and (IV) by the method disclosed in J.P. KOKAI No. 54-52534; compounds (V) by the method disclosed in J.P. KOKAI Nos. 51-68568, 51-70763 and 53-50169; compounds (VI) by the method disclosed in J.P. KOKOKU No. 53-9854 and J.P. KOKAI No. 59-214855; and compounds (VII) by the method disclosed in J.P. KOKAI No. 53-94927.

The amount of the bleaching accelerators to be added to the bleaching solution used in the invention may vary depending on the kinds of the photographic light-sensitive materials to be processed, processing temperature, processing time of the intended process and the like, but it is desirably in the range of $1\times10^{-5}$ to $1\times10^{-1}$ mole, preferably $1\times10^{-4}$ to $5\times10^{-2}$ mole per liter of the bleaching solution.

These compounds may in general be added to the bleaching solution in the form of a solution in water, an alkaline solution, an organic acid or an organic solvent. Alternatively, it is also possible to directly add powder to the bleaching solution without impairing their effect of accelerating bleaching process.

In the present invention, any commercially available resins may be used as the anion-exchange resins. Particularly, a basic anion-exchange resin is preferably used as the anion-exchange resins of the present invention.

Preferred basic anion-exchange resins used in the invention are represented by the formula (VIII):

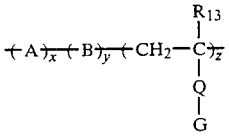

In the formula, A represents a monomer unit obtained by copolymerizing copolymerizable monomers having at least two ethylenically unsaturated copolymerizable groups and at least one of these groups is present in a side chain. B represents a monomer unit obtained by copolymerizing ethylenically unsaturated copolymerizable monomers. $R^{13}$ represents a hydrogen atom, a lower alkyl group or an aralkyl group.

Q represents a single bond, or an alkylene group, a phenylene group, an aralkylene group

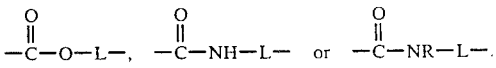

Wherein L represents an alkylene, arylene or aralkylene group and R is an alkyl group.

G represents

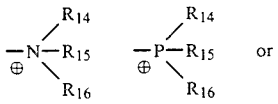

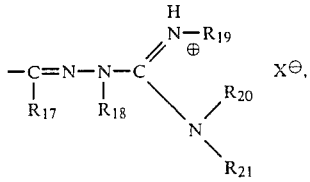

and $R_{14}$, $R_{15}$, $R_{16}$, $R_{17}$, $R_{18}$, $R_{19}$, $R_{20}$ and $R_{21}$ may be the same or different and may be substituted and each represents a hydrogen atom, an alkyl, anyl or aralkyl group. $X^-$ represents an anion. Two or more groups selected from Q, $R_{14}$, $R_{15}$ and $R_{16}$ or Q, $R_{17}$, $R_{18}$, $R_{19}$, $R_{20}$ and $R_{21}$ may be bonded to form a ring structure together with the nitrogen atom.

x, y and z each represents molar percentage, x ranges from 0 to 60, y from 0 to 60 and z from 30 to 100.

The foregoing general formula (VIII) will hereunder be explained in more detail. Examples of monomers from which A is derived are divinylbenzene, ethylene glycol dimethacrylate, diethylene glycol dimethacrylate, triethylene glycol dimethacrylate, ethylene glycol diacrylate, diethylene glycol diacrylate, 1,6-hexanediol diacrylate, neopentyl grlycol dimethacrylate and tetramethylene glycol dimethacrylate and particularly divinylbenzene and ethylene glycol dimethacrylate are preferred.

A may comprise at least two of the foregoing monomer units.

Examples of ethylenically unsaturated monomer from which B is derived include ethylene, propylene, 1-butene, isobutene, styrene, α-methylstyrene, vinyltoluene, monoethylenically unsaturated esters of aliphatic acids (e.g., vinyl acetate and allyl acetate), esters of ethylenically unsaturated monocarboxylic acids or dicarboxylic acids (e.g., methyl methacrylate, ethyl methacrylate, n-butyl methacrylate, n-hexyl methacrylate, cyclohexyl methacrylate, bonzyl methacrylate, n-butyl acrylate, n-hexyl acrylate and 2-ethylhexyl acrylate), monoethylenically unsaturated compounds (e.g., acrylonitrile), or dienes (e.g., butadiene and isoprene). Particularly preferred are styrene, n-butyl methacrylate and cyclohexyl methacrylate. B may comprise two or more of the foregoing monomer units.

$R_{13}$ preferably represents a hydrogen atom, a lower alkyl group having 1 to 6 carbon atoms such as a methyl, ethyl, n-propyl, n-butyl, n-amyl or n-hexyl group or an aralkyl group such as a benzyl group and particularly preferred are a hydrogen atom and a methyl group.

Q preferably represents a divalent optionally substituted alkylene group having 1 to 12 carbon atoms such as a methylene, ethylene or hexamethylene group, an optionally substituted arylene group such as a phenylene group, or an optionally substituted aralkylene group having 7 to 12 carbon atoms such as

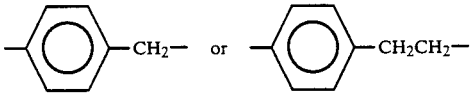

and groups represented by the following

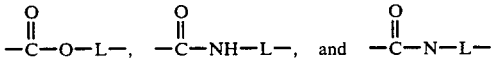

Wherein L preferably represents an optionally substituted alkylene group having 1 to 6 carbon atoms, or an optionally substituted arylene group or an optionally substituted aralkylene group having 7 to 12 carbon atoms, more preferably an optionally substituted alkylene group having 1 to 6 carbon atoms. R is preferably an alkyl group having 1 to 6 carbon atoms.

G represents

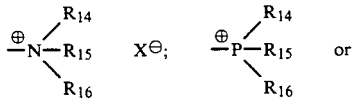

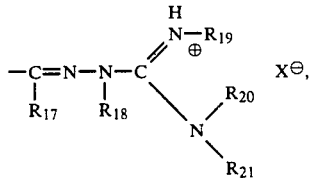

and $R_{14}$, $R_{15}$, $R_{16}$, $R_{17}$, $R_{18}$, $R_{19}$, $R_{20}$ and $R_{21}$ may be the same or different and each represents a hydrogen atom, an alkyl having 1 to 20 carbon atoms, an aryl having 6 to 20 carbon atoms or an aralkyl group having 7 to 20 carbon atoms. These alkyl, aryl and aralkyl groups include substituted alkyl, aryl and aralkyl groups.

Examples of alkyl groups include such unsubstituted alkyl groups as methyl, ethyl, n-propyl, iso-propyl, n-butyl, iso-butyl, t-butyl, n-amyl, iso-amyl, n-hexyl, cyclohexyl, n-heptyl, n-octyl, 2-ethylhexyl, n-nonyl, n-decyl and n-dodecyl groups. The number of carbon atoms of the alkyl group preferably ranges from 1 to 16 and more preferably 4 to 10.

Examples of substituted alkyl groups are alkoxyalkyl groups such as methoxymethyl, methoxyethyl, methoxybutyl, ethoxyethyl, ethoxypropyl, ethoxybutyl, butoxyethyl, butoxypropyl, butoxybutyl and vinyloxyethyl; cyanoalkyl groups such as 2-cyanoethyl, 3-cyanopropyl and 4-cyanobutyl; halogenated alkyl groups such as 2-fluoroethyl, 2-chloroethyl and 3-fluoropropyl; alkoxycarbonylalkyl groups such as ethyoxycarbonylmethyl; allyl group, 2-butenyl group and propargyl.

Examples of aryl groups include such unsubstituted aryl groups as phenyl and naphthyl groups; such substituted aryl groups as alkylaryl groups (e.g., 2-methylphenyl, 3-methylphenyl, 4-mehylphenyl, 4-ethylphenyl, 4-isopropylphenyl and 4-t-butylphenyl); alkoxyaryl groups (e.g., 4-methoxyphenyl, 3-methoxyphenyl and 4-ethoxyphenyl); and aryloxyaryl groups (e.g., 4-phenoxyphenyl). The number of carbon atoms of the aryl group preferably ranges from 6 to 14, more preferably 6 to 10. Particularly preferred is a phenyl group.

Examples of aralkyl groups include unsubstituted aralkyl groups such as benzyl, phenethyl, diphenylmethyl and naphthylmethyl; substituted aralkyl groups such as alkylaralkyl groups (e.g., 4-methylbenzyl, 2,5-dimethylbenzyl and 4-isopropylbenzyl), alkoxyaralkyl groups (e.g., 4-methoxybenzyl and 4-ethoxybenzyl), cyanoaralkyl groups (e.g., 4-cyanobenzyl), perfluoroalkoxyaralkyl groups (e.g., 4-pentafluoropropoxybenzyl and 4-undecafluorohexyloxybenzyl) and halogenoaralkyl groups (e.g., 4-chlorobenzyl, 4-bromobenzyl and 3-chlorobenzyl). The number of carbon atoms of the aralkyl group preferably ranges from 7 to 15 and more preferably 7 to 11. Among these, benzyl and phenethyl groups are particularly preferred.

$R_{14}$, $R_{15}$ and $R_{16}$ each preferably represents an alkyl or aralkyl group, in particular they represent alkyl groups whose total number of carbon atoms ranges from 12 to 30.

$R_{17}$ to $R_{21}$ each preferably represents a hydrogen atom or an alkyl group.

$X^{\ominus}$ represents an anion such as a hydroxide ion, a halogen ion (e.g., chloride or bromide ion), an alkyl- or arylsulfonate ion (e.g., a methanesulfonate, ethanesulfonate, benzenesulfonate or p-toluenesulfonate ion), an acetate ion, a sulfate ion and a nitrate ion. Particularly preferred are chloride, acetate and sulfate ions.

At least two groups selected from Q and $R_{14}$ to $R_{16}$ may be preferably be bonded to form a ring structure together with the nitrogen atom. Examples of such rings preferably include pyrrolidine, piperidine, morpholine, pyridine, imidazole and quinuclidine rings. Particularly preferred are pyrrolidine, morpholine, piperidine, imidazole and pyridine rings.

At least two groups selected from Q and $R_{17}$ to $R_{21}$ may be bonded to form a ring structure together with the nitrogen atom. Particularly preferred are 5- or 6-membered ring structures.

The basic anion-exchange resins of the invention may comprise two or more of the foregoing monomer units:

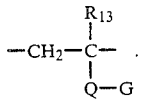

x ranges from 0 to 60 mole %, preferably 0 to 40 mole %, and more preferably 0 to 30 mole %. y ranges from 0 to 60 mole %, preferably 0 to 40 mole % and more preferably 0 to 30 mole %. z ranges from 30 to 100 mole %, preferably 40 to 95 mole % and more preferably 50 to 85 mole %.

Among the compounds represented by formula (VIV), particularly preferred are those represented by the following general formula (IX):

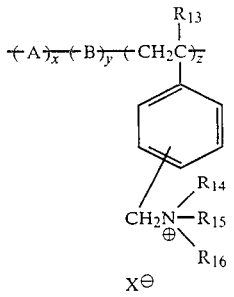

(IX)

In the formula, A, B, x, y, z, $R_{13}$ to $R_{16}$, and $X^-$ are the same as those in the general formula (VIII).

More preferred are those represented by formula (IX) in which all of the groups $R_2$ to $R_4$ are alkyl groups whose total number of carbon atoms ranges from 12 to 30.

Specific examples of the basic anion-exchange resins of the present invention represented by the general formula (VIII) will be listed below, but the compounds of this invention are not restricted to these specific examples.

(1)

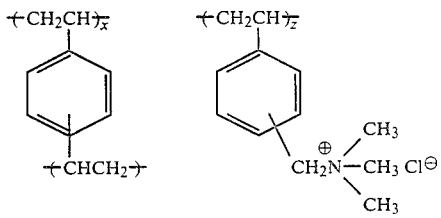

x:z = 10:90

(2)

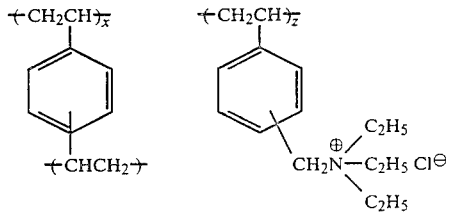

x:z = 25:75

(3)

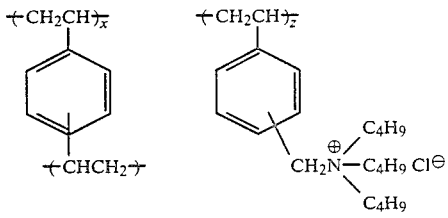

x:z = 31:69

(4)

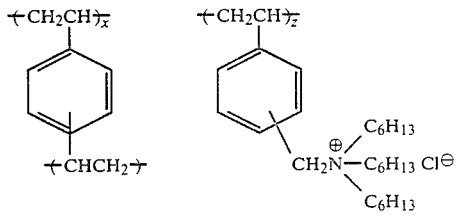

x:z = 33:67

-continued
(5)
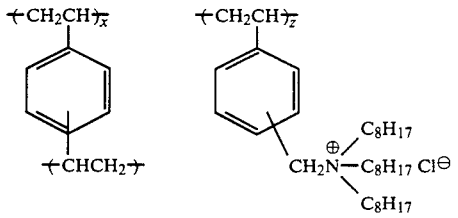
x:z = 30:70
(4)
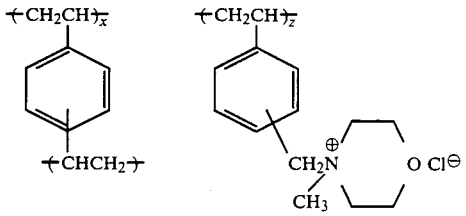
x:z = 10:90
(7)
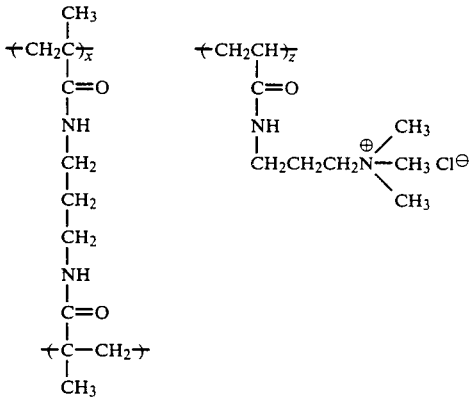
x:z = 20:80
(8)
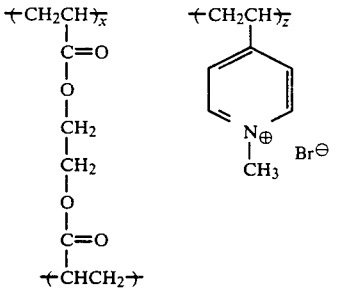
x:z = 20:80
(9)
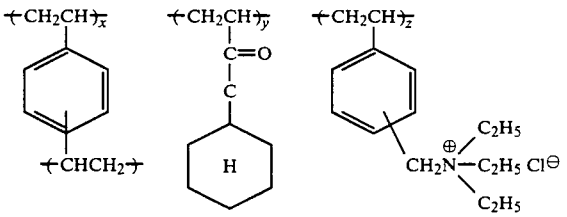
x:y:z = 20:20:60

-continued
(10)
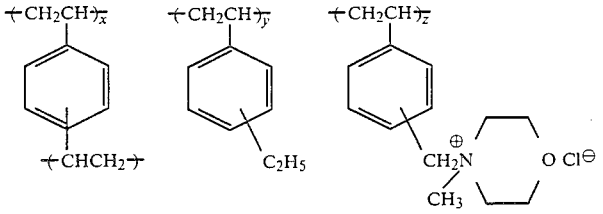
x:y:z = 5:47:48
(11)
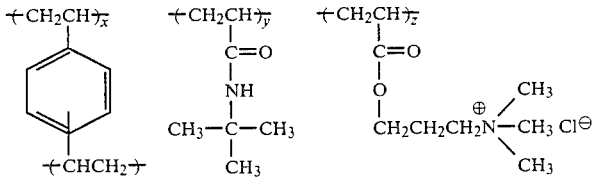
x:y:z = 10:40:50
(12)
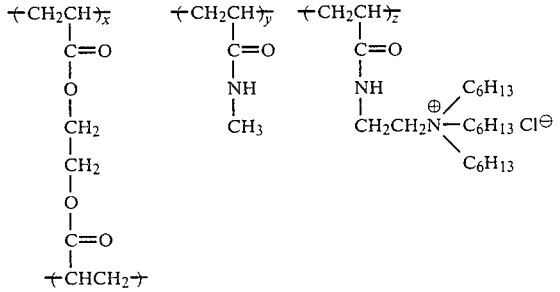
x:y:z = 10:10:80
(13)
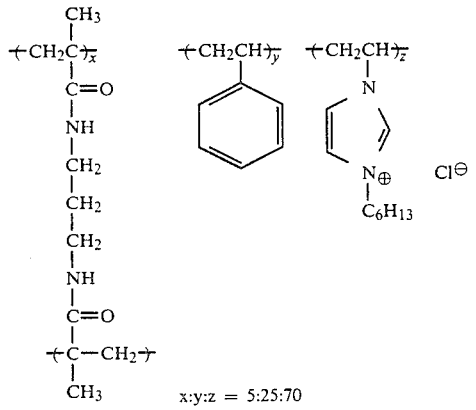
x:y:z = 5:25:70
(14)
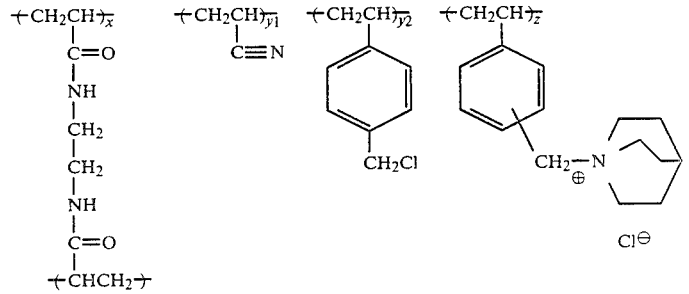
x:y1:y2:z = 10:10:7:73

-continued
(15)
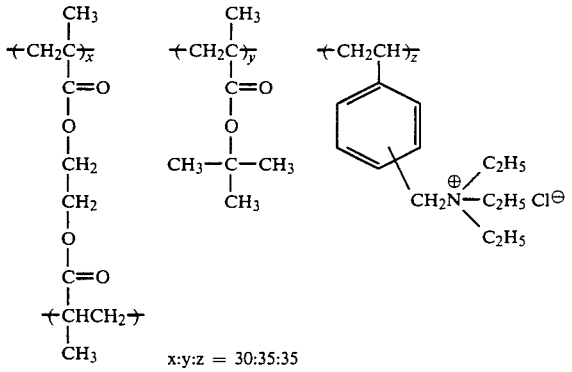
x:y:z = 30:35:35
(16)
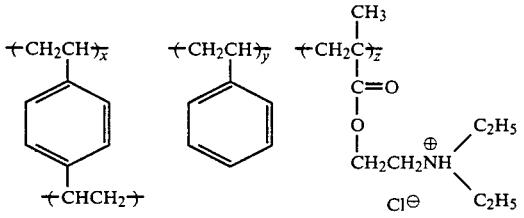
x:y:z = 15:5:80
(17)
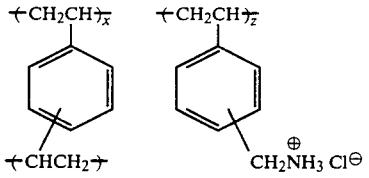
x:z = 36:64
(18)
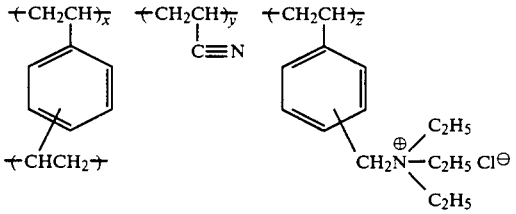
x:y:z = 10:20:70
(19)
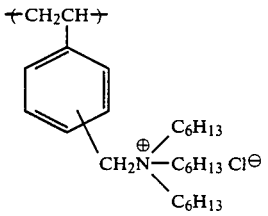
(20)
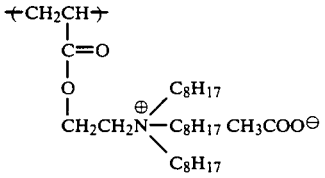

-continued
(21)
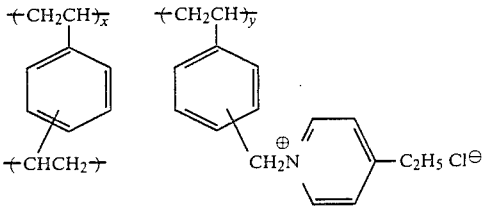
x:z = 20:80
(22)
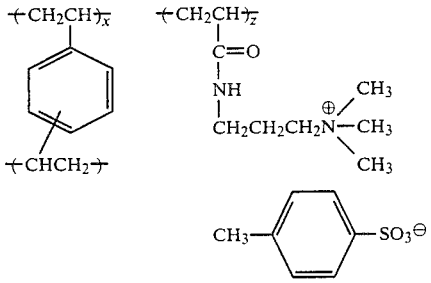
x:z = 15:85
(23)
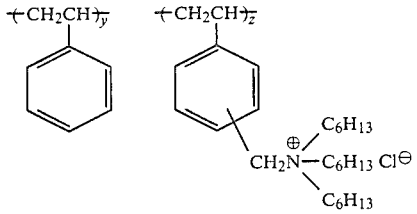
y:z = 45:55
(24)
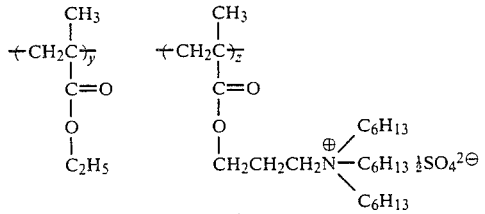
y:z = 40:60
(25)
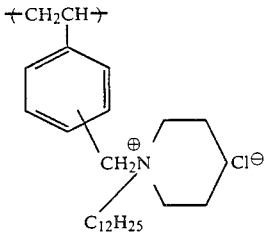
(26)
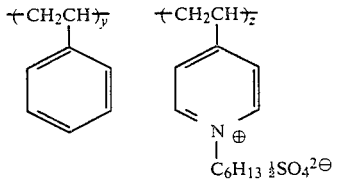
y:z = 25:75

-continued
(27)
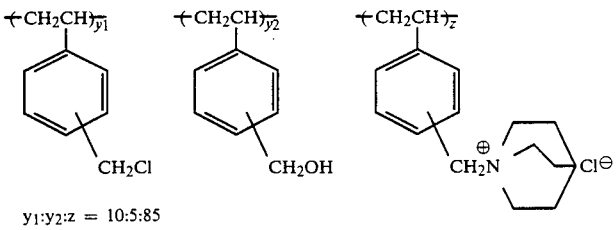
$y_1:y_2:z = 10:5:85$
(28)
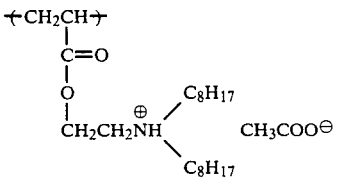
(29)
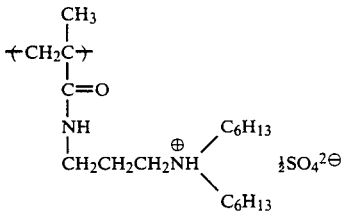
(30)
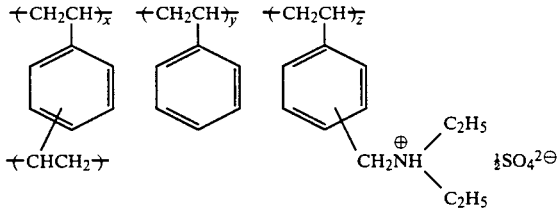
x:y:z = 15:10:75
(31)
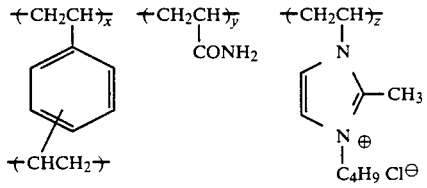
x:y:z = 10:15:75
(32)
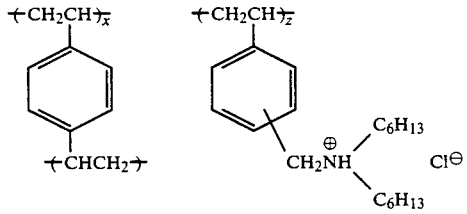
x:z = 10:90
(33)
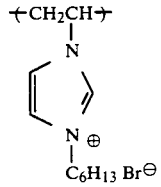

-continued
(34)
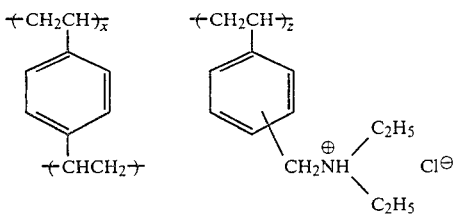
x:z = 10:90
(35)
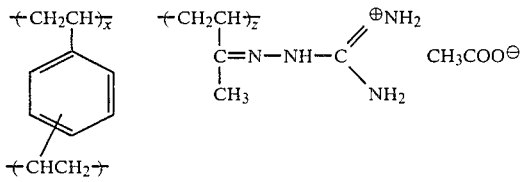
x:z = 30:70
(36)
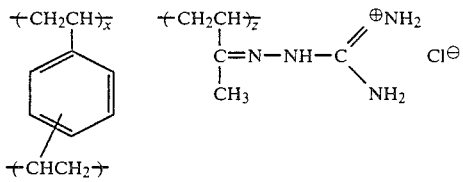
x:z = 20:80
(37)
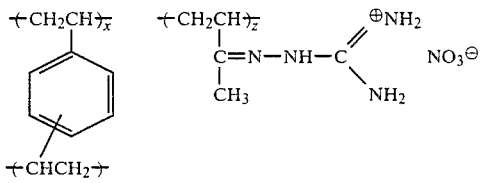
x:z = 25:75
(38)
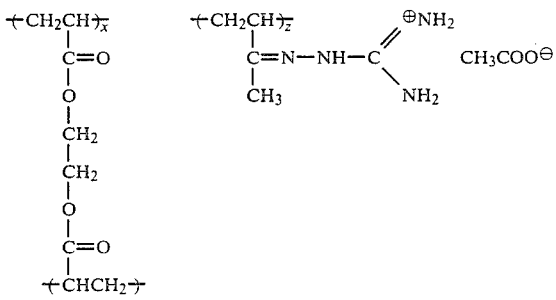
x:z = 40:60

-continued
(39)
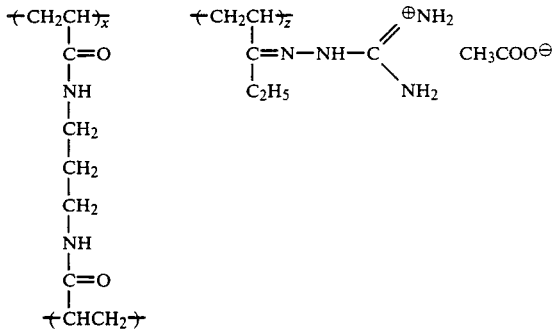
x:z = 20:80
(40)
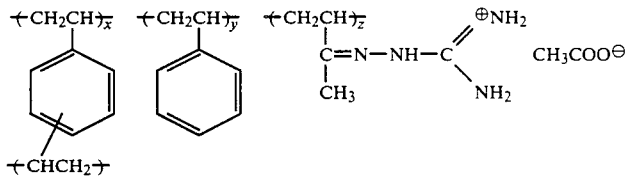
x:y:z = 15:15:70
(41)
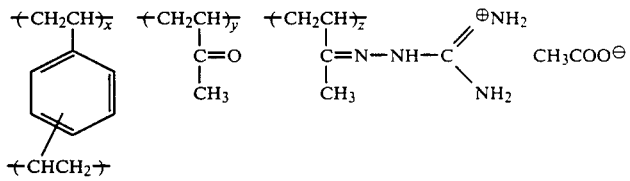
x:y:z = 15:25:60
(42)
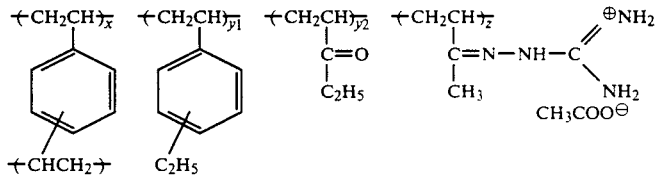
x:y1:y2:z = 20:5:25:50
(43)
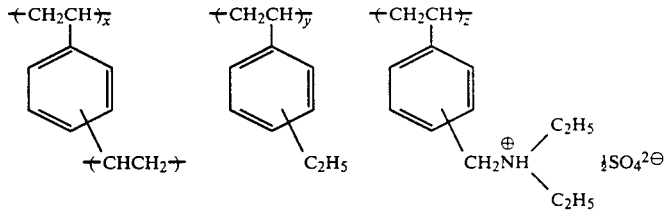
x:y:z = 11:9:80
(44)
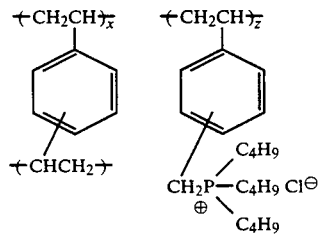
x:z = 30:70

-continued
(45)
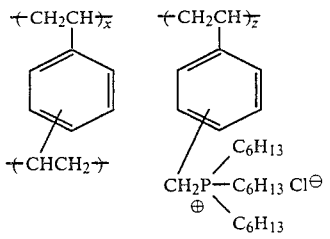
x:z = 30:70
(46)
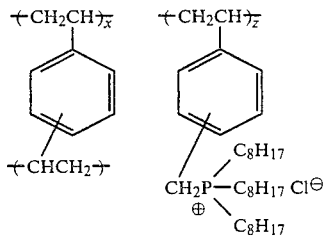
x:z = 25:75
(47)
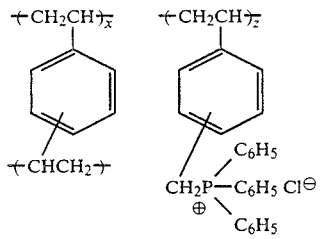
x:z = 30:70
(48)
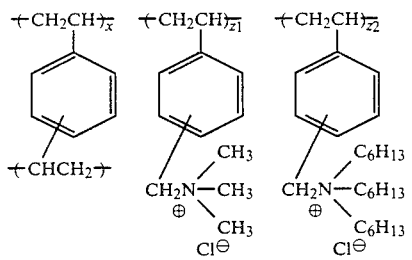
$x:z_1:z_2$ = 10:15:75
(49)
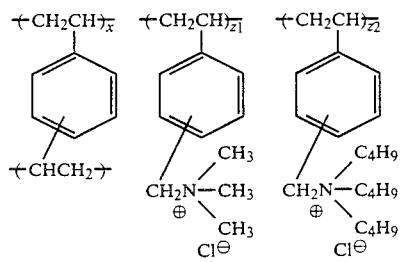
$x:z_1:z_2$ = 15:15:70

-continued (50)

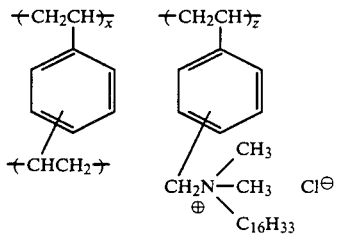

x:z = 30:70

(51)

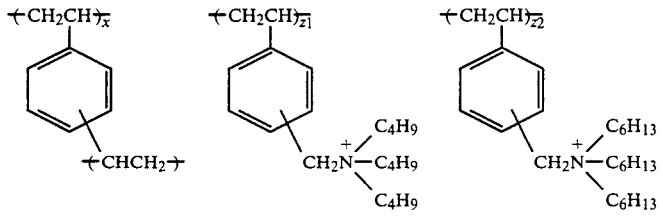

x:z$_1$:z$_2$ = 20:30:50

In the present invention, any commercially available resins may be used as the strong basic anion-exchange resins. Specific examples thereof include Amberlite IRA-410, IRA-411, IRA-910, IRA-400, IRA-401, IRA-402, IRA-430, IRA-458, IRA-900, IRA-904 and IRA-938 (all these being available from Rohm & Haas Co., Ltd.); DIAION SA 10A, SA 12A, SA 20A, SA 21, PA 306, PA 316, PA 318, PA 406, PA 412 and PA 418 (all these being available from MITSUBISHI CHEMICAL INDUSTRIES LTD.) and EPOLUS K-70 (available from MIYOSHI FAT & OIL CO., LTD.).

Moreover, they may be synthesized in accordance with the following Preparation Examples.

GENERAL METHOD FOR PREPARATION

The anion-exchange resins of this invention can be synthesized by quaternarizing a substantially water-insoluble resin having groups capable of being quaternarized with a tertiary amine or a tertiary phosphine (hereunder referred to as a "precarsor resin") with a tertiary amine or a tertiary phosphine to introduce cations. The precursor resins may be prepared by a variety of methods as disclosed in J.P. KOKAI No. 59-39347, U.S. Pat. Nos. 2,874,132; 3,297,648; 3,549,562; 3,637,535; 3,817,878; 3,843,566; 2,630,427 and 2,630,429; German Patent No. 1,151,127 and J.P. KOKOKU Nos. 32-4143, 46-19044, 46-20054, 53-5294, 33-2796 and 33-7397 or methods similar thereto.

The introduction of cationic groups into the precursor resin by quaternarization with a tertiary amine or phosphine can be carried out by using the foregoing precursor resin and a tertiary amine or phosphine according to methods as disclosed in J.P. KOKAI No. 59-39347; U.S. Pat. Nos. 2,874,132; 3,297,648; 3,549,562; 3,637,535; 3,817,878; 3,843,566; 2,630,427; 2,630,429; German Patent No. 1,151,127 and J.P. KOKOKU Nos. 32,4143, 46-19044; 46-20054, 53-5294; 33-2796 and 33-7397 or methods similar thereto.

Alternatively, the anion-exchange resin of this invention may also be obtained by using a substantially water-insoluble monomer having a copolymerizable ethylenically unsaturated group and a quaternary ammonium or phosphonium group in the foregoing methods for synthesizing the precursor resins or the methods similar thereto to form a resin.

Further, the anion-exchange resin of this invention may be obtained by using a monomer mixture of a substantially water-insoluble copolymerizable monomer having a quaternary ammonium or phosphonium group and an ethylenically unsaturated group and a substantially water-insoluble copolymerizable monomer having a group capable of being quaternarized with an amine or phosphine and an ethylenically unsaturated group in the foregoing methods for synthesizing the precursor resin or the methods similar thereto to obtain a resin and then introducing cations into the precursor resin according to the foregoing methods for quaternarization with a tertiary amine or phosphine or the methods similar thereto.

PREPARATION EXAMPLE 1

Preparation of poly(divinylbenzene-co-chloromethylstyrene)

To a 3 l three-necked flask equipped with a stirrer, a thermometer and a cooling tube, there were introduced, at room temperature, 1500 g of water, 2.5 g of polyvinyl alcohol (available from The Nippon Synthemical Chemical Industry Co., Ltd. under the trade name of GOSENOL) and 80 g of sodium chloride and they were sufficiently stirred to dissolve. To the solution, there was added, at room temperature, a solution of 206 g of chloromethylstyrene (available from Seimi Chemical Co., Ltd. under the trade name of CMS-AM), 19.5 g of divinylbenzene, and 4.0 g of benzoyl peroxide in 200 g of toluene and the solution was stirred for one hour at 110 rpm in a nitrogen gas stream. The temperature of the solution was raised to 70° C. to perform the reaction for 7 hours, followed by filtering off the resulting resin spheres, immersing the resin in 5 l of warm water of 50° C. to subject it to ultrasonic washing for 30 min. The resin was likewise washed with 2 l of methanol, 2 l of acetone and 2 l of ethyl acetate, dried at 100° C. under a reduced pressure to obtain 221.2 g of spherical resin particles having a particle size of not more than 1 mm. The resin was subjected to elemental analysis to determine the content of chlorine and it was confirmed that the content was $5.89\times10^{-3}$ mole/g resin.

Preparation of
Poly(divinylbenzene-co-tributylammonio-methylstyrene chloride) (Compound 3)

20 g of poly(divinylbenzene-co-chloromethylstyrene) spherical particles prepared above was weighed and put in a 500 ml 3-necked flask equipped with a stirrer, a thermometer and a cooling tube followed by adding 40 g of isopropyl alcohol, 40 g of dimethylacetamide and 40 g of tributylamine and swelling the resin for 7 hours at room temperature with stirring. The resin was heated to 85° C. to react it for 8 hours under refluxing. Then, the reaction system was cooled to room temperature and solid contents (spherical resin particles) were filtered off. The resin spheres were immersed in warm water of 50° C. to perform ultrasonic washing for 30 min., followed by repeating ultrasonic washing using 2 l of methanol, 2 of acetone, 2 l of ethyl acetate and 2 l of acetone in this order for every 20 min. and drying at 120° C. under a reduced pressure to obtain 38.6 g of spherical resin particles. The chloride ion content was $2.70\times10^{-3}$ (mole/g resin).

The chloride ion content was determined by swelling the ground resin in 1N sodium nitrate solution and titrating the solution with 0.1N silver nitrate.

PREPARATION EXAMPLE 2

Preparation of
N-vinylbenzyl-N,N,N-trihexylammonium chloride 54.9 g (0.36 mole) of chloromethylstyrene, 80.7 g (0.30 mole) of tri-n-hexylamine, 0.5 g of nitrobenzene as a polymerization inhibitor and 400 ml of acetonitrile were fed to 1 l 3-necked flask and they were refluxed under heating for 7 hours with stirring.

After cooling to room temperature, the solution was washed with 500 ml of n-hexane several times to remove unreacted chloromethylstyrene. The solution was concentrated to precipitate crystals and the crystals were recrystallized from 500 ml of ethyl acetate to obtain 103.89 g of intended N-vinylbenzyl-N,N,N-trihexylammonium chloride as white crystals (yield: 82.1%). The molecular structure of the resultant compound was confirmed by $^1$H-NMR and elemental analysis.

Preparation of
Poly(divinylbenzene-co-trihexylammoniomethylstyrene chloride) (Compound 4)

288 g of water and 143.5 g (0.34 mole) of N-vinylbenzyl-N,N,N-trihexylammonium chloride were introduced into a 3 l 3-necked flask equipped with a stirrer, a thermometer and a cooling tube to let sufficiently absorb water to thus obtain an oily substance. To the oily substance, there were added 7.8 g (0.06 mole) of divinylbenzene and 3.0 g of azobisisobutyronitrile (available from WACO JUNYAKU CO., LTD. under the trade name of V-60) and the mixture was stirred to dissolve. Further, a solution of 1080 g of calcium chloride and 2.3 g of polyvinyl alcohol (the same as that used above) in 1152 g of water was added to the resultant solution and the solution was stirred at room temperature for 30 min. at 135 rpm in a nitrogen gas stream. The temperature of the solution was raised to 70° C. and was stirred for 6 hours.

The solution was cooled to room temperature, the solid contents were filtered off and they were subjected to ultrasonic washing in 2 l of distilled water maintained at 50° C. for 30 min. Then, the ultrasonic washing was repeated using 2 l of methanol, 2 l of acetone and 2 l of ethyl acetate as solvents and the solid was dried at 100° C. under a reduced pressure to obtain 122.6 g of spherical particles. The chlorine content thereof was $1.8\times10^{-3}$ (mole/g resin).

PREPARATION EXAMPLE 3

Preparation of
Poly(divinylbenzene-co-trihexylammoniomethylstyrene chloride-co-chloromethylstyrene)

There were introduced, into a 5 l 3-necked flask equipped with a stirrer, a thermometer and a cooling tube, 360 g of water and 84.4 g (0.2 mole) of N-vinylbenzyl-N,N,N-trihexylammonium chloride to let sufficiently absorb water to thus obtain an oily substance. To the oily substance, there were added 10.4 g (0.08 mole) of divinylbenzene, 18.3 g (0.12 mole) of chloromethylstyrene (the same as that used above) and 2.9 g of azobisisobutyronitrile (the same as that used above) and the mixture was stirred to dissolve. To the solution, there was added a solution of 864 g of calcium chloride and 2.0 g of polyvinyl alcohol (the same as that used above) in 930 g of water followed by stirring the mixture at room temperature, for 30 min. at 120 rpm in a nitrogen gas stream. The temperature of the solution was raised to 80° C. and the solution was stirred for 7 hr.

The solution was cooled to room temperature followed by filtering off the solid contents obtained and subjecting them to ultrasonic washing in 2 l of distilled water maintained at 50° C. for 30 min. The ultrasonic washing was repeated using 2 l each of methanol, acetone and ethyl acetate as solvents and the solid contents were dried at 100° C. under a reduced pressure to obtain 95.2 g of spherical particles. The resultant resin was analyzed by elemental analysis and it was found that the total chlorine content thereof was $2.78\times10^{-3}$ (mole/g resin). In addition, the resin was titrated to obtain chloride ion content and it was found to be $1.65\times10^{-3}$ (mole/g resin).

Preparation of
Poly(divinylbenzene-co-tributylammoniomethylstyrene chloride-co-trihexylammoniamethylstyrene chloride) (Compound 51)

There was introduced 75 g of the spherical particles of poly(divinylbenzene-co-trihexylammoniomethylstyrene chloride-co-chloromethylstyrene) into an 1 l 3-necked flask provided with a stirrer, a thermometer and a cooling tube and 100 ml of isopropyl alcohol, 100 ml of acetonitrile and 150 g of tributylamine were added thereto to swell the polymer at room temperature for 7 hr. with stirring. The solution was heated to 80° C. to cause a reaction for 9 hr. with refluxing the solvent. Thereafter, the reaction system was cooled to room temperature and the resultant solid contents (spherical resin particles) were filtered off. The spherical resin was immersed in warm water of 50° C. to carry out ultrasonic washing for 30 min. and it was repeated using 2 l each of methanol, acetone, ethyl acetate and acetone in this order.

PREPARATION EXAMPLE 5

Preparation of Poly(divinylbenzene-co-chloromethylstyrene)

There were introduced, at room temperature, 3000 of water, 5.0 g of polyvinyl alcohol (available from The Nippon Synthemical Chemical Industry Co., Ltd. under the trade name of GOSENOL) and 160 g of sodium chloride into a 5 l 3-necked flask equipped with a stirrer, a thermometer and a cooling tube and the mixture was sufficiently stirred to dissolve. To the solution, there was added a solution of 412 g of chloromethylstyrene (available from SEIMI Chemicals Co., Ltd. under the trade name of CMS-AM), 43.4 g of divinylbenzene and 8.0 g of benzoyl peroxide in 500 g of toluene at room temperature, followed by stirring the solution for 30 min. at 120 rpm in a nitrogen gas stream, raising the temperature to 70° C. and reacting for 7 hr. After the reaction, the resulting spherical resin particles were filtered off, followed by immersing them in 5 l of warm water of 50° C. to perform ultrasonic washing for 30 min., likewise repeating the ultrasonic washing using 2 l each of methanol, acetone and ethyl acetate and drying at 100° C. under a reduced pressure to obtain 440 g of spherical resin particles having a particle size of not more than 1 mm. The resin was subjected to elemental analysis and the chlorine content thereof was found to be $5.85\times10^{-3}$ mole/g resin.

Preparation of Poly(divinylbenzene-co-trimethylammoniomethylstyrene chloride-co-tributylammoniomethylstyrene chloride) (Compound 49)

20 g of poly(divinylbenzene-co-chloromethylstyrene) spherical particles were introduced into a 500 ml 3-necked flask equipped with a stirrer, a thermometer and a cooling tube, and 70 g of isopropyl alcohol, 30 g of dimethylformamide and 40 g tributylamine were added thereto to swell the resin at room temperature for 30 min. with stirring. The reaction system was heated to 80° C. and the reaction was continued for 6 hr. with refluxing the solvent. Then, the reaction system was cooled to room temperature, the resulting solid contents was filtered off, followed by adding 40 g of 30% aqueous trimethylamine solution, reacting at room temperature for 2 hr., raising the temperature to 80° C. by heating for one hour and filtering off the resin particles in the system. The spherical resin was sufficiently washed with running warm water of 50° C., ultrasonic washing was performed for every 30 min. using 2 l each of methanol, acetone, ethyl acetate and acetone in this order and the resin was dried at 120° C. under a reduced pressure to obtain 30.0 g of spherical resin particles. The chloride ion content thereof was $3.1\times10^{-3}$ (mole/g resin).

The chloride ion content was determined by swelling the ground resin in 1N sodium nitrate solution and titrating the solution with 0.1N silver nitrate.

PREPARATION EXAMPLE 6

Preparation of Poly(divinylbenzene-co-trihexylammoniomethylstyrene chloride-co-chloromethylstyrene)

There were introduced, at room temperature, 360 g of water and 168.9 g (0.40 mole) of N-vinylbenzyl-N,N,N-trihexylammonium chloride to let sufficiently absorb water to thus obtain an oily substance. To the oily substance, there were added 5.2 g (0.04 mole) of divinylbenzene, 9.2 g (0.06 mole) of chloromethylstyrene and 4.0 g of benzoyl peroxide and further a solution of 1350 g of calcium chloride in 1,000 g of water and a solution of 2.9 g of polyvinyl alcohol (the same as that used above) in 440 g of water with stirring. The solution was stirred at room temperature, at 150 rpm in a nitrogen gas stream for 30 min., then heated to 70° C. and further stirred for 6 hr.

The solution was cooled down to room temperature, the resulting solid contents were filtered off and were subjected to ultrasonic washing for 30 min. in 2 l of distilled water maintained at 50° C. Then, the washing was repeated using, as solvents, 2 l each of methanol, acetone and ethyl acetate and the solid was dried at 100° C. under a reduced pressure to obtain 176.8 g of spherical resin particles (chloride ion content: $2.1\times10^{-3}$ mole/g resin).

Preparation of Poly(divinylbenzene-co-trimethylammoniomethylstyrene chloride-co-trihexylammoniomethylstyrene) (Compound 48)

150 g of the poly(divinylbenzene-co-trihexylammoniomethylchloride-co-chloromethylstyrene) obtained above was introduced into a 2 l 3-necked flask equipped with a stirrer, a thermometer and a cooling tube and 300 ml of dichloroethane was added thereto at room temperature to swell the resin for 30 min. Then, 500 ml of 30% aqueous trimethylamine solution was added, followed by allowing to stand for one hour to swell and reacting at room temperature for 2 hr. with stirring. Thereafter, the system was heated to 80° C. to get out dichloroethane from the system by azeotropy. 500 ml of water was added in three portions during heating to prevent drying of the resin. After continuing the removal of the solvent until dichloroethane was not distilled by azeotropy, the resultant solid contents were filtered off and washed with running water sufficiently. Then, the solid was subjected to ultrasonic washing in 3 l of warm water of 50° C. for 30 min., followed by repeating the washing using 2 l each of methanol, acetone, ethyl acetate and acetone for every 30 min. and drying the solid at 120° C. under a reduced pressure to obtain 147.2 g of spherical resin particles. The chloride ion content thereof was $3.0\times10^{-3}$ (mole/g).

In the general formula (VIII), G preferably represents

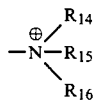

from the viewpoint of selective removal of iodide ions and more preferably G represents such a functional group wherein the total carbon atom number of $R_{14}$ to $R_{16}$ is not less than 12. Specifically, preferred are Compounds (3) to (5), (12), (19), (20), (23), (24), (28), (29), (32), and (44) to (49).

In the method of this invention, the bleaching process is performed while a part or whole of a bleaching solution is brought into contact with an anion-exchange resin. The contact between the bleaching solution and the anion-exchange resin can be carried out by, for instance, packing an anion-exchange resin in a column and incorporating it into a circulating pump of a bleaching bath (e.g., a bleaching or bleach-fixing bath); or charging it into a subtank separately disposed and continuously or intermittently circulating a bleaching solution from the bleaching bath to the subtank. Alternatively, the contact can be performed by a method comprising packaging an anion-exchange resin in a bag of fine mesh net and immersing the same in the bath for bleaching.

The amount of the bleaching solution to be brought into contact with the anion-exchange resins is preferably not less than one liter, more preferably 5 to 3000 liters and most preferably 15 to 2000 liters per liter of the anion-exchange resin.

The terms "amount of the processing solution per liter of the anion-exchange resin" herein means the amount of the processing solution supplemented during a continuous processing of light-sensitive materials per liter of the resin and if a replenisher is supplemented in the amount defined above, the resin should be replaced with a fresh one.

The method may be a continuous or batchwise one, preferably a continuous method.

The continuous processing herein means a processing in which a processing solution is supplemented while the processing is continuously or intermittently performed for a long time period. The amount of the processing solution (replenisher) is determined depending on, for instance, area of the light-sensitive materials to be processed and processing time.

In addition, the method can be applied to a so-called regeneration system in which a solution obtained by bringing the overflow (bleaching solution) from a bleaching bath into contact with an anion-exchange resin is reused as a replenisher.

In general, supplementation of the fixing and bleach-fixing solutions is performed depending on area of the light-sensitive materials to be processed, but if the amount of the replenisher is saved, the rate of bleaching is lowered because of the accumulation of substances dissolved out from the light-sensitive material, as a result, the rate of desilvering is lowered and if the processing time is constant, insufficient bleaching, i.e., insufficient desilvering is caused.

However, in the method of this invention, such delay in bleaching can be prevented since the foregoing bleaching accelerators are used and a replenisher-saved and rapid processing can be achieved.

The light-sensitive materials to be processed by the method of this invention includes emulsion layers containing the aforesaid silver iodide. Other constructions thereof will be described below.

Treatment of Emulsion Layer and General Additives

The emulsions as used herein are subjected to physical and/or chemical ripening and are spectrally sensitized. Additives used in such processes are disclosed in Research Disclosure (RD), Vol. 176, No. 17643 (December, 1978) and ibid, Vol. 187, No. 18716 (November, 1979). The relevant passages are summarized in the following Table. Photographic additives usable in the invention are also disclosed in the same articles (two Research Disclosures) and likewise the relevant passages are listed in the following Table.

| Kind of Additive | RD 17643 | RD 18716 |
|---|---|---|
| 1. Cemical Sensitizer | p. 23 | p. 648, right column |
| 2. Sensitivity Enhancing Agent | | p. 648, right column |
| 3. Spectral Sensitizing Agent | p. 23–24 | infra p. 648, right column |
| 4. Supersensitizing Agent | | p. 649, right column |
| 5. Brightener | p. 24 | |
| 6. Antifoggant & Stabilizer | p. 24–25 | p. 649, right column |
| 7. Coupler | p. 25 | |
| 8. Organic Solvent | " | |
| 9. Light Absorber & Filter Dye and Ultraviolet Absorber | p. 25–26 | p. 649, right to p. 650 left column |
| 10. Stain Resistant Agent | p. 25, right column | p. 650, left to right column |
| 11. Dye Image Stabilizer | p. 25 | |
| 12. Film Hardening Agent | p. 26 | p. 651, left column |
| 13. Binder | p. 26 | p. 651, left column |
| 14. Plasticizer & Lubricant | p. 27 | p. 650, right column |
| 15. Coating Aid & Surfactant | p. 26–27 | p. 650, right column |
| 16. Antistatic Agent | p. 27 | p. 650, right column |

Color Couplers

The color light-sensitive materials to be processed in the present invention may contain color couplers. "Color coupler(s)" herein means a compound capable of forming a dye through coupling reaction with an oxidized form of an aromatic primary amine developing agent. Typical examples of useful color couplers are naphthol or phenol type compounds, pyrazolone or pyrazoloazole type compounds, and linear or heterocyclic ketomethylene compounds. Cyan, magenta and yellow color couplers which may be used in the present invention are disclosed in the patents cited in Research Disclosure No. 17643 (December, 1978) VII-D; and ibid, No. 18717 (November, 1979).

The color couplers to be incorporated into the light-sensitive materials are preferably made non-diffusible by imparting thereto ballast groups or polymerizing them. 2-Equivalent couplers which are substituted with elimination groups are more preferable than 4-equivalent couplers in which a hydrogen atom is in a coupling active site, because the amount of coated silver can be decreased. Furthermore, couplers in which a formed dye has a proper diffusibility, non-color couplers, DIR couplers which release a development inhibitor through coupling reaction or couplers which release a development accelerator during coupling reaction may also be used.

Magenta couplers usable in the invention include couplers of an oil protect type of indazolone, cyanoacetyl, or preferably pyrazoloazole type ones such as 5-pyrazolones and pyrazolotriazoles. Among 5-pyrazolone type couplers, couplers whose 3-position is substituted with an arylamino or acylamino group are preferred from the viewpoint of color phase and color density of the formed dye. Typical examples thereof are disclosed in U.S. Pat. Nos. 2,311,082; 2,343,703; 2,600,788; 2,908,573; 3,062,653; 3,152,896 and 3,936,015. An elimination group of the 2-equivalent 5-pyrazolone type couplers is preferably a nitrogen atom elimination group described in U.S. Pat. No. 4,310,619 and an arylthio group described in U.S. Pat. No. 4,351,897. The 5-pyrazolone couplers having ballast groups such as those described in European Patent No. 73,636 provide high color density.

As examples of pyrazoloazole type couplers, there may be mentioned such pyrazolobenzimidazoles as those disclosed in U.S. Pat. No. 3,369,879, preferably such pyrazolo(5,1-c)(1,2,4)triazoles as those disclosed in U.S. Pat. No. 3,725,067, such pyrazolotetrazoles as those disclosed in Research Disclosure No. 24220 (June, 1984) and such pyrazolopyrazoles as those disclosed in Research Disclosure No. 24230 (June, 1984). Imidazo(1,2-b)pyrazole disclosed in European Patent No. 119,741 is preferred on account of small yellow minor absorption of formed dye and light fastness. Pyrazolo(1,5-b)(1,2,4)triazole described in European Patent No. 119,860 is particularly preferred. In particular in the present invention, the use of pyrazoloazole and 2-equivalent pyrazolone type magenta couplers represented by the following general formulas (M) and (m) is most preferable from the viewpoint of substantially preventing an increase in magenta stains during continuous processing and enhancing desilvering properties:

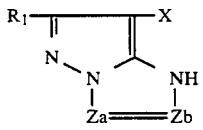
(M)

Wherein Za and Zb represent —CH=,

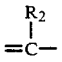

or =N—; $R_1$ and $R_2$ represent a hydrogen atom or a substituent; X represents a hydrogen atom or a group capable of being eliminated through the coupling reaction with an oxidized form of an aromatic primary amine developing agent. If Za=Zb is a carbon-carbon double bond, it encloses cases where Za=Zb is a part of the aromatic ring.

Among the pyrazoloazole magenta couplers of formula (M), preferred are those represented by the following general formulas (M-2) to (M-6):

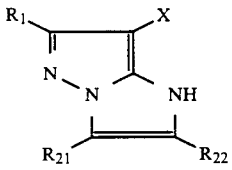
(M-2)

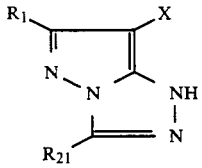
(M-3)

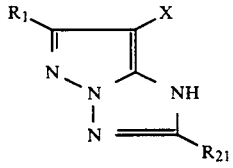
(M-4)

-continued

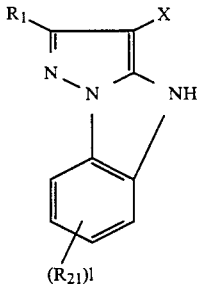
(M-5)

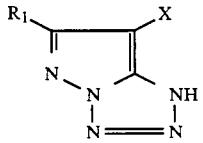
(M-6)

In the general formulas (M-2) to (M-6), $R_1$ and X are the same as those in formula (M), $R_{21}$ and $R_{22}$ have the same meanings as those of $R_2$ defined above in connection with formula (M) and l is an integer of 1 to 4.

The pyrazoloazole magenta couplers represented by formulas (M-2) to (M-6) will be explained in more detail below.

$R_1$, $R_{21}$ and $R_{22}$ each represents a hydrogen atom, a halogen atom (such as fluorine or chlorine atom), an alkyl group (such as methyl, ethyl, isopropyl, 1-butyl, t-butyl or 1-octyl), an aryl group (such as phenyl, p-tolyl, 4-nitrophenyl, 4-ethoxyphenyl, 2-(2-octyloxy-5-t-octylbenzenesulfonamido) phenyl, 3-dodecanesulfonamidophenyl or 1-naphthyl), a heterocyclic group (such as 4-pyridyl or 2-furyl), a hydroxyl, an alkoxy (such as methoxy, ethoxy, 1-butoxy, 2-phenoxyethoxy or 2-(2,4-di-t-amylphenoxy)ethoxy), an aryloxy (such as phenoxy, 2-methoxyphenoxy, 4-methoxyphenoxy, 4-nitrophenoxy, 3-butanesulfonamidophenoxy, 2,5-di-t-amylphenoxy or 2-naphthoxy), a heterocyclic oxy (such as 2-furyloxy), an acyloxy (such as acetoxy, pivaloyloxy, benzoyloxy or dodecoanoyloxy), an alkoxycarbonyloxy (such as ethoxycarbonyloxy, t-butoxycarbonyloxy or 2-ethyl-1-hexyloxycarbonyloxy), an aryloxycarbonyloxy (such as phenoxycarbonyloxy), a carbamoyloxy (such as N,N-dimethylcarbamoyloxy or N-butylcarbamoyloxy), a sulfamoyloxy (such as N,N-diethylsulfamoyloxy or N-propylsulfamoyloxy), a sulfonyloxy (such as methanesulfonyloxy or benzenesulfonyloxy), a carboxyl, an acyl (such as acetyl, pivaloyl, or benzoyl), an alkoxycarbonyl (such as ethoxycarbonyl), an aryloxycarbonyl (such as phenoxycarbonyl), a carbamoyl (N,N-dibutylcarbamoyl, N-ethyl-N-octylcarbamoyl or N-propylcarbamoyl), an amino (such as amino, N-methylamino or N,N-dioctylamino), an anilino (such as N-methylanilino), a heterocyclic amino (such as 4-pyridyl amino), an amido (such as acetamido or benzamido), an urethane (such as N-hexylurethane or N,N-dibutylurethane), an ureido (such as N,N-dimethylureido or N-phenylureido), a sulfonamido (such as butanesulfonamido or p-toluenesulfonamido), an alkylthio (such as ethylthio or octylthio), an arylthio (such as phenylthio or 4-dodecylphenylthio), a heterocyclic thio (such as 2-benzothiazolylthio or 5-tetrazolylthio), a sulfinyl (such as benzenesulfinyl), a sulfonyl (such as methanesulfonyl, octanesulfonyl or p-toluenesulfonyl), a sulfo, a cyano or a nitro group.

X represents a hydrogen, a halogen (such as fluorine, chlorine or bromine atom), a carboxyl, a group bonded through an oxygen atom (such as acetoxy, benzoyloxy, phenoxy, 4-cyanophenoxy, tolyloxy, 4-methanesulfonylphenoxy, 4-ethoxycarbonylphenoxy, 2-naphthoxyethoxy, 2-cyanoethoxy or 2-benzothiazolyloxy), a group bonded through a nitrogen atom (such as benzenesulfonamido, heptafluorobutanamido, pentafluorobenzamido, octanesulfonamido, p-cyanophenylureido, 1-piperidinyl, 5,5-dimethyl-2,4-dioxo-3-oxazolidinyl, 1-benzyl-5-ethoxy-3-hydantoinyl, 1-imidazolyl, 1-pyrozolyl, 3-chloro-1-pyrazolyl, 3,5-dimethyl-1,2,4-triazol-1-yl or 5- or 6-bromobenzotriazol-1-yl), or a group bonded through a sulfur atom (such as phenylthio, 2-butoxy-5-t-octylphenyl, 4-methanesulfonylphenylthio, 4-dodecyloxyphenylthio, 2-cyanoethylthio, 1-ethoxycarbonyltridecylthio, 2-benzothiazolylthio, or 1-phenyl-1,2,3,4-tetrazole-5-thio).

Among the pyrazoloazole magenta couplers represented by formulas (M-2) to (M-6), preferred are those of formulas (M-3) and (M-4).

Typical examples of the pyrazoloazole magenta couplers of formulas (M-2) to (M-6) are as follows, but the present invention is not restricted to these specific examples.

PM-1

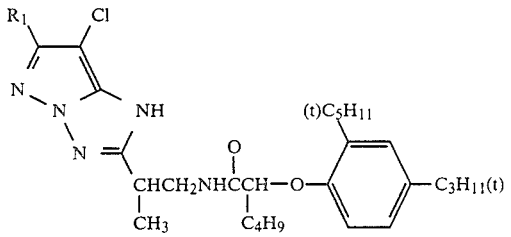

PM-2

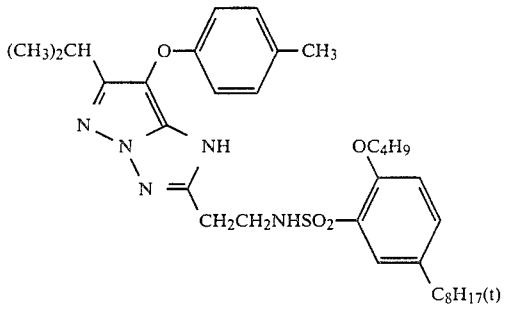

PM-3

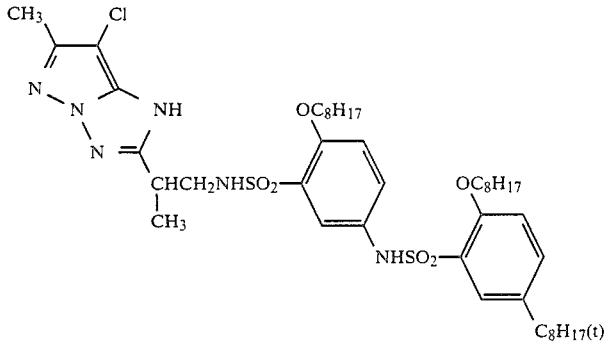

PM-4

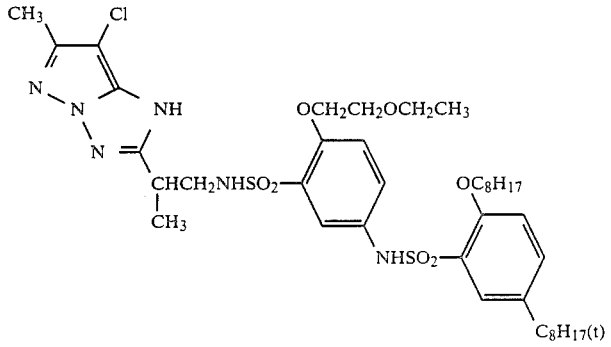

-continued
PM-5
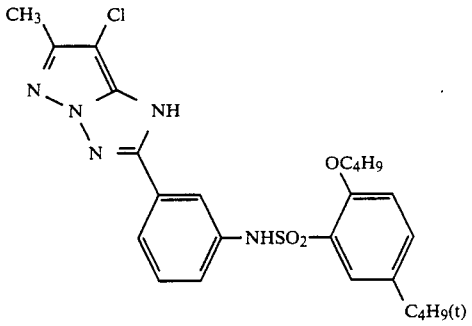
PM-6
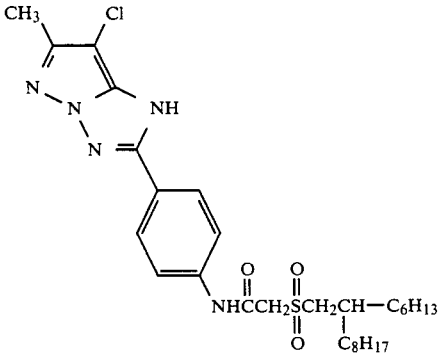
PM-7
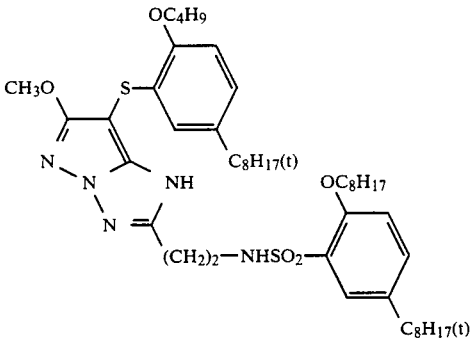
PM-8
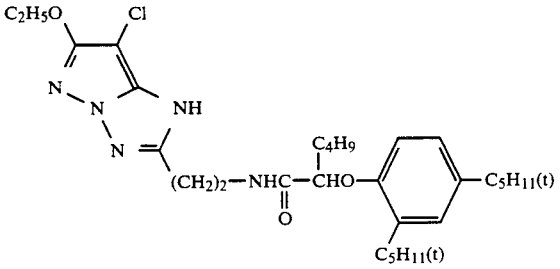

-continued
PM-9
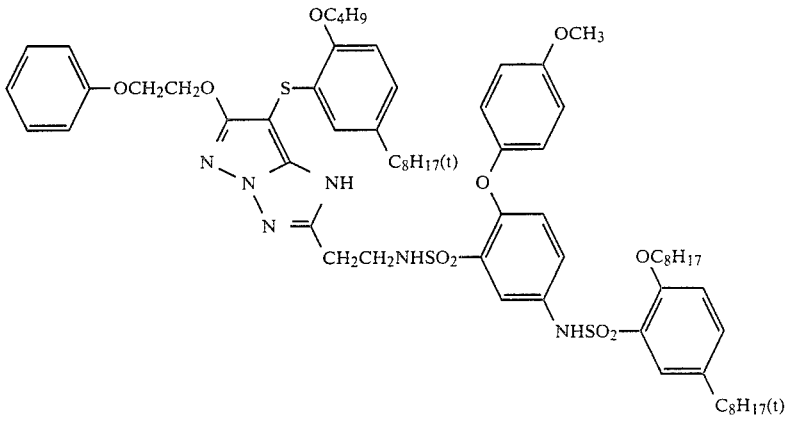
PM-10
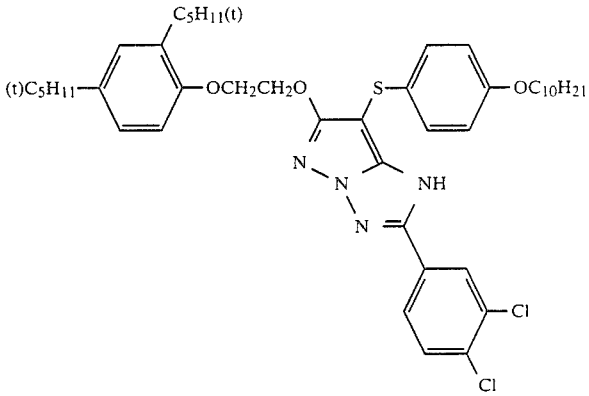
PM-11
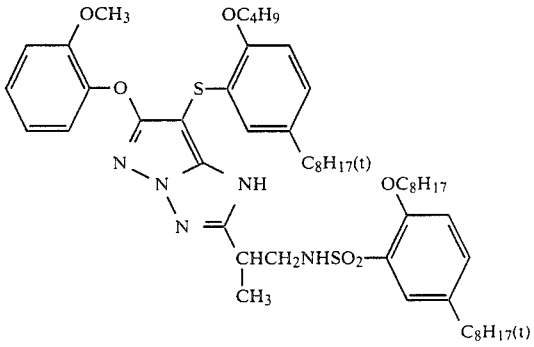
PM-12
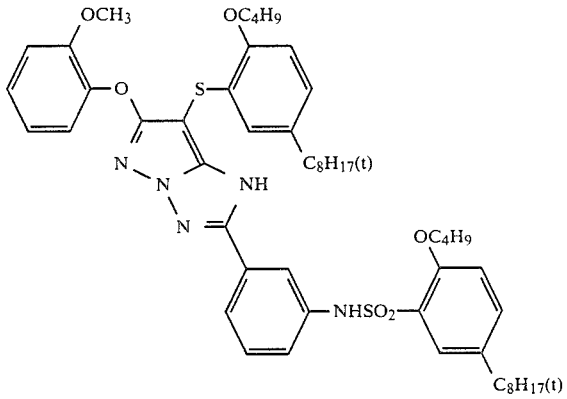

-continued
PM-13
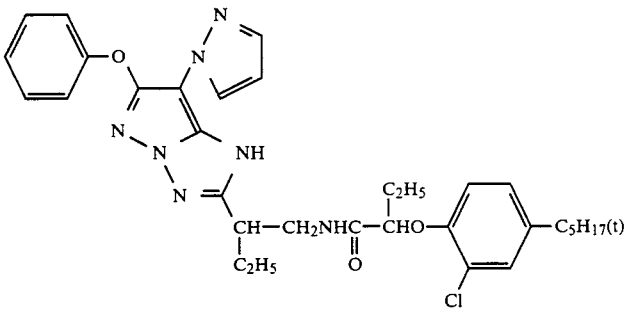
PM-14
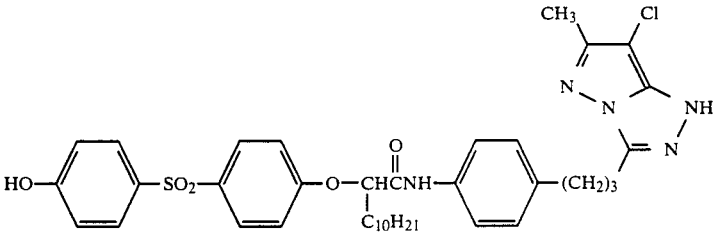
PM-15
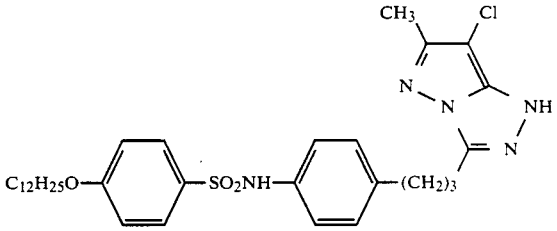
PM-16
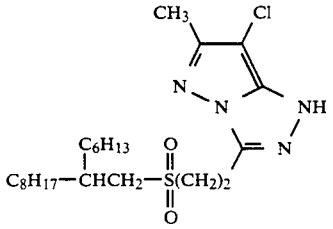
PM-17
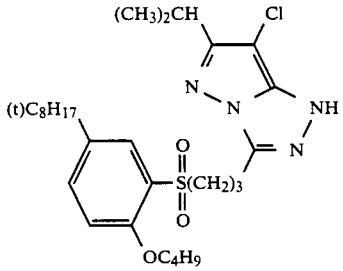
PM-19
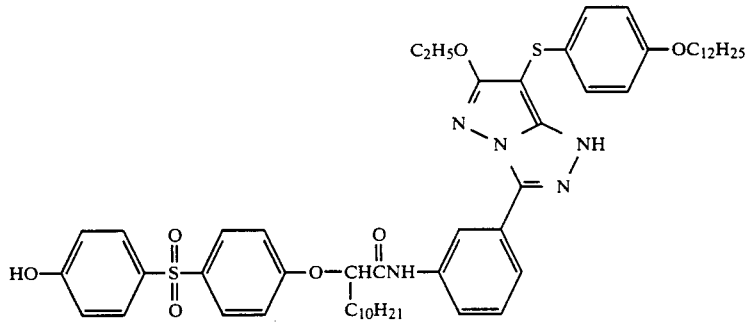

-continued
PM-20
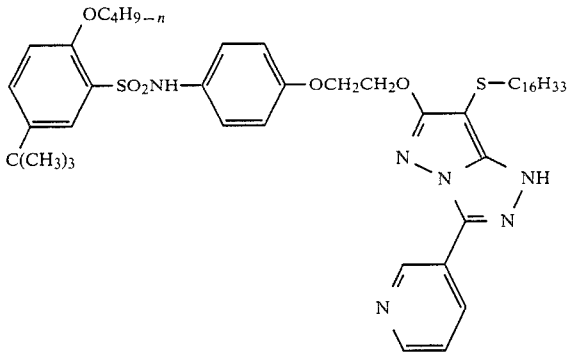
PM-21
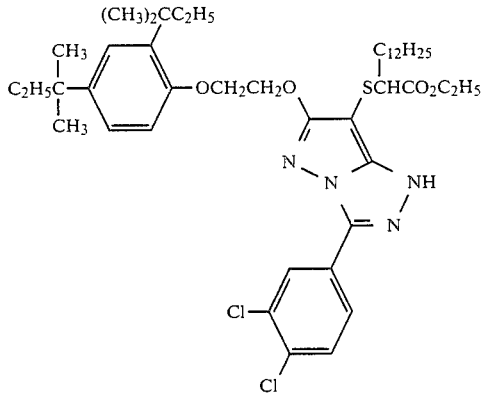
PM-22
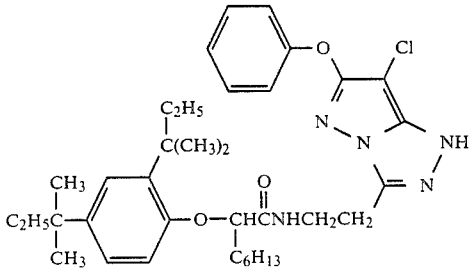
PM-23
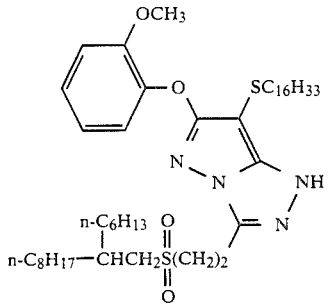
PM-24
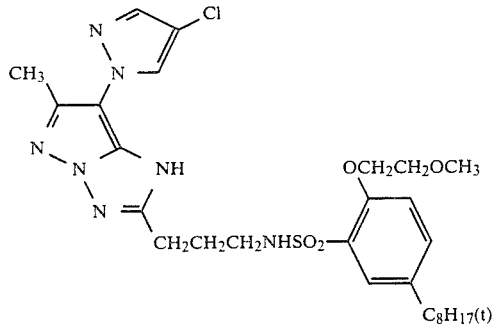

-continued

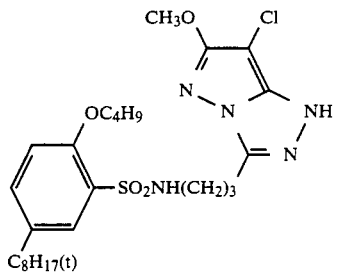

PM-25

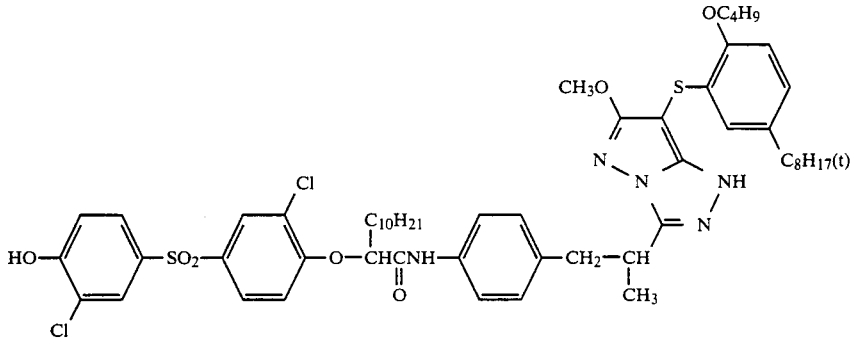

PM-26

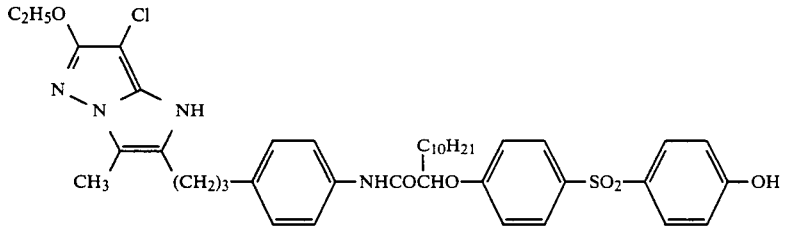

PM-27

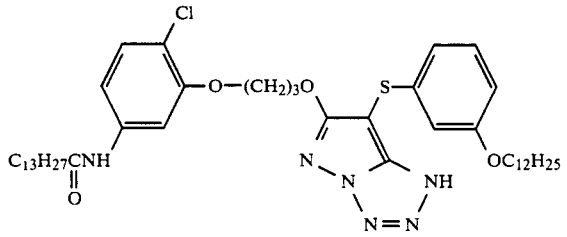

PM-28

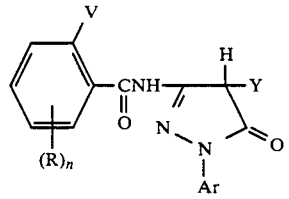

(m)

In the formula, Ar represents a substituted or unsubstituted phenyl group, Y is a group which is eliminated through a coupling reaction with an oxidized form of an aromatic primary amine color developing agent to form a dye. V represents a halogen atom or an alkoxy or alkyl group, R represents a group capable of being substituted on the benzene ring, an n is 1 or 2. When n is 2, two groups R may be the same or different.

The magenta couplers represented by formula (m) used in the invention will be explained in detail below.

First of all, each group Ar, Y, V or R in formula (m) will be specifically explained below.

Ar: This represents a phenyl group, in particular, a substituted phenyl group. Examples of such substituents are halogen atoms, alkyl groups, alkoxy groups, aryloxy groups, alkoxycarbonyl groups, cyano group, carbamoyl group, sulfamoyl group, sulfonyl group, sulfonamido groups, acylamino group. The phenyl group represented by Ar may have two or more substituents. Particularly preferred are halogen atoms and most preferred is chlorine atom(s).

Y: This represents a group which is eliminated when the coupler causes coupling with an oxidized form of an aromatic primary amine color developing agent to form a dye.

Specific examples thereof are halogen atoms, alkoxy, aryloxy, acyloxy, arylthio, alkylthio groups and

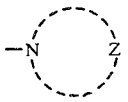

(wherein Z represents a group having an atom selected from oxygen, nitrogen and sulfur atoms required for forming a 5- or 6-membered ring together with the nitrogen atom). Examples of -N Z are pyrazolyl, imidazolyl, triazolyl and tetrazolyl groups. Particularly preferred Y are those eliminated at sulfur atom.

V represents a halogen atom or an alkoxy or alkyl group. Preferred are halogen atoms, in particular a chlorine atom.

R: represents a group capable of being substituted on the benzene ring and examples thereof include halogen atoms, R'—, R'O—, R'—CO—NR''—, $R'SO_2$—NR''—, R''—O—CO—NR'', R'—COO—, R'—NR''—CO—, R'—NR''—$SO_2$—, R'—O—CO—, R'—NR''—CO—NR'''— and

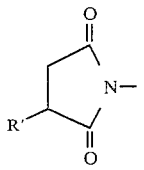

Wherein R', R'', R''' may be the same or different and each represents a hydrogen atom or a substituted or unsubstituted alkyl, alkenyl or aryl group. Among these, preferred are R'—CONH—, $R'SO_2NH$— and

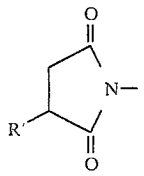

Specific examples of the magenta couplers used in the invention represented by formula (m) will be listed below, but the invention is not restricted to these specific examples.

m-1

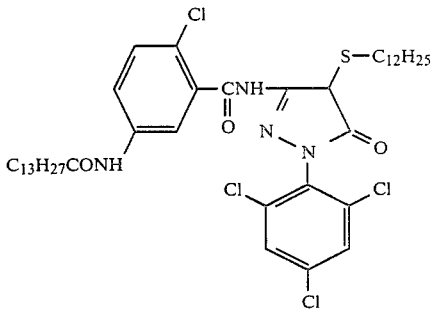

m-2

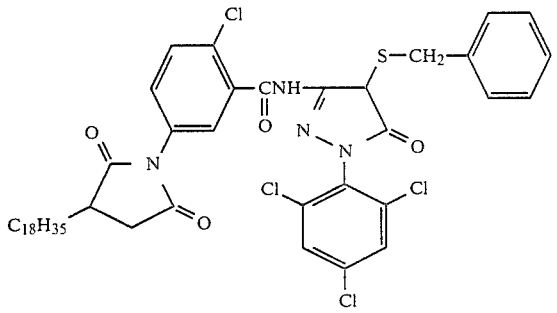

m-3

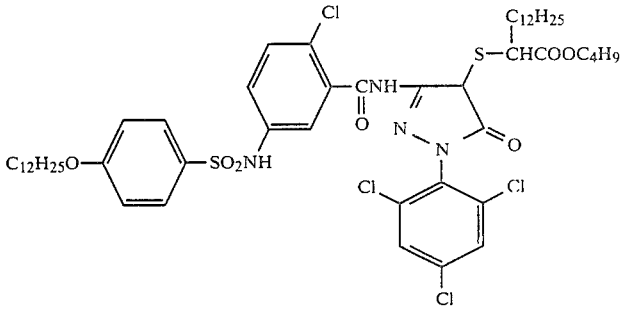

-continued
m-4
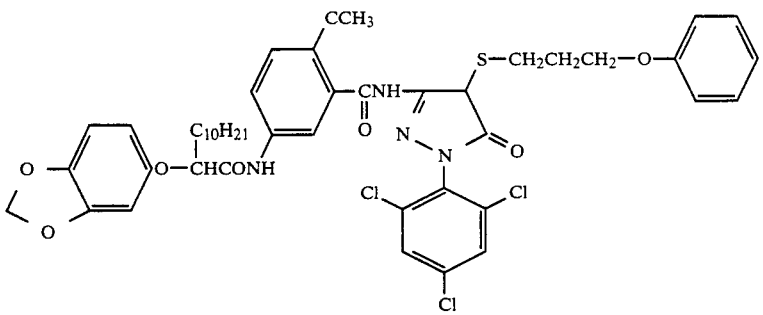
m-5
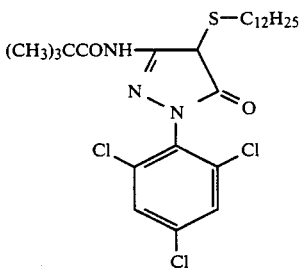
m-6
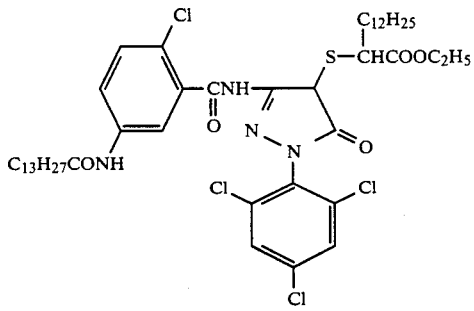
m-7
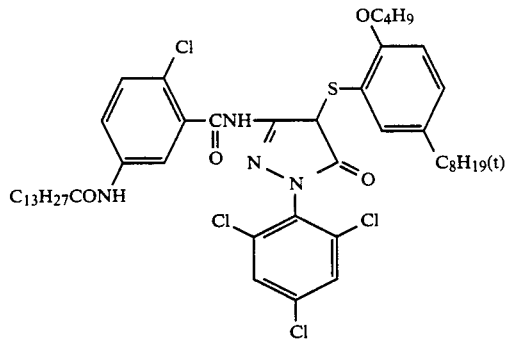
m-8
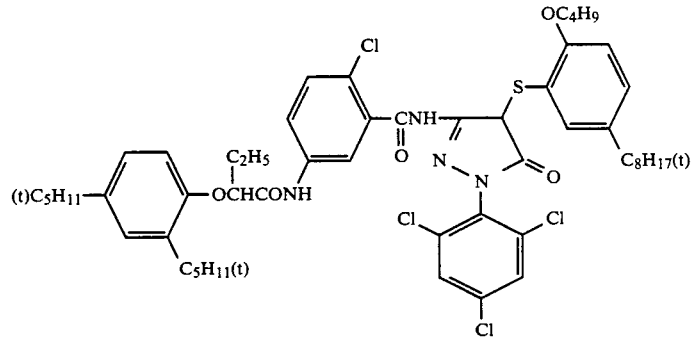

-continued
m-9
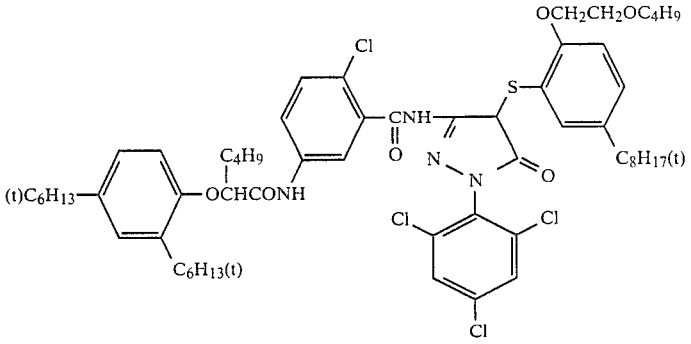
m-10
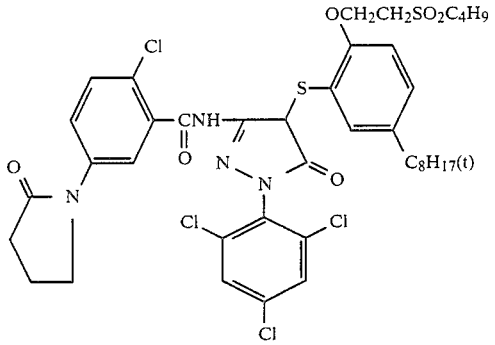
m-11
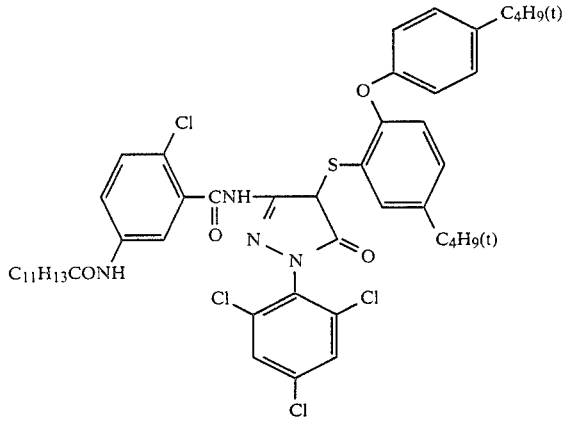
m-12
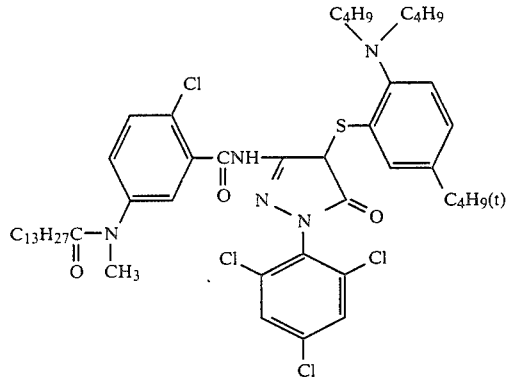

-continued
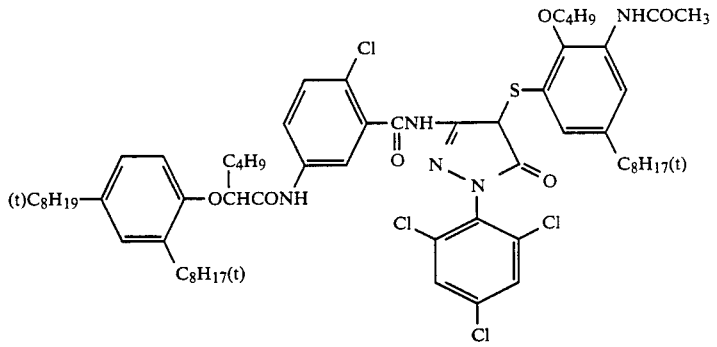
m-13
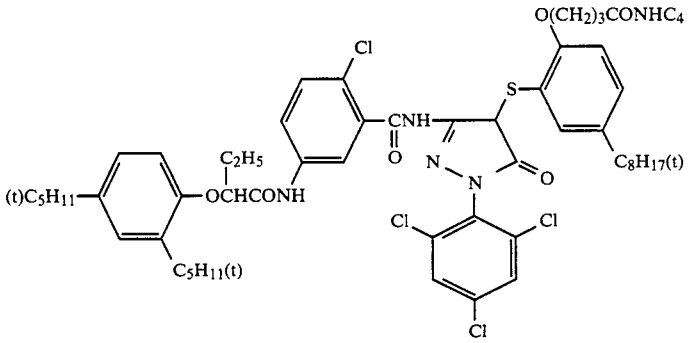
m-14
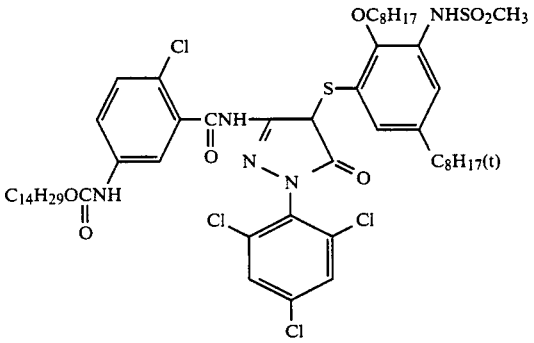
m-15
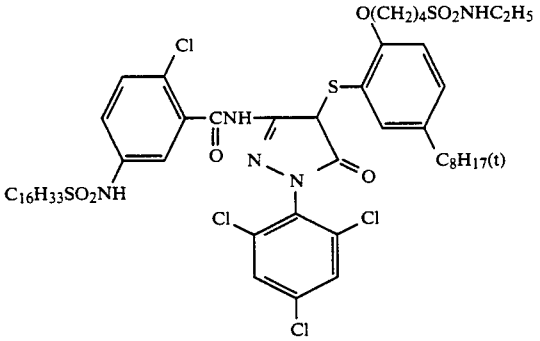
m-16

-continued
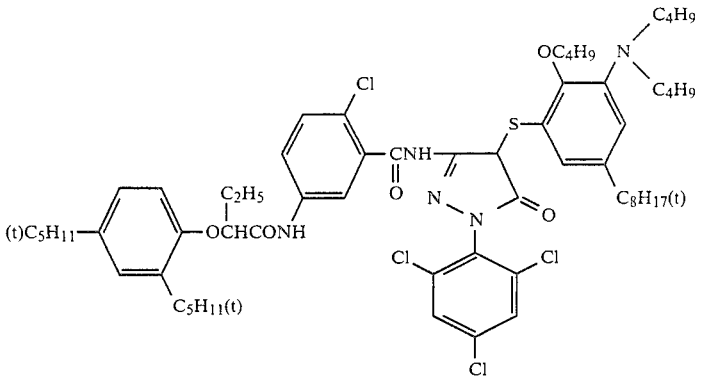
m-17
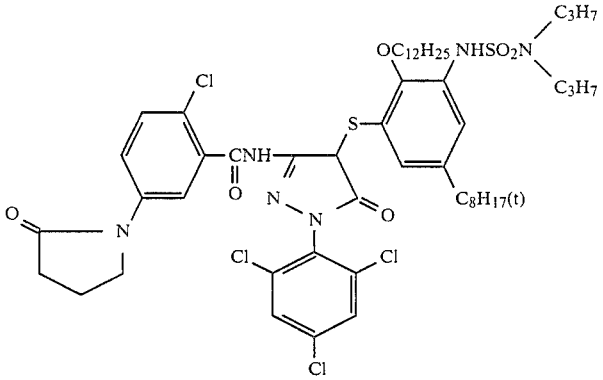
m-18
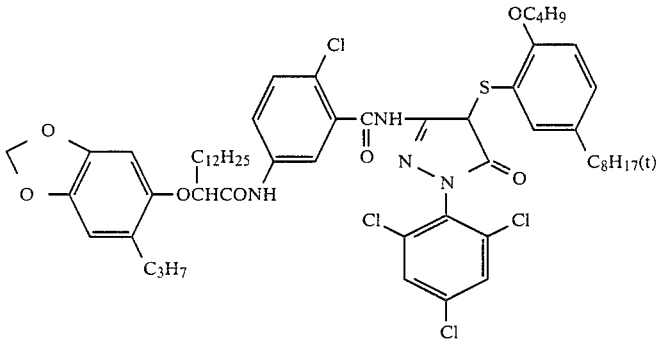
m-19
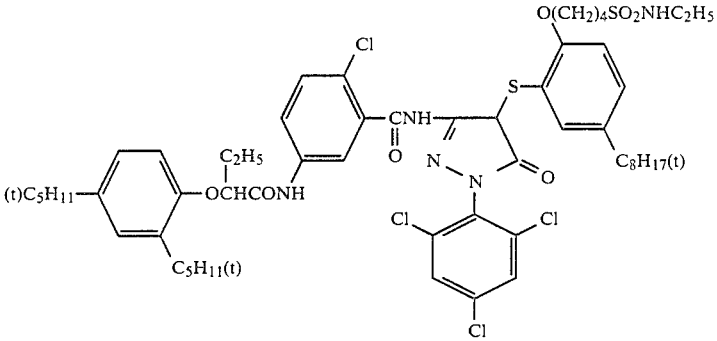
m-20

-continued
m-21
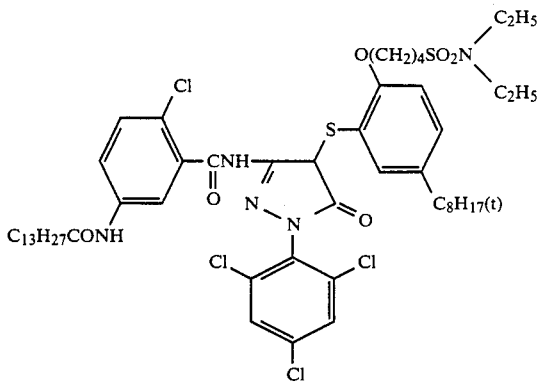
m-22
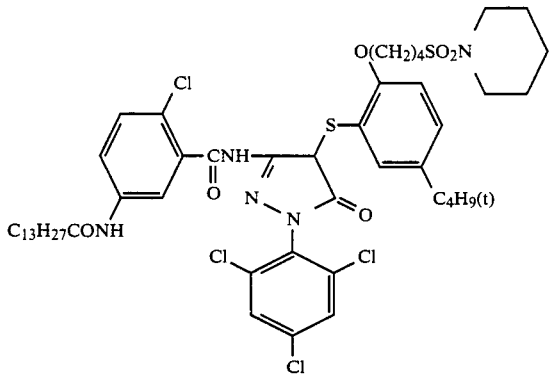
m-23
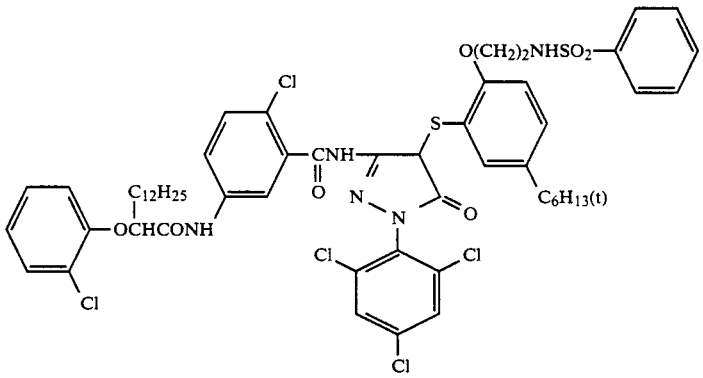
m-24
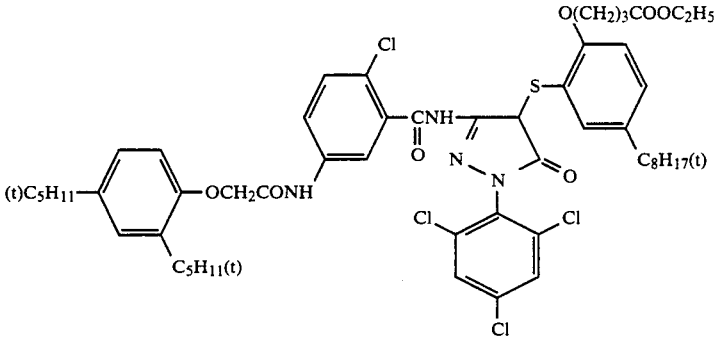

-continued
m-25
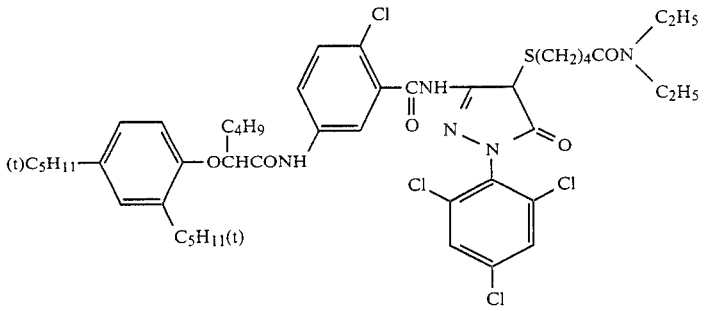
m-26
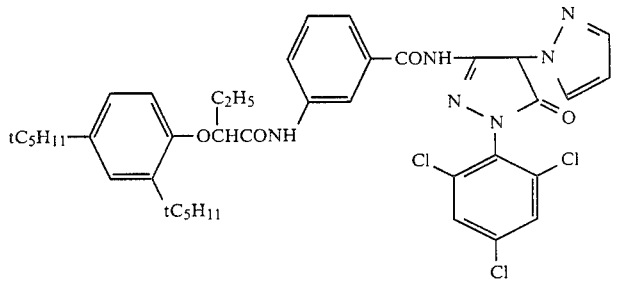
m-27
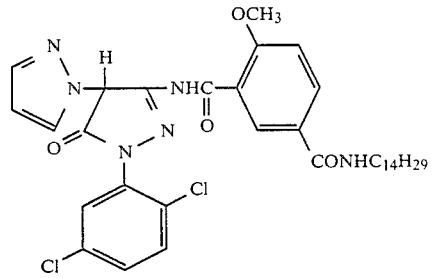
m-28
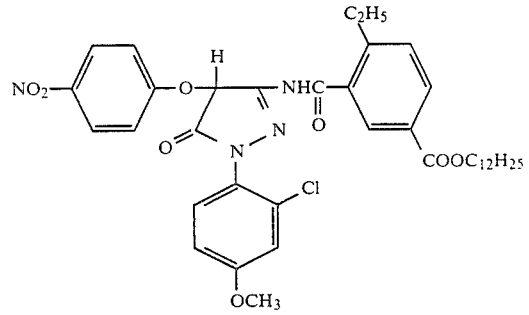
m-29
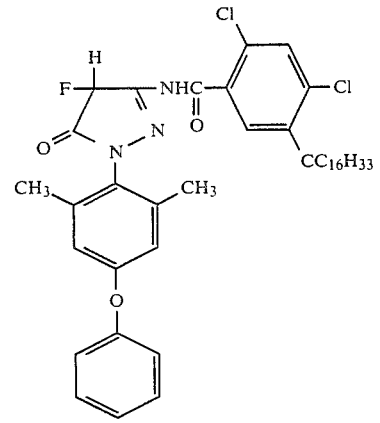

-continued m-30

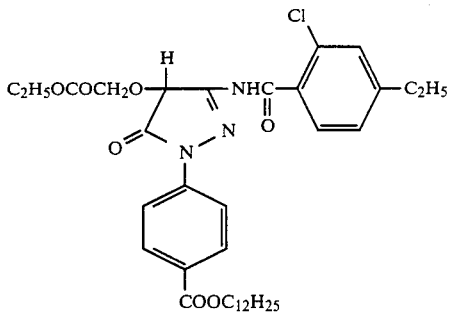

m-31

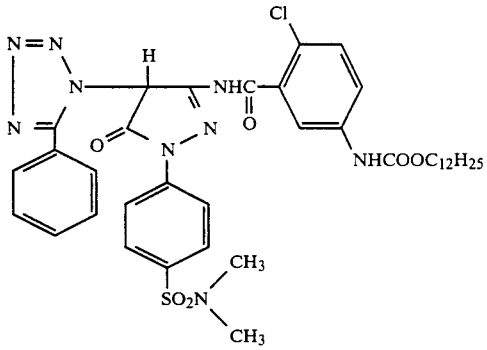

m-32

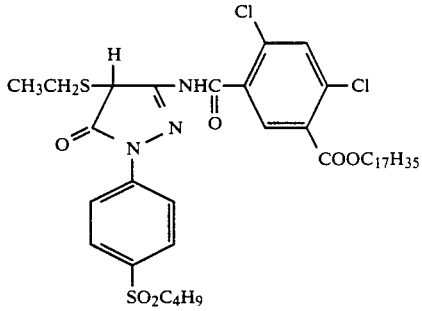

m-33

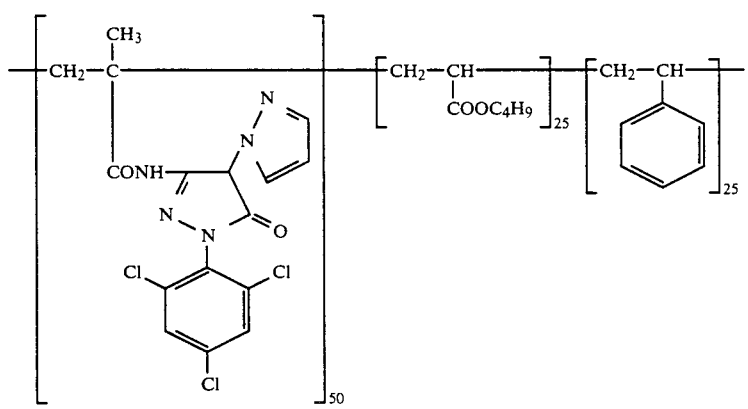

The couplers represented by formula (m) as used in the present invention are farther detailed in J.P. KOKAI Nos. 60-262161 (pp. 3–7) and 60-238832 (pp. 6–7) and specific examples thereof usable in the invention are disclosed in J.P. KOKAI Nos. 60-262161 (pp. 7–11) and 60-238832 (pp. 7–9).

The magenta couplers used in the invention can be prepared by methods disclosed in, for instance, J.P. KOKOKU No. 53-34044; J.P. KOKAI No. 55-62454 and U.S. Pat. No. 3,701,783.

Cyan couplers which may be used in the present invention include naphthol or phenol type couplers of an oil protect type. Typical naphthol type couplers are disclosed in U.S. Pat. No. 2,474,293. Typical preferred 2-equivalent naphtholic couplers of oxygen atom elimination type are disclosed in U.S. Pat. Nos. 4,052,212; 4,146,396; 4,228,233; and 4,296,200. Exemplary phenol type couplers are disclosed in U.S. Pat. Nos. 2,369,929; 2,801,171; 2,772,162 and 2,895,826. Cyan couplers which are resistant to humidity and heat are preferably used in the present invention. Examples thereof are phenol type cyan couplers having an alkyl group having not less than two carbon atoms at a metha-position of a phenolic nucleus as disclosed in U.S. Pat. No. 3,772,002; 2,5-diacylamino substituted phenol type couplers as disclosed in U.S. Pat. Nos. 2,772,162; 3,758,308; 4,126,396; 4,334,011 and 4,327,173; DEOS No. 3,329,729; and Japanese Patent Application Serial (hereunder referred to as "J.P.A.") No. 58-42671; and phenolic couplers having a phenylureido group at the 2-position and an acylamino group at the 5-position as disclosed in U.S. Pat. Nos. 3,446,622; 4,333,999; 4,451,559 and 4,427,767.

A typical yellow coupler usable in the present invention is an acylacetamide coupler of an oil protect type. Examples thereof are disclosed in U.S. Pat. Nos. 2,407,210; 2,875,057; and 3,265,506. 2-Equivalent yellow couplers are preferably used in the present invention. Typical examples thereof include the yellow couplers of an oxygen atom elimination type disclosed in U.S. Pat. Nos. 3,408,194; 3,447,928; 3,933,501 and 4,022,620, or the yellow couplers of a nitrogen atom elimination type disclosed in J.P. KOKOKU No. 55-10739; U.S. Pat. Nos. 4,401,752; and 4,326,024, Research Disclosure No. 18053 (April, 1979), U.K. Patent No. 1,425,020, DEOS Nos. 2,219,917; 2,261,361; 2,329,587 and 2,433,812. α-Pivaloyl acetanilide type couplers are excellent in fastness, particularly light fastness, of the formed dye. α-Benzoyl acetanilide type couplers yield high color density.

Graininess may be improved by using together a coupler which can form a dye being moderately diffusible. As such dye-diffusing couplers, some magenta couplers are specifically described in U.S. Pat. No. 4,366,237 and U.K. Patent No. 2,125,570 and some yellow, magenta and cyan couplers are specfically described in European Patent No. 96,570 and DEOS No. 3,234,533.

Dye-forming couplers and the aforesaid special couplers may be a dimer or a higher polymer. Typical examples of polymerized dye-forming couplers are described in U.S. Pat. Nos. 3,415,820 and 4,080,211. Examples of polymerized magenta couplers are described in U.K. Patent No. 2,102,173 and U.S. Pat. No. 4,367,282.

In order to meet properties required for light-sensitive materials, two or more couplers may be used together in a single light-sensitive layer, or the same coupler may be introduced in two or more different light-sensitive layers.

The standard amount of the colored couplers to be used is 0.001 to 1 mole and preferred amount thereof is 0.01 to 0.5 mole for yellow couplers, 0.003 to 0.3 mole for magenta couplers and 0.002 to 0.3 mole for cyan couplers per mole of light-sensitive silver halide.

The couplers used in the invention can be introduced, into the color light-sensitive materials, by a variety of known methods for dispersion. Examples of high boiling point organic solvents used in the oil-in-water dispersion method are disclosed in U.S. Pat. No. 2,322,027. Specific examples of processes, effects and latexes for impregnation, for latex dispersion method are, for instance, disclosed in U.S. Pat. No. 4,199,363 and DE OLS Nos. 2,541,274 and 2,541,230.

Substrate

The photographic light-sensitive materials to be processed by the present invention are applied to the surface of a flexible substrate such as a plastic film (e.g., cellulose nitrate, cellulose acetate or polyethylene terephthalate) or paper; or a rigid substrate such as a glass plate. Substrates and methods for applying the photographic light-sensitive materials thereto are detailed in Research Disclosure, Vol. 176, No. 17643, Item XV (p. 27) and XVII (p. 28) (December, 1978).

Typical examples of the photographic light-sensitive materials to be processed by the method of the present invention include color negative films for general use or motion picture, color reversal films for slide or television, color paper, color positive films, color reversal paper and color direct positive light-sensitive materials.

Development Processing

The processing method of this invention is particularly characterized in that the amount of a processing solution having fixing ability to be supplemented is preferably restricted to not more than 3,000 ml, more preferably 30 to 2,000 ml and in particular 45 to 1,000 ml. The term "a bath having fixing ability" herein means a fixing solution and bleach-fixing solution and thus the amount of these solutions replenished is limited to the range defined above.

The method of this invention comprises a variety of combination of the processing processes and specific examples thereof are as follows:

(i) Development-Bleach-fixing-Water Washing-Drying
(ii) Development-Bleach-fixing-Stabilization-Drying
(iii) Development-Bleach-fixing-Water Washing-Stabilization-Drying
(iv) Development-Bleaching-Bleach-fixing-Water Washing-Drying
(v) Development-Bleaching-Bleach-fixing-Water Washing-Stabilization-Drying
(vi) Development-Bleaching-Bleach-fixing-Stabilization-Drying In this respect, it is also possible in the foregoing processes, to carry out water washing process between the development and bleaching or bleach-fixing processes; or between the bleaching and fixing processes. Each processing may be performed according to any manners such as a single bath processing, a multistage countercurrent system or multistage direct flow system.

The processing time of the bleaching process of the present invention is preferably not more than 10 minutes and in particular if it ranges from 1 to 5 minutes, the marked enhancement of bleaching properties (desilvering properties) and stain increment-inhibiting effect can be achieved and thus the objects of this invention can effectively be attained.

Development

The color developer used to develop light-sensitive materials is preferably an aqueous alkaline solution containing, as a principal component, an aromatic primary amine type color developing agent. Although aminophenol type developing agents are also useful as the color developing agent, but preferred are p-phenylenediamine type compounds whose typical examples are 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, and 3-methyl-4-amino-N-ethyl-N-β-methoxyethylaniline and sulfates, hydrochlorides or p-toluenesulfonates thereof. These diamines in the form of salts are in general more stable than those in the free state and, therefore, they are preferably used in the form of salts.

The color developer in general contains, in addition to the foregoing components, pH buffering agents such as carbonates, borates or phosphates of alkali metals; development inhibitors such as bromides, iodides, benzimidazoles, benzothiazoles or mercapto compounds; or antifoggants. The color developer may optionally comprise various kinds of preservatives such as hydroxylamine, diethylhydroxylamine, sulfites and compounds disclosed in J.P.A. No. 61-280792; organic solvents such as triethanolamine and diethylene glycol; development accelerators such as benzyl alcohol, polyethylene glycol, quaternary ammonium salts and amines; fogging agents such as dye-forming couplers, competing couplers and sodium borohydride; auxiliary developing agents such as 1-phenyl-3-pyrazolidone; thickening agents; a variety of chelating agents such as aminopolycarboxylic acid, aminopolyphosphonic acid, alkylphosphonic acid and phosphonocarboxylic acid; and antioxidizing agents as disclosed in DE OLS No. 2,622,950.

In addition, if the reversal processing is performed, the photographic light-sensitive materials are in general subjected to monochromatic development prior to the color development. In such a monochromatic developer, there may be used any known monochromatic developing agents, for instance, dihydroxybenzenes such as hydroquinone; 3-pyrazolidones such as 1-phenyl-3-pyrazolidone; and aminophenols such as N-methyl-p-aminophenol, which may be used alone or in combination.

The amount of the color developer and the monochromatic developer to be replenished generally varies depending on the kinds of the light-sensitive materials to be processed and it is in general not more than 3 liters per 1 $m^2$ of the light-sensitive material to be processed. However, it can be reduced to not more than 500 ml by reducing the amount of bromide ions present in the replenisher. Upon reducing the amount of the replenisher, the area of the opening of the processing bath should be limited to a small value to prevent the evaporation of the solution and the oxidation thereof with air. Alternatively, the amount of the replenisher may further be reduced by utilizing a means for suppressing the accommodation of bromide ions in the developer.

Bleaching, Fixing

Subsequently, the color developed photographic emulsion layer is generally processed with a bleach-fixing solution. Moreover, after bleaching, a bleach-fixing treatment may be carried out to speed up the processing. Further, it is also possible to perform fixing treatment prior to bleach-fixing treatment or to perform bleaching treatment after bleach-fixing treatment, depending on purposes. As the bleaching agents, there may be used, for instance, compounds of polyvalent metals such as iron(III), cobalt(III), chromium(IV) and copper(II); peracids; and quinones. Typical examples thereof include ferricyanides; bichromates; organic complexes of iron(III) or cobalt(III); aminopolycarboxylic acids such as ethylenediaminetetraacetic acid, diethylenetriaminepentaacetic acid, cyclohexanediaminetetraacetic acid, methyliminodiacetic acid, 1,3-diaminopropanetetraacetic acid and glycol ether diaminetetraacetic acid; complexes of organic acids such as citric acid, tartaric acid or malic acid; persulfates; hydrobromides; manganates; and nitrosophenol. Among these, ferric aminopolycarboxylates such as ferric ethylenediaminetetraacetate and persulfates are preferably used on account of rapid processing and prevention of environmental pollution.

Examples of fixing agents are thiosulfates, thiocyanates, thioether type compounds, thioureas and a large amount of iodides, but in general thiosulfates are used and particularly ammonium thiosulfate is most widely used. Preferred preservatives for the bleach-fixing solution and the fixing solution are sulfites, bisulfites and carbonylbisulfite adducts.

Water Washing and Stabilization

It is common that the silver halide color photographic light-sensitive materials to be processed by the present invention are subjected to water washing and/or stabilization processes after the desilvering process.

The amount of washing water in water washing process can widely be established depending on a variety of conditions such as characteristics of the light-sensitive materials to be processed (for instance, materials used such as couplers), applications, the temperature of the washing water, the number of washing tanks (step number), and the manners of the replenishment, for instance, direct flow system and countercurrent flow system. Among these, the relation between the amount of water and the number of water washing tanks in the multistage countercurrent flow system can be obtained by the method disclosed in Journal of the Society of Motion Picture and Television Engineers, 1955, May, Vol. 64, p. 248–253.

Although, the multistage countercurrent flow system disclosed in the foregoing article makes it possible to extremely reduce the amount of washing water, the retention time of water in the tanks increases and as a result bacteria proliferates therein which leads to the formation of floating substances and the adhesion of the substances to the processed light-sensitive materials.

In order to solve such problems, a method for reducing the amount of calcium and magnesium, in the processing of the color light-sensitive materials, disclosed in J.P.A. No. 61-131632 can be effectively adopted in the invention. Alternatively, the problems can also be solved by utilizing isothiazolone compounds and thiabendazoles disclosed in J.P. KOKAI No. 57-8542; such chlorine type antibacterial agents as sodium chlorinated isocyanurates; benzotriazoles; or other antibacterial agents disclosed in "BOKIN BOBAIZAI NO KAGAKU (Chemistry of Antibacterial and Antifungus Agents)", Hiroshi HORIGUCHI; "BISEIBUTSU NO MEKKIN, SAKKIN AND BOBAI GIJUTSU (Sterilization, Pasteurization and Mold Controlling Techniques)", edited by Sanitary Engineering Society; and "Dictionary of Antibacterial and Antifungus Agents", edited by Japan Bacteria and Fungi Controlling Society.

In the present invention, the pH value of the washing water is 4 to 9 and preferably 5 to 8. The temperature and time of the water washing process may vary depending on, for instance, the properties and applications of the color light-sensitive materials to be processed, but in general the water washing is performed at a temperature of 15° to 45° C. for 20 seconds to 10 minutes and preferably 25° to 40° C. for 30 seconds to 5 minutes.

In the invention, the color light-sensitive materials are directly processed with a stabilization solution instead of the water washing process. In such a stabilization process, any known methods disclosed in J.P. KOKAI Nos. 57-8543, 58-14834 and 60-220345 can be employed.

Additionally, the stabilization process may be carried out subsequent to the water washing process and examples thereof are stabilization baths containing formalin and a surfactant, which is used as the final bath for processing color light-sensitive materials for taking photographs. The stabilization solution may contain a variety of chelating agents and/or antifungus agents.

The overflows associated with the supplementation of a replenisher to the water washing and/or stabilization processes may be introduced into other baths such as those for the desilvering process to reuse them.

The silver halide color light-sensitive materials processed by the invention may contain a color developing agent for simplification of processes and rapid processing. For that purpose, it is preferable to use a variety of precursors of the color developing agents. Examples thereof include indoaniline compounds as disclosed in U.S. Pat. No. 3,342,597; Schiff base type compounds as disclosed in U.S. Pat. No. 3,342,599 and Research Disclosure Nos. 14850 and 15159; aldol compounds as disclosed in Research Disclosure No. 13924; metal complex salts as disclosed in U.S. Pat. No. 3,719,492; and urethane type compounds as disclosed in J.P. KOKAI No. 53-135628.

For the purpose of promoting the color development, the silver halide color light-sensitive materials processed by the invention may optionally comprise various 1-phenyl-3-pyrazolidones. Typical examples of such compounds are disclosed in, for instance, J.P. KOKAI Nos. 56-64339; 57-144547 and 58-115438.

In the present invention, each processing solution is used at a temperature of 10° to 50° C. It generally ranges from 33° to 38° C., but higher temperature may be used to promote the processing and to thus reduce the processing time, or a lower temperature may also be used to improve the quality of images or the stability of the processing solution. Moreover, to save the amount of silver in the color light-sensitive materials, processings utilizing a cobalt intensifier or hydrogen peroxide intensifier disclosed in German Patent No. 2,226,770 and U.S. Pat. No. 3,674,499 can be employed.

Each processing bath may be provided with a heater, a temperature sensor, a level sensor, a circulation pump, a filter, a floating cover, a squeezy and the like according to need.

Moreover, if a continuous processing is performed, the composition of each processing solution should be maintained by adding a replenisher for each processing solution to achieve uniform finishing of the processed materials. The amount of the replenisher can be reduced to half or less of the standard replenished amount for cutting the cost and so on.

EXAMPLE

The present invention will hereunder be explained in more detail with reference to the following Examples, but the present invention is not restricted to these specific Examples.

EXAMPLE 1

A multi-layered color light-sensitive material (Sample 101) was prepared by applying in order coating solutions having the following compositions on the surface of a substrate of cellulose triacetate ot which an underlying layer had been applied.

Composition of the Light-sensitive Layer

In the following composition, the coated amounts are expressed in g/m$^2$ of elemental silver for silver halide and colloidal silver; in g/m$^2$ for couplers, additives and gelatin; and in moles per mole of silver halide included in the same layer for sensitizing dyes.

| | |
|---|---|
| **1st Layer: Halation Inhibiting Layer** | |
| Black colloidal silver | 0.2 |
| Gelatin | 1.3 |
| Coupler C-1 | 0.06 |
| Ultraviolet absorber UV-1 | 0.1 |
| Ultraviolet absorber UV-2 | 0.2 |
| Dispersion oil Oil-1 | 0.01 |
| Dispersion oil Oil-2 | 0.01 |
| **2nd Layer: Intermediate Layer** | |
| Fine grain silver bromide (average grain size = 0.07$\mu$) | 0.15 |
| Gelatin | 1.0 |
| Coupler C-2 | 0.02 |
| Dispersion oil Oil-1 | 0.1 |
| **3rd Layer: First Red-sensitive Emulsion Layer** | |
| Silver iodobromide emulsion (AgI = 2 mole %; diameter/thickness ratio = 2.5; average grain size = 0.3$\mu$; AgI content is high at the inner portion) | 0.4 (Ag) |
| Gelatin | 0.6 |
| Sensitizing dye I | $1.0 \times 10^{-4}$ |
| Sensitizing dye II | $3.0 \times 10^{-4}$ |
| Sensitizing dye III | $1 \times 10^{-5}$ |
| Coupler C-3 | 0.06 |
| Coupler C-4 | 0.06 |
| Coupler C-8 | 0.04 |
| Coupler C-2 | 0.03 |
| Dispersion oil Oil-1 | 0.03 |
| Dispersion oil Oil-3 | 0.012 |
| **4th Layer: Second Red-sensitive Emulsion Layer** | |
| Silver iodobromide emulsion (AgI = 5 mole %; diameter/thickness ratio = 4.0; average grain size = 0.7$\mu$; AgI content is high at the inner portion) | 0.7 (Ag) |
| Gelatin | 1.0 |
| Sensitizing dye I | $1 \times 10^{-4}$ |
| Sensitizing dye II | $3 \times 10^{-4}$ |
| Sensitizing dye III | $1 \times 10^{-5}$ |
| Coupler C-3 | 0.24 |
| Coupler C-4 | 0.24 |
| Coupler C-8 | 0.04 |
| Coupler C-2 | 0.04 |
| Dispersion oil Oil-1 | 0.15 |
| Dispersion oil Oil-3 | 0.02 |
| **5th Layer: Third Red-sensitive Emulsion Layer** | |
| Silver iodobromide emulsion (AgI = 10 mole %; diameter/thickness ratio = 1.3; average grain size = 0.8$\mu$; AgI content is high at the inner portion) | 1.0 (Ag) |
| Gelatin | 1.0 |
| Sensitizing dye I | $1 \times 10^{-4}$ |
| Sensitizing dye II | $3 \times 10^{-4}$ |
| Sensitizing dye III | $1 \times 10^{-5}$ |
| Coupler C-6 | 0.05 |
| Coupler C-7 | 0.1 |
| Dispersion oil Oil-1 | 0.01 |
| Dispersion oil Oil-2 | 0.05 |
| **6th Layer: Intermediate Layer** | |
| Gelatin | 1.0 |
| Compound Cpd-A | 0.03 |
| Dispersion oil Oil-1 | 0.05 |
| **7th Layer: First Green-sensitive Emulsion Layer** | |
| Silver iodobromide emulsion (AgI = 2 mole %; diameter/thickness ratio = 2.5; average grain size = 0.3$\mu$; AgI content is high at the inner portion) | 0.3 (Ag) |
| Gelatin | 1.0 |
| Sensitizing dye IV | $5 \times 10^{-4}$ |
| Sensitizing dye VI | $0.3 \times 10^{-4}$ |

-continued

| | |
|---|---|
| Sensitizing dye V | $2 \times 10^{-4}$ |
| Coupler C-9 | 0.2 |
| Coupler C-5 | 0.03 |
| Coupler C-1 | 0.03 |
| Compound Cpd-C | 0.012 |
| Dispersion oil Oil-1 | 0.5 |

8th Layer: Second Green-sensitive Emulsion Layer

| | |
|---|---|
| Silver iodobromide emulsion (AgI = 4 mole %; diameter/thickness ratio = 4.0; average grain size = 0.6μ; AgI content is high at the inner portion) | 0.4 (Ag) |
| Gelatin | 1.0 |
| Sensitizing dye IV | $5 \times 10^{-4}$ |
| Sensitizing dye V | $2 \times 10^{-4}$ |
| Sensitizing dye VI | $0.3 \times 10^{-4}$ |
| Coupler C-9 | 0.25 |
| Coupler C-1 | 0.03 |
| Coupler C-10 | 0.015 |
| Coupler C-5 | 0.01 |
| Compound Cpd-C | 0.012 |
| Dispersion oil Oil-1 | 0.2 |

9th layer: Third Green-sensitive Emulsion Layer

| | |
|---|---|
| Silver iodobromide emulsion (AgI = 6 mole %; diameter/thickness ratio = 1.2; average grain size = 1.0μ; AgI content is high at the inner portion) | 0.4 (Ag) |
| Gelatin | 1.0 |
| Sensitizing dye VII | $3.5 \times 10^{-4}$ |
| Sensitizing dye VIII | $1.4 \times 10^{-4}$ |
| Coupler C-13 | 0.01 |
| Coupler C-12 | 0.03 |
| Coupler C-9 | 0.20 |
| Coupler C-1 | 0.02 |
| Coupler C-15 | 0.02 |
| Dispersion oil Oil-1 | 0.20 |
| Dispersion oil Oil-2 | 0.05 |

10th Layer: Yellow Filter Layer

| | |
|---|---|
| Gelatin | 1.2 |
| Yellow colloidal silver | 0.08 |
| Compound Cpd-B | 0.1 |
| Dispersion oil Oil-1 | 0.3 |

-continued

11th Layer: First Blue-sensitive Emulsion Layer

| | |
|---|---|
| Monodisperse Silver iodobromide emulsion (AgI = 4 mole %; diameter/thickness ratio = 1.5; average grain size = 0.5μ; AgI content is high at the inner portion) | 0.4 (Ag) |
| Gelatin | 1.0 |
| Sensitizing dye IX | $2 \times 10^{-4}$ |
| Coupler C-14 | 0.9 |
| Coupler C-5 | 0.07 |
| Dispersion oil Oil-1 | 0.2 |

12th Layer: Second Blue-sensitive Emulsion Layer

| | |
|---|---|
| Silver iodobromide emulsion (AgI = 10 mole %; diameter/thickness ratio = 4.5; average grain size = 1.3μ; AgI content is high at the inner portion) | 0.4 (Ag) |
| Gelatin | 0.6 |
| Sensitizing dye IX | $1 \times 10^{-4}$ |
| Coupler C-14 | 0.25 |
| Dispersion oil Oil-1 | 0.07 |

13th Layer: First Protective Layer

| | |
|---|---|
| Gelatin | 0.8 |
| Ultraviolet absorber UV-1 | 0.1 |
| Ultraviolet absorber UV-2 | 0.2 |
| Dispersion oil Oil-1 | 0.01 |
| Dispersion oil Oil-2 | 0.01 |

14th Layer: Second Protective Layer

| | |
|---|---|
| Fine grain silver bromide (average grain size = 0.07μ) | 0.5 |
| Gelatin | 0.45 |
| Polymethyl methacrylate particles (diameter = 15μ) | 0.2 |
| Film hardening agent H-1 | 0.4 |
| n-Butyl p-hydroxybenzoate | 0.012 |
| Formaldehyde scavenger S-1 | 0.5 |
| Formaldehyde scavenger S-2 | 0.5 |

To each layer there was added a surfactant as a coating aid in addition to the foregoing components.

The chemical structures or the chemical names of the compounds used in this Example are as follows:

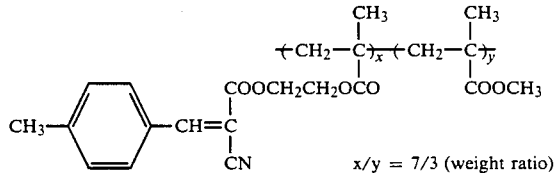

UV-1

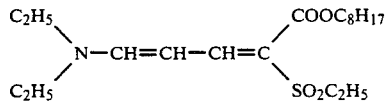

UV-2

Tricresyl Phosphate — Oil-1

Dibutyl Phthalate — Oil-2

Bis(2-ethylhexyl)Phthalate — Oil-3

-continued
C-1
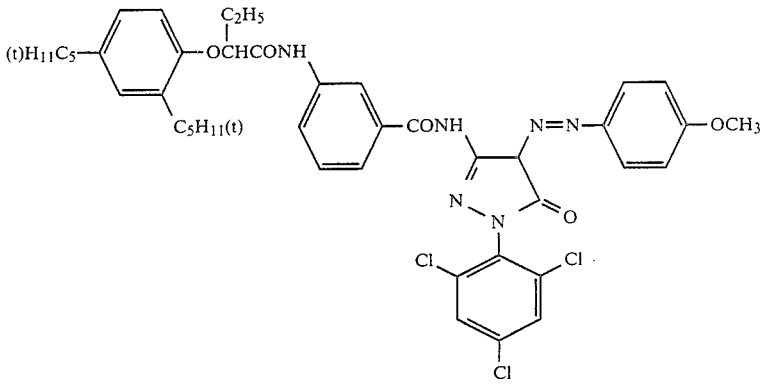
C-2
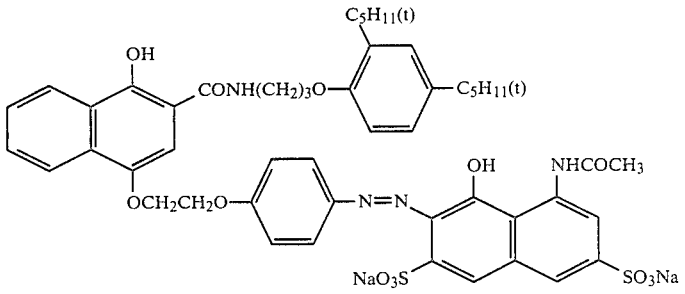
C-3
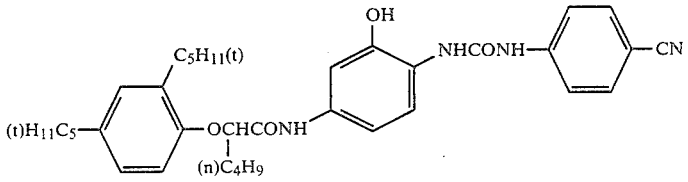
C-4
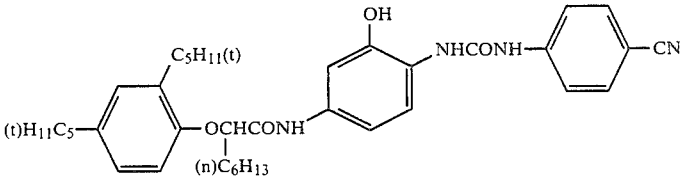
C-5
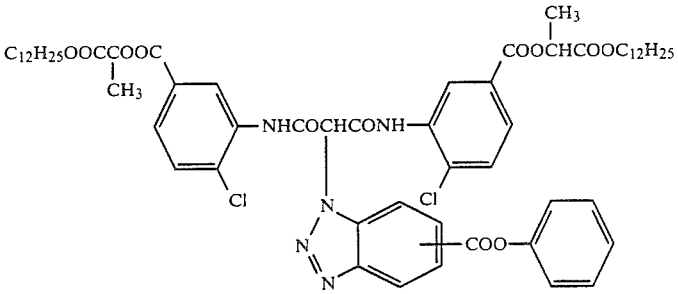

-continued
C-6
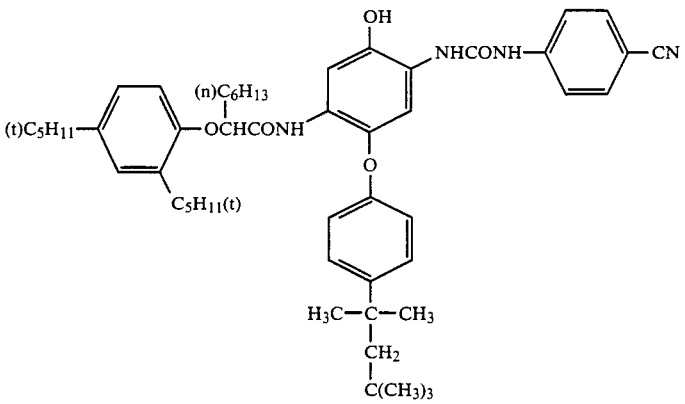
C-7
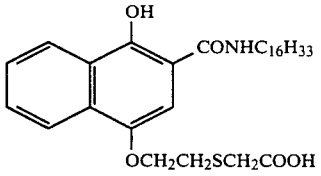
C-8
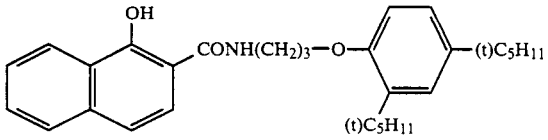
C-9
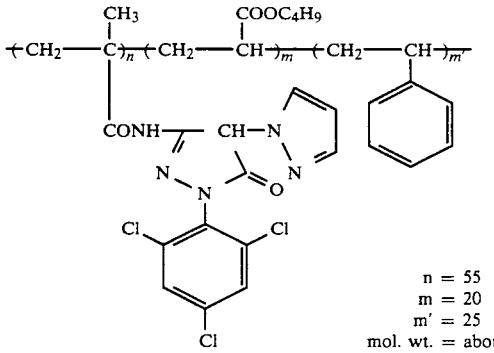
n = 55
m = 20
m' = 25
mol. wt. = about 20,000
C-10
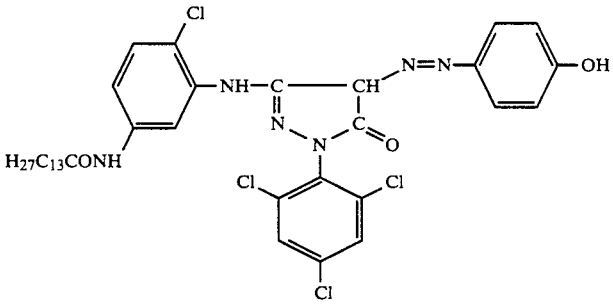
C-11
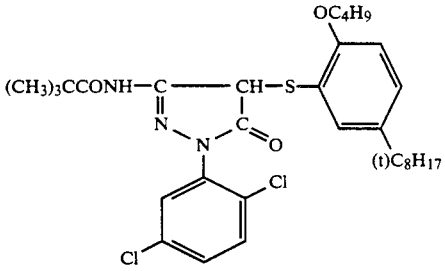

-continued
C-12
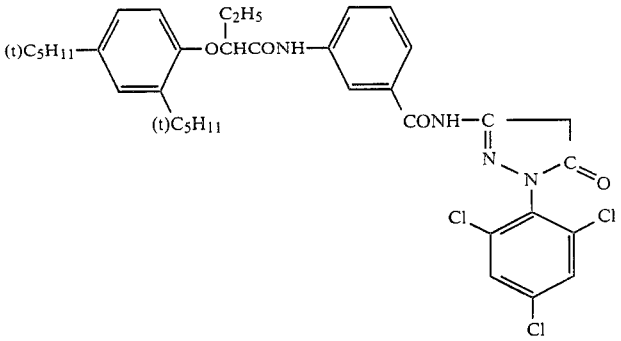
C-13
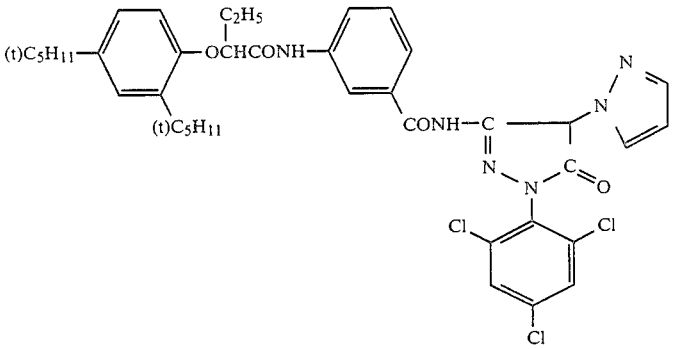
C-14
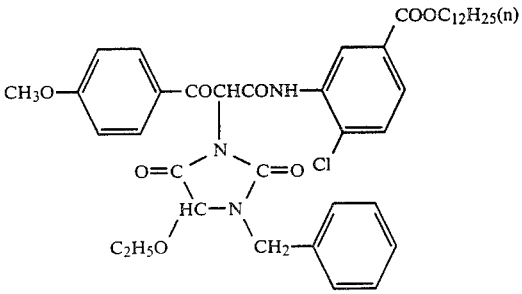
C-15
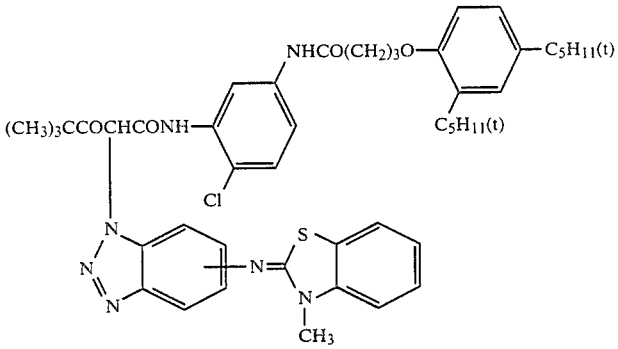
Cpd A
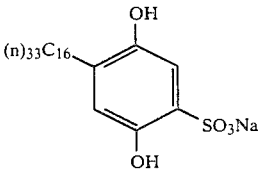
Cpd B
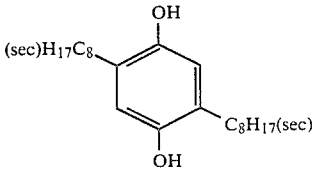

-continued
Cpd-C
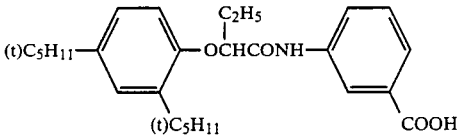
Sensitizing Dye I
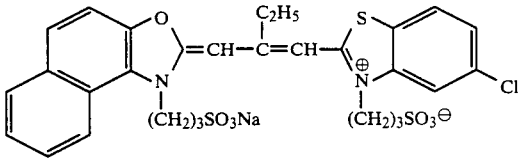
Sensitizing Dye II
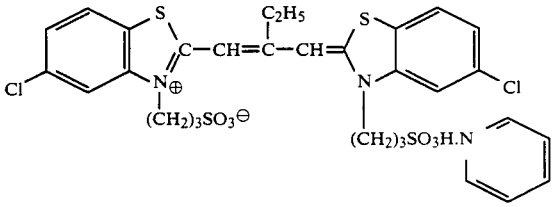
Sensitizing Dye III
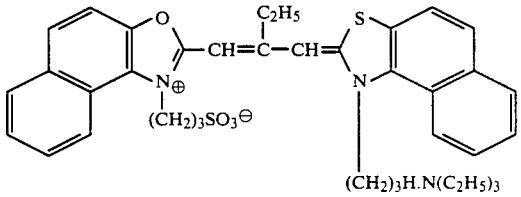
Sensitizing Dye IV
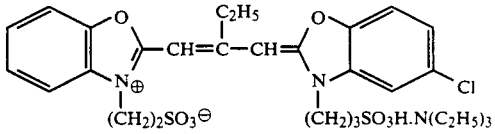
Sensitizing Dye V
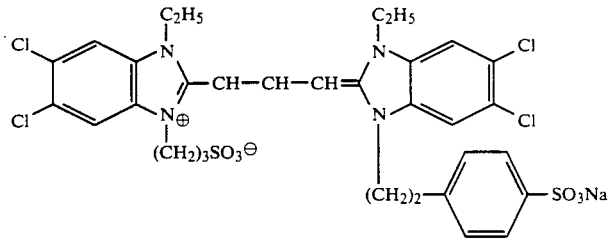
Sensitizing Dye VI
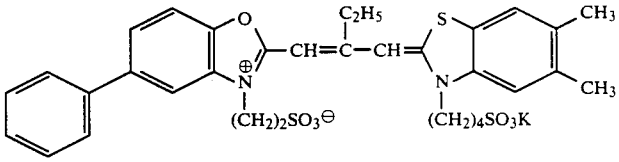
Sensitizing Dye VII
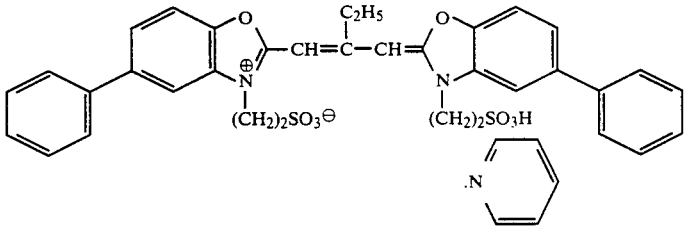

-continued

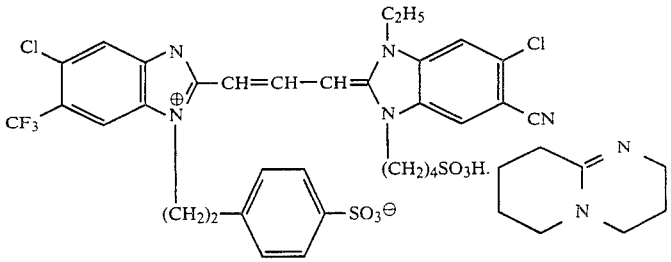

Sensitizing Dye VIII

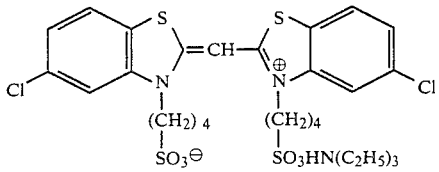

Sensitizing Dye IX

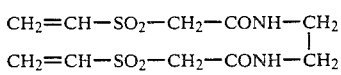

H-1

S-1 S-2

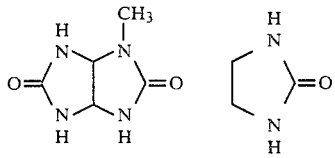

A multilayered color light-sensitive material (Sample 102) was prepared by applying in order coating solutions having the following compositions onto the surface of a substrate of cellulose triacetate to which an underlying layer had been applied.

Composition of the Light-sensitive Layer

In the following composition, the coated amounts are expressed in g/m$^2$, that of silver halide is expressed in reduced amount of elemental silver. The coated amount of sensitizing dyes is expressed in moles per mole of silver halide included in the same layer.

| (Sample 102) | |
|---|---|
| **1st Layer: Halation Inhibiting Layer** | |
| Black colloidal silver | 0.18 (Ag) |
| Gelatin | 0.40 |
| **2nd Layer: Intermediate Layer** | |
| 2,5-Di-t-pentadecyl hydroquinone | 0.18 |
| EX-1 | 0.07 |
| EX-3 | 0.02 |
| EX-12 | 0.002 |
| U-1 | 0.06 |
| U-2 | 0.08 |
| U-3 | 0.10 |
| HBS-1 | 0.10 |
| HBS-2 | 0.02 |
| Gelatin | 1.04 |
| **3rd Layer: First Red-sensitive Emulsion Layer** | |
| Monodisperse silver iodobromide emulsion (AgI = 6 mole %; average grain size = 0.6μ; Coefficient of Variation in grain size (C.V.) = 0.15) | 0.55 (Ag) |
| Sensitizing dye I | $6.9 \times 10^{-5}$ |
| Sensitizing dye II | $1.8 \times 10^{-5}$ |
| Sensitizing dye III | $3.1 \times 10^{-4}$ |
| Sensitizing dye IV | $4.0 \times 10^{-5}$ |
| EX-2 | 0.350 |
| HBS-1 | 0.005 |

-continued

| (Sample 102) | |
|---|---|
| EX-10 | 0.020 |
| Gelatin | 1.20 |
| **4th Layer: Second Red-sensitive Emulsion Layer** | |
| Tabular silver iodobromide emulsion (AgI = 10 mole %; average grain size = 0.7μ; average aspect ratio = 5.5; average thickness = 0.2μ) | 1.0 (Ag) |
| Sensitizing dye I | $5.1 \times 10^{-5}$ |
| Sensitizing dye II | $1.4 \times 10^{-5}$ |
| Sensitizing dye III | $2.3 \times 10^{-4}$ |
| Sensitizing dye IV | $3.0 \times 10^{-4}$ |
| EX-2 | 0.400 |
| EX-3 | 0.050 |
| EX-10 | 0.015 |
| Gelatin | 1.30 |
| **5th Layer: Third Red-sensitive Emulsion Layer** | |
| Silver iodobromide emulsion (AgI = 16 mole %; average grain size = 1.1μ) | 1.60 (Ag) |
| Sensitizing dye IX | $5.4 \times 10^{-5}$ |
| Sensitizing dye II | $1.4 \times 10^{-5}$ |
| Sensitizing dye III | $2.4 \times 10^{-4}$ |
| Sensitizing dye IV | $3.1 \times 10^{-5}$ |
| EX-3 | 0.240 |
| EX-4 | 0.120 |
| HBS-1 | 0.22 |
| HBS-2 | 0.10 |
| Gelatin | 1.63 |
| **6th Layer: Intermediate Layer** | |
| EX-5 | 0.040 |
| HBS-1 | 0.020 |
| EX-12 | 0.004 |
| Gelatin | 0.80 |
| **7th Layer: First Green-sensitive Emulsion Layer** | |
| Tabular silver iodobromide emulsion (AgI = 6 mole %; average grain size = 0.6μ; average aspect ratio = 6.0; average thickness = 0.15μ) | 0.40 (Ag) |
| Sensitizing dye I | $3.0 \times 10^{-5}$ |
| Sensitizing dye VI | $1.0 \times 10^{-4}$ |

-continued

| (Sample 102) | |
|---|---|
| Sensitizing dye VII | $3.8 \times 10^{-4}$ |
| EX-6 | 0.260 |
| EX-1 | 0.021 |
| EX-7 | 0.030 |
| EX-8 | 0.025 |
| HBS-1 | 0.100 |
| HBS-4 | 0.010 |
| Gelatin | 0.75 |
| **8th Layer: Second Green-sensitive Emulsion Layer** | |
| Monodisperse silver iodobromide emulsion (AgI = 9 mole %; average grain size = 0.7μ; Coefficient of Variation in grain size (C.V.) = 0.18) | 0.80 (Ag) |
| Sensitizing dye V | $2.1 \times 10^{-5}$ |
| Sensitizing dye VI | $7.0 \times 10^{-5}$ |
| Sensitizing dye VII | $2.6 \times 10^{-4}$ |
| EX-6 | 0.180 |
| EX-8 | 0.010 |
| EX-1 | 0.008 |
| EX-7 | 0.012 |
| HBS-1 | 0.160 |
| HBS-4 | 0.008 |
| Gelatin | 1.10 |
| **9th Layer: Third Green-sensitive Emulsion Layer** | |
| Silver iodobromide emulsion (AgI = 12 mole %; average grain size = 1.0μ) | 1.2 (Ag) |
| Sensitizing dye V | $3.5 \times 10^{-5}$ |
| Sensitizing dye VI | $8.0 \times 10^{-5}$ |
| Sensitizing dye VII | $3.0 \times 10^{-4}$ |
| EX-6 | 0.065 |
| EX-11 | 0.030 |
| EX-1 | 0.025 |
| HBS-1 | 0.25 |
| HBS-2 | 0.10 |
| Gelatin | 1.74 |
| **10th Layer: Yellow Filter Layer** | |
| Yellow colloidal silver | 0.05 (Ag) |
| EX-5 | 0.08 |
| HBS-3 | 0.03 |
| Gelatin | 0.95 |
| **11th Layer: First Blue-sensitive Emulsion Layer** | |
| Tabular silver iodobromide emulsion (AgI = 6 mole %; average grain size = 0.6μ; average aspect ratio = 5.7; average thickness = 0.15μ) | 0.24 (Ag) |
| Sensitizing dye VIII | $3.5 \times 10^{-4}$ |
| EX-9 | 0.85 |
| EX-8 | 0.12 |
| HBS-1 | 0.28 |
| Gelatin | 1.28 |
| **12th Layer: Second Blue-sensitive Emulsion Layer** | |
| Monodisperse silver iodobromide emulsion (AgI = 10 mole %; average grain size = 0.8μ; Coefficient of Variation in grain size (C.V.) = 0.16) | 0.45 (Ag) |
| Sensitizing dye VIII | $2.1 \times 10^{-4}$ |
| EX-9 | 0.20 |
| EX-10 | 0.015 |
| HBS-1 | 0.03 |
| Gelatin | 0.46 |
| **13th Layer: Third Blue-sensitive Emulsion Layer** | |
| Silver iodobromide emulsion (AgI = 14 mole %; average grain size = 1.3μ) | 0.77 (Ag) |
| Sensitizing dye VIII | $2.2 \times 10^{-4}$ |
| EX-9 | 0.20 |
| HBS-1 | 0.07 |
| Gelatin | 0.69 |
| **14th Layer: First Protective Layer** | |
| Silver iodobromide emulsion (AgI = 1 mole %; average grain size = 0.07μ) | 0.5 (Ag) |
| U-4 | 0.11 |
| U-5 | 0.17 |
| HBS-1 | 0.90 |
| Gelatin | 1.00 |
| **15th Layer: Second Protective Layer** | |
| Polymethylacrylate particles (diameter = about 1.5μ) | 0.54 |
| S-1 | 0.15 |
| S-2 | 0.05 |
| Gelatin | 0.72 |

To each layer, there were added, in addition to the foregoing components, a gelatin hardening agent H-1 and a surfactant.

The structural formulas and chemical names of the compounds used in the foregoing compositions are as follows:

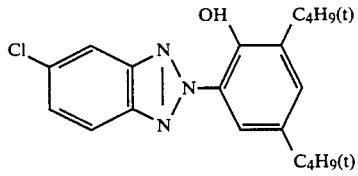

U-1

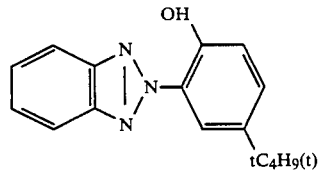

U-2

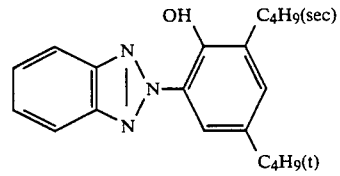

U-3

-continued
U-4
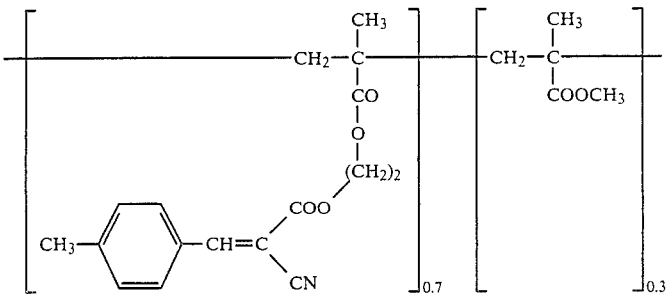
U-5
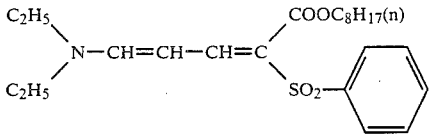
EX-1
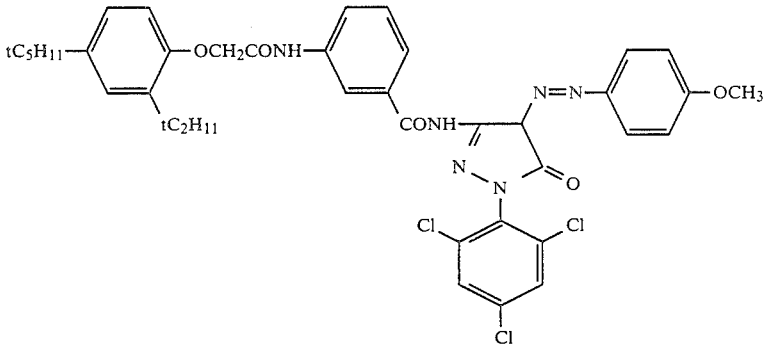
EX-2
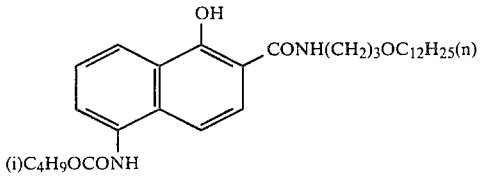
EX-3
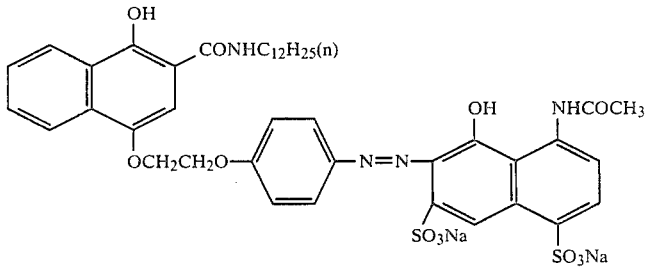
EX-4
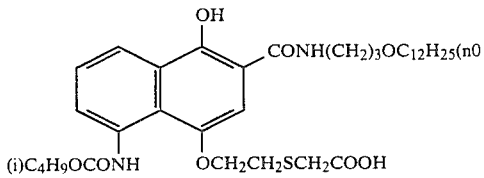
EX-5
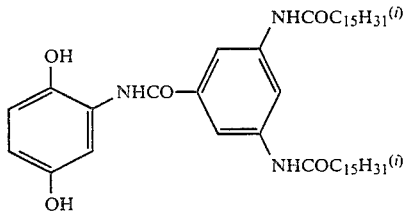

-continued
EX-6
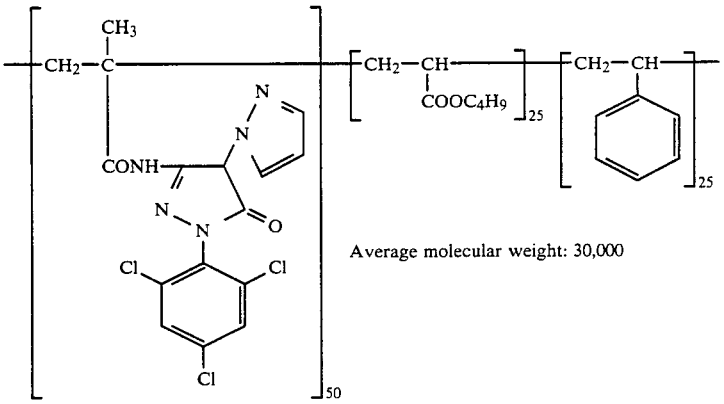
Average molecular weight: 30,000
EX-7
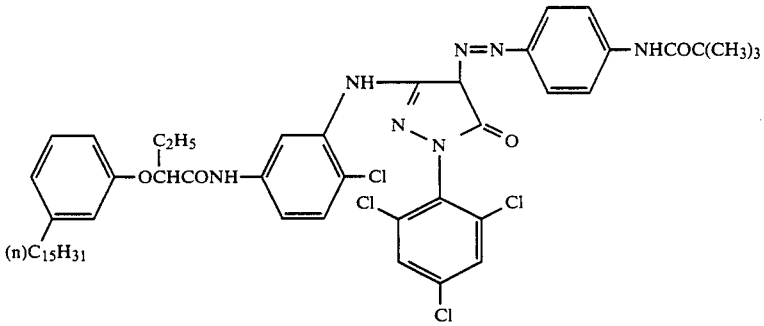
EX-8
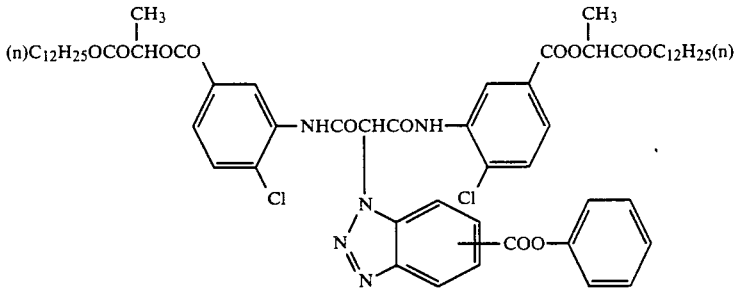
EX-9
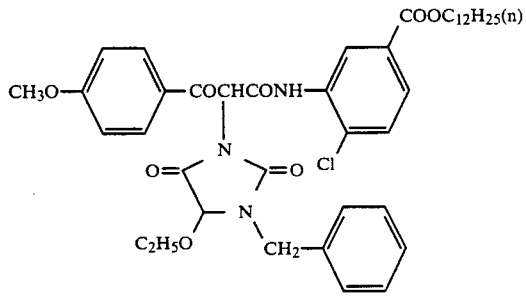

-continued
EX-10
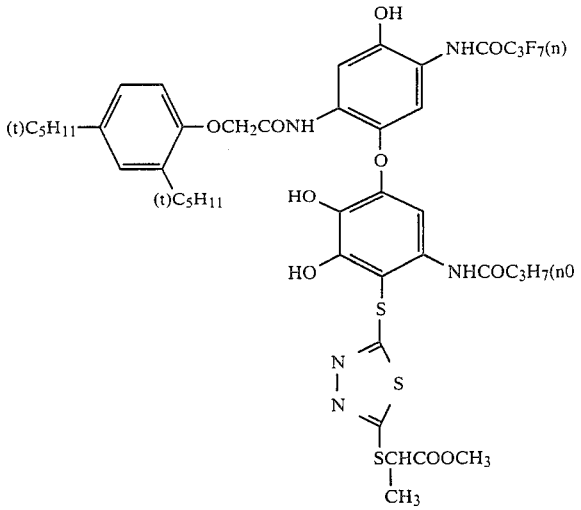
EX-11
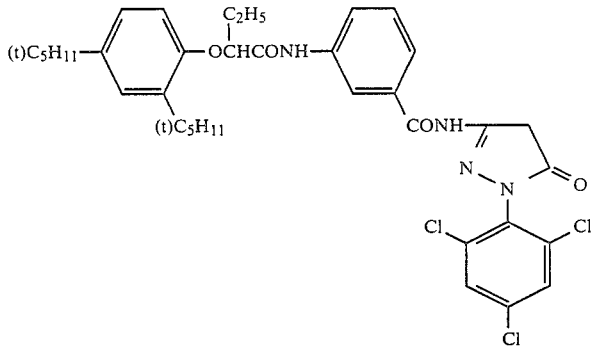
EX-12
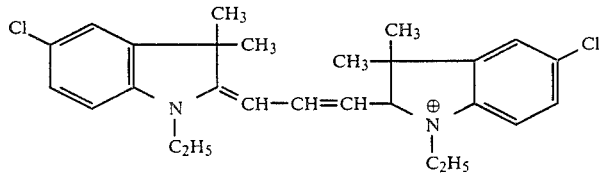
S-1
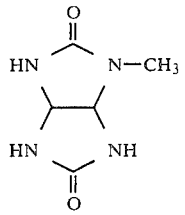
S-2
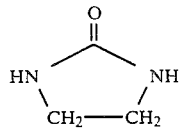
Tricresyl Phosphate HBS-1
Dibutyl Phthalate HBS-2
Bis(2-ethylhexyl)Phthalate HBS-3
HBS-4
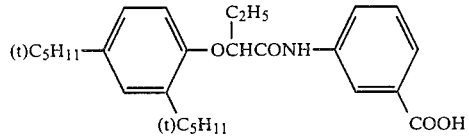

-continued
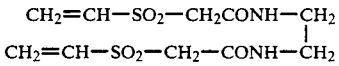
H-1
Sensitizing Dyes
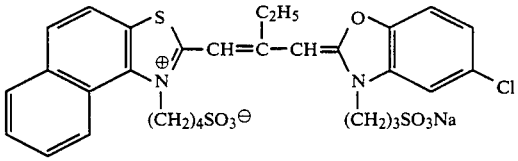
I
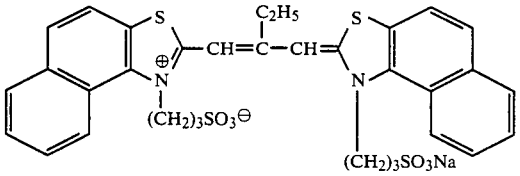
II
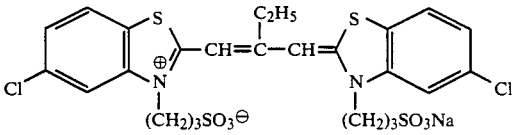
III
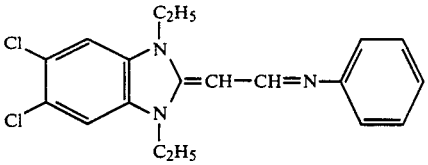
IV
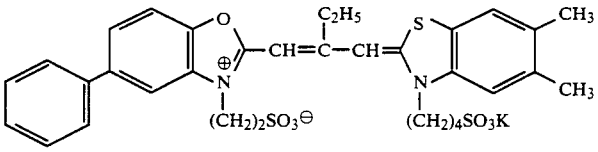
V
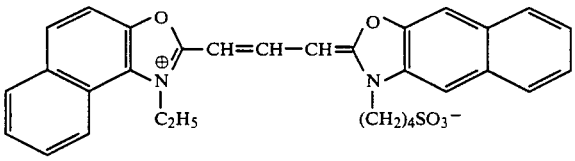
VI
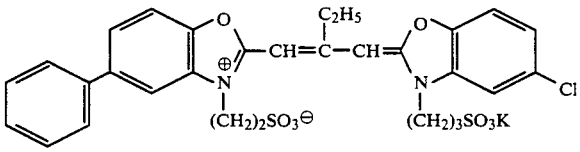
VII
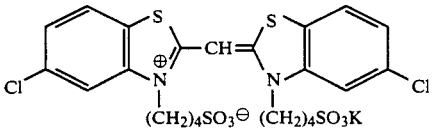
VIII -continued

IX

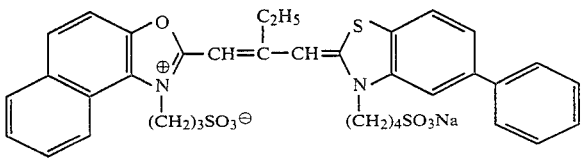

The same procedures as used for preparing Sample 101 were repeated except that silver bromide emulsions were substituted for all of the silver halide emulsions in Sample 101 to obtain Sample 103.

The color photographic light-sensitive materials (Samples 101 to 103) thus prepared each was exposed to light and then processed in accordance with the following processes utilizing an automatic developing machine till the cumulative amount of a bleach-fixing solution replenished reached three times the volume of the tank for the mother liquor thereof.

Processing Method (A)

| Process | Processing Time (sec) | Processing Temp. (°C.) | Amount of replenisher | Volume of Tank (l) |
|---|---|---|---|---|
| Color Development | 195 | 38 | 45 | 10 |
| Bleach-fixing | 195 | 38 | 17 | 8 |
| Water Washing (1) | 40 | 35 | countercurrent flow system from (2) to (1) | 4 |
| Water Washing (2) | 60 | 35 | 30 | 4 |
| Stabilization | 40 | 38 | 20 | 4 |
| Drying | 75 | 55 | — | — |

*The amount replenished is expressed in milliliters per 1 $m^2$ of the processed light-sensitive material having a width of 35 mm.

The composition of each processing solution is as follows:

| (Color Developer) | Tank Soln. (g) | Replenisher (g) |
|---|---|---|
| Diethylenetriaminepentaacetic acid | 1.0 | 1.1 |
| 1-Hydroxyethylidene-1,1-diphosphonic acid | 3.0 | 3.2 |
| Sodium sulfite | 4.0 | 4.4 |
| Potassium carbonate | 30.0 | 37.0 |
| Potassium bromide | 1.4 | 0.7 |
| Potassium iodide | 1.5 (mg) | — |
| Hydroxylamine sulfate | 2.4 | 2.8 |
| 4-(N-Ethyl-N-(β-hydroxyethyl)-amino)-2-methylaniline sulfate | 4.5 | 5.5 |
| Water | ad. 1.0 l | ad. 1.0 l |
| pH | 10.05 | 10.10 |

| (Bleach-fixing Solution): Tank Soln. and Replenisher | Amount (g) |
|---|---|
| Ferric ammonium ethylenediaminetetraacetate dihydrate | 90.0 |
| Disodium ethylenediaminetetraacetate | 5.0 |
| Sodium sulfite | 6.0 |
| 70% Aqueous solution of ammonium thiosulfate | 280 |
| p-Toluenesulfinic acid | 20.0 |
| 27% Aqueous ammonia | 6.0 (ml) |
| Illustrated Compound IA-11 | $5 \times 10^{-3}$ mole |
| Water | ad. 1.0 l |
| pH | 6.5 |

Water Washing Solution

Tank Soln. and Replenisher

This was prepared by passing tap water through a mixed bed column packed with an H-type strong acidic cation-exchange resin (available from Rohm & Haas Co. Ltd. under the trade name of Amberlite IR-120B) and an OH-type anion-exchange resin (available from the same company under the trade name of Amberlite IR-400) to reduce the concentrations of calcium and magnesium ions to a level of not more than 3 mg/l, respectively and then adding 20 mg/l of sodium dichloroisocyanurate and 1.5 g/l of sodium sulfate. The pH value of the solution was in the range of 6.5 to 7.5.

| (Stabilization Solution): Tank Soln. and Replenisher | Amount (g) |
|---|---|
| 37% Formalin | 2.0 (ml) |
| Polyoxyethylene p-monononylphenyl ether (average degree of polymerization = 10) | 0.3 |
| Disodium ethylenediaminetetraacetate | 0.05 |
| Water | ad. 1.0 l |
| pH | 5.0–8.0 |

Then, a column packed with 1 l of a strong basic anion-exchange resin (Amberlite IRA-400) was incorporated into a piping of a circulating pumping system for a bleach-fixing bath and Samples 101 to 103 were continuously processed (processing method B) as in the processing method (A).

In addition, the processing method (B) was performed without using the illustrated compound IA-11 (processing method (C)).

After each continuous processing, Samples 101 to 103 which had been exposed to light (4000° K.; 100 CMS) were processed in an automatic developing machine according to the process (A) or (B) and the amount of residual silver thereon was estimated by fluorescent X-rays technique. Moreover, unexposed Samples were processed to determine magenta density.

TABLE 1

| Processing | Sample No. | Amount of Residual Silver (μg/$cm^2$) | Magenta Density | |
|---|---|---|---|---|
| A | 103 | 8.7 | 0.38 | Comp. Ex. |
| A | 102 | 15.4 | 0.46 | " |
| A | 101 | 20.7 | 0.48 | " |
| B | 103 | 9.3 | 0.32 | " |
| B | 102 | 2.4 | 0.28 | Present Invention |
| B | 101 | 1.9 | 0.27 | Present Invention |
| C | 103 | 9.0 | 0.32 | Comp. Ex. |
| C | 102 | 7.0 | 0.30 | " |
| C | 101 | 5.3 | 0.30 | " |

The processing method of this invention provided good images having a low amount of residual silver and a low magenta density (stain) on the unexposed areas. Contrary to this, when Sample 103 free of iodide ions was treated with the ion-exchange resin, almost no such effects could not be obtained. It is assumed that this effect of decreasing the amount of the residual silver is due to the removal of iodide ions accommodated in the bleach-fixing solution through the treatment with the ion-exchange resin, but the reason why the magenta stain was reduced is not clear at present. The processing method of the present invention makes it possible to reduce the amount of the residual silver, in other words, to improve the bleaching ability of the processing and to bleach within a short time period.

Each of Samples was also processed at 38° C. for 4 min. 20 sec. using a fixing solution $N_3$ for processing color negative film CN-16 Process (available from Fuji Photo Film Co., Ltd.). No change in the amount of residual Ag was observed.

EXAMPLE 2

A multilayered color light-sensitive material (Sample 201) was prepared by applying in order coating solutions having the following compositions on the surface of a substrate of cellulose triacetate to which an underlying layer had been applied.

| | |
|---|---|
| 1st Layer: Halation Inhibiting Layer | |
| Black colloidal silver | 0.25 g/m$^2$ |
| Ultraviolet absorber U-1 | 0.1 g/m$^2$ |
| Ultraviolet absorber U-2 | 0.1 g/m$^2$ |
| High boiling point organic solvent Oil-1 | 0.1 cc/m$^2$ |
| Gelatin | 1.9 g/m$^2$ |
| 2nd Layer: First Intermediate Layer | |
| Cpd | 10 mg/m$^2$ |
| High boiling point organic solvent Oil-3 | 40 mg/m$^2$ |
| Gelatin | 0.4 g/m$^2$ |
| 3rd Layer: Second Intermediate Layer | |
| Surface fogged fine grain silver iodobromide emulsion (average grain size = 0.06μ; AgI content = 1 mole %) | 0.05 g/m$^2$ (Ag) |
| Gelatin | 0.4 g/m$^2$ |
| 4th Layer: First Red-sensitive Emulsion Layer | |
| Silver iodobromide emulsion spectrally sensitized with sensitizing dyes S-1 and S-2 (1:1 mixture of monodisperse cubic grains having average grain size of 0.2μ and AgI content of 5 mole % and monodisperse cubic grains having average grain size of 0.1μ and AgI content of 5 mole %) | 0.4 g/m$^2$ (Ag) |
| Coupler C-1 | 0.2 g/m$^2$ |
| Coupler C-2 | 0.05 g/m$^2$ |
| High boiling point organic solvent Oil-1 | 0.1 cc/m$^2$ |
| Gelatin | 0.8 g/m$^2$ |
| 5th Layer: Second Red-sensitive Emulsion Layer | |
| Silver iodobromide emulsion spectrally sensitized with sensitizing dyes S-1 and S-2 (monodisperse emulsion of cubic grains having average grain size of 0.3μ and AgI content of 4 mole %) | 0.4 g/m$^2$ (Ag) |
| Coupler C-1 | 0.2 g/m$^2$ |
| Coupler C-3 | 0.2 g/m$^2$ |
| Coupler C-2 | 0.05/g/m$^2$ |
| High boiling point organic solvent Oil-1 | 0.1 cc/m$^2$ |
| Gelatin | 0.8 g/m$^2$ |
| 6th Layer: Third Red-sensitive Emulsion Layer | |
| Silver iodobromide emulsion spectrally sensitized with sensitizing dyes S-1 and S-2 (monodisperse cubic grains having average grain size of 0.4μ and AgI content of 2 mole %) | 0.4 g/m$^2$ (Ag) |
| Coupler C-3 | 0.7 g/m$^2$ |
| Gelatin | 1.1 g/m$^2$ |
| 7th Layer: Third Intermediate Layer | |
| Dye D-1 | 0.02 g/m$^2$ |
| Gelatin | 0.6 g/m$^2$ |
| 8th Layer: Fourth Intermediate Layer | |
| Surface fogged fine grain silver iodobromide emulsion (average grain size = 0.06μ; AgI content = 1 mole %) | 0.05 g/m$^2$ (Ag) |
| Compound Cpd A | 0.2 g/m$^2$ |
| Gelatin | 1.0 g/m$^2$ |
| 9th Layer: First Green sensitive Emulsion Layer | |
| Silver iodobromide emulsion spectrally sensitized with sensitizing dyes S-3 and S-4 (1:1 mixture of monodisperse cubic grains having average grain size of 0.2μ and AgI content of 5 mole % and monodisperse cubic grains having average grain size of 0.1μ and AgI content of 5 mole %) | 0.5 g/m$^2$ (Ag) |
| Coupler C-4 | 0.3 g/m$^2$ |
| Compound Cpd B | 0.03 g/m$^2$ |
| Gelatin | 0.5 g/m$^2$ |
| 10th Layer: Second Green-sensitive Emulsion Layer | |
| Silver iodobromide emulsion spectrally sensitized with sensitizing dyes S-3 and S-4 (monodisperse cubic grains having average grain size of 0.4μ and AgI content of 5 mole %) | 0.4 g/m$^2$ (Ag) |
| Coupler C-4 | 0.3 g/m$^2$ |
| Compound Cpd B | 0.03 g/m$^2$ |
| Gelatin | 0.6 g/m$^2$ |
| 11th Layer: Third Green-sensitive Emulsion Layer | |
| Silver iodobromide emulsion spectrally sensitized with sensitizing dyes S-3 and S-4 (emulsion containing tabular grains having an aspect ratio of 5, average grain size of 0.5μ and AgI content of 2 mole %) | 0.5 g/m$^2$ (Ag) |
| Coupler C-4 | 0.8 g/m$^2$ |
| Compound Cpd B | 0.08 g/m$^2$ |
| Gelatin | 1.0 g/m$^2$ |
| 12th Layer: Fifth Intermediate Layer | |
| Dye D-2 | 0.05 g/m$^2$ |
| Gelatin | 0.6 g/m$^2$ |
| 13th Layer: Yellow Filter Layer | |
| Yellow colloidal silver | 0.1 g/m$^2$ |
| Compound Cpd A | 0.01 g/m$^2$ |
| Gelatin | 1.1 g/m$^2$ |
| 14th Layer: First Blue-sensitive Emulsion Layer | |
| Silver iodobromide emulsion spectrally sensitized with sensitizing dyes S-5 and S-6 (1:1 mixture of monodisperse emulsion of cubic grains having average grain size of 0.2μ and AgI content of 3 mole % and monodisperse emulsion of cubic grains having average grain size of 0.1μ and AgI content of 3 mole %) | 0.6 g/m$^2$ (Ag) |
| Coupler C-5 | 0.6 g/m$^2$ |
| Gelatin | 0.8 g/m$^2$ |
| 15th Layer: Second Blue-sensitive Emulsion Layer | |
| Silver iodobromide emulsion spectrally sensitized with sensitizing dyes S-7 and S-8 (emulsion containing tabular grains having an aspect ratio of 7, average grain size of 0.5μ and AgI content of 2 mole %) | 0.4 g/m$^2$ (Ag) |
| Coupler C-5 | 0.3 g/m$^2$ |
| Coupler C-6 | 0.3 g/m$^2$ |
| Gelatin | 0.9 g/m$^2$ |
| 16th Layer: Third Blue-sensitive Emulsion Layer | |
| Silver iodobromide emulsion spectrally sensitized with sensitizing dyes S-7 and S-8 (emulsion containing tabular grains having an aspect ratio of 7, average grain size of 1.0μ and AgI content of 2 mole %) | 0.4 g/m$^2$ (Ag) |
| Coupler C-6 | 0.7 g/m$^2$ |
| Gelatin | 1.2 g/m$^2$ |
| 17th Layer: First Protective Layer | |
| Ultraviolet absorber U-1 | 0.04 g/m$^2$ |
| Ultraviolet absorber U-3 | 0.03 g/m$^2$ |
| Ultraviolet absorber U-4 | 0.03 g/m$^2$ |
| Ultraviolet absorber U-5 | 0.05 g/m$^2$ |
| Ultraviolet absorber U-6 | 0.05 g/m$^2$ |
| Compound Cpd C | 0.8 g/m$^2$ |
| D-3 | 0.05 g/m$^2$ |
| Gelatin | 0.7 g/m$^2$ |
| 18th Layer: Second Protective Layer | |
| Surface fogged fine grain silver iodobromide | 0.1 g/m$^2$ (Ag) |

-continued

| | |
|---|---|
| emulsion (average grain size = 0.06μ; AgI content = 1 mole %) | |
| Polymethyl methacrylate particles (average particle size = 1.5μ) | 0.1 g/m$^2$ |
| Polymethyl methacrylate-acrylic acid (4:6) copolymer (average particle size = 1.5μ) | 0.1 g/m$^2$ |
| Silicone oil | 0.03 g/m$^2$ |

-continued

| | |
|---|---|
| Fluorine containing surfactant W-1 | 3 mg/m$^2$ |
| Gelatin | 0.8 g/m$^2$ |

In addition to the foregoing components, each composition further comprises a gelatin hardening agent H-1 and a surfactant.

C-1

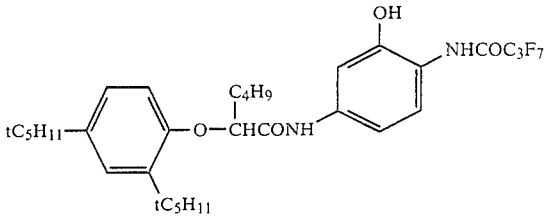

C-2

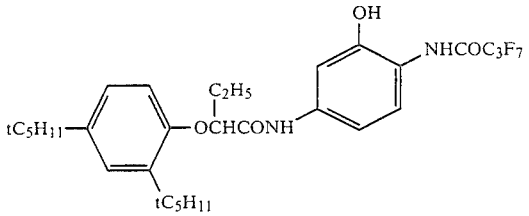

C-3

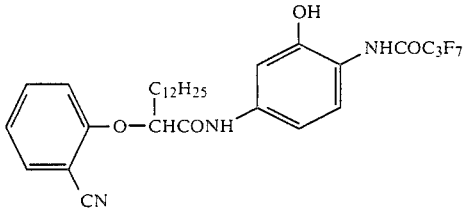

C-4

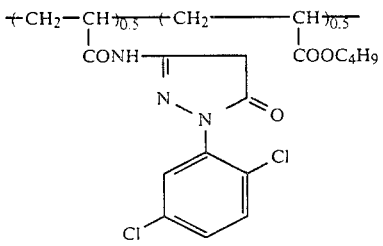

C-5

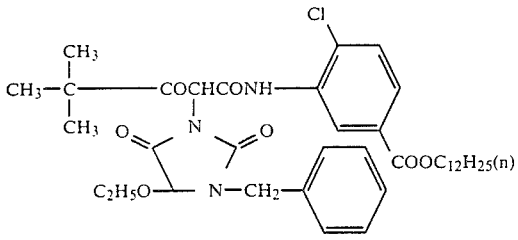

C-6

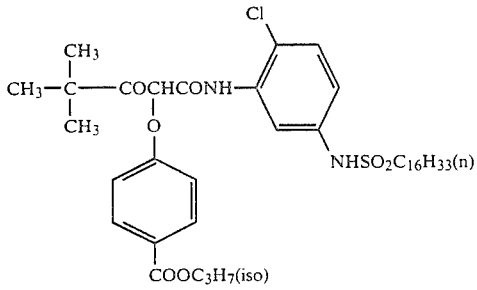

Dibutyl Phthalate — Oil 1

-continued
Tricresyl Phosphate — Oil 2
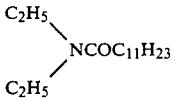
Oil 3
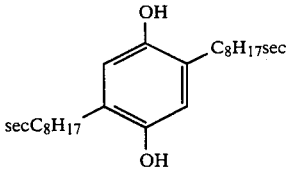
Cpd A
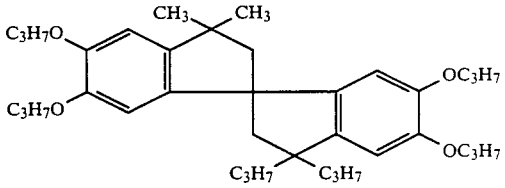
Cpd B
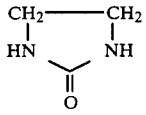
Cpd C
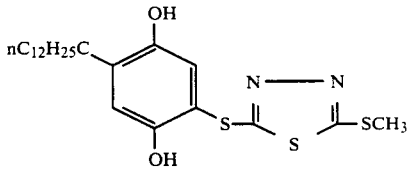
Cpd D
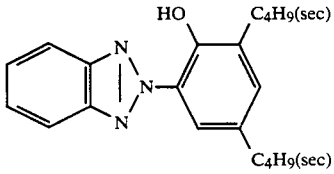
U-1
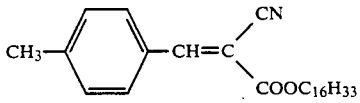
U-2
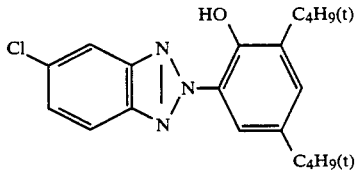
U-3
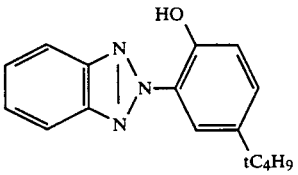
U-4
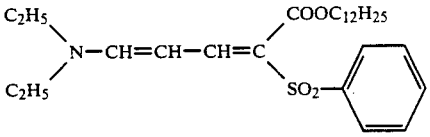
U-5

-continued
U-6
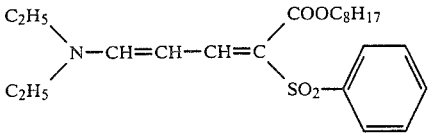
S-1
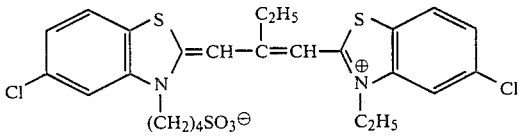
S-2
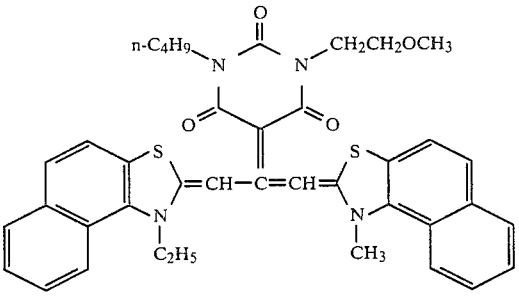
S-3
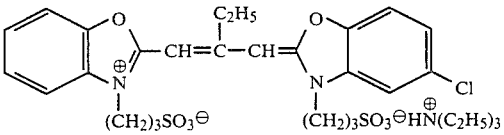
S-4
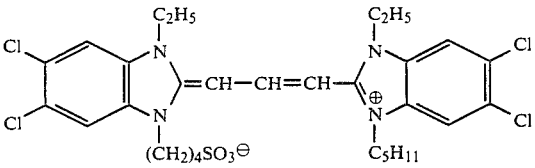
S-5
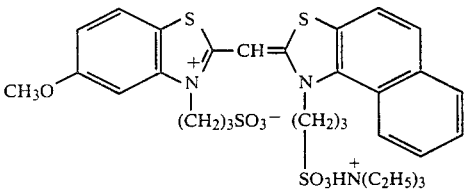
S-6
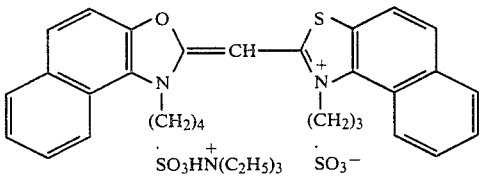
D-1
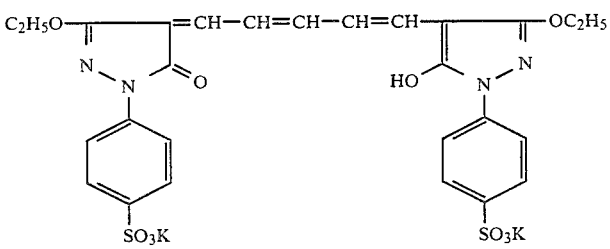

-continued

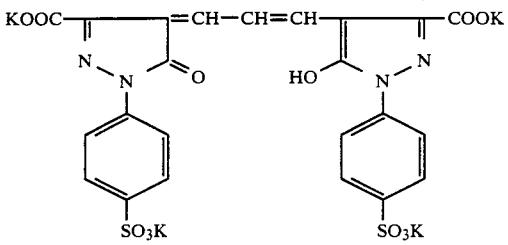

D-2

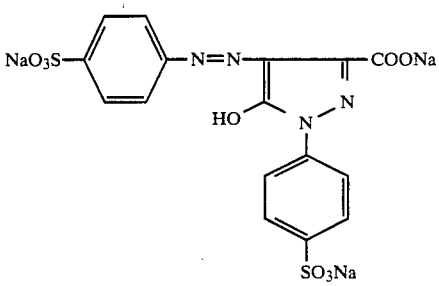

D-3

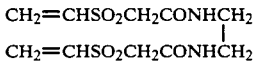

H-1

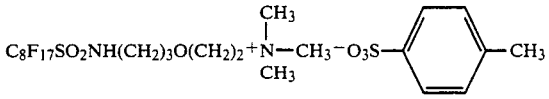

W-1

The color photographic light-sensitive material (Sample 201) thus prepared was exposed to light and then processed according to the following processes utilizing an automatic developing machine, in which the processing was continued till the cumulative amount of replenisher reached three times the volume of the tank for mother liquor.

| Process | Processing time (second) | Processing Temp. (°C.) | Amount Replenished (ml/m²) | Volume of Tank (l) |
|---|---|---|---|---|
| First development | 360 | 38 | 2200 | 12 |
| First water washing | 45 | 38 | 2200 | 2 |
| Reversal | 45 | 38 | 1100 | 2 |
| Color development | 360 | 38 | 2200 | 12 |
| Bleaching | 120 | 38 | 860 | 4 |
| Bleach-fixing | 240 | 38 | 360 | 8 |
| Second water washing (1) | 60 | 38 | — | 2 |
| Second water washing (2) | 60 | 38 | 1100 | 2 |
| Stabilization | 60 | 25 | 1100 | 2 |
| Drying | 60 | 65 | — | — |

**The replenishing of the second water washing was performed according to so-called countercurrent replenishment system in which a replenisher was introduced into the water washing (2) and the overflow from the washing (2) was introduced into the second water washing (1).

The composition of each processing solution is as follows:

| First Developer | Tank Soln. (g) | Replenisher (g) |
|---|---|---|
| Pentasodium nitrilo-N,N,N-trimethylene phosphonate | 2.0 | 2.0 |
| Sodium sulfite | 30 | 30 |

-continued

| First Developer | Tank Soln. (g) | Replenisher (g) |
|---|---|---|
| Potassium hydroquinone monosulfonate | 20 | 20 |
| Potassium carbonate | 33 | 33 |
| 1-Phenyl-4-methyl-4-hydroxy-methy-3-pyrazolidone | 2.0 | 2.0 |
| Potassium bromide | 2.5 | 1.4 |
| Potassium thiocyanate | 1.2 | 1.2 |
| Potassium iodide | 1.2 (mg) | |
| Water | ad. 1,000 ml | ad. 1,000 ml |
| pH | 9.60 | 9.60 |

*pH was adjusted by the addition of hydrochloric acid or potassium hydroxide.

| First Washing Water: Tank Soln. and Replenisher | Amount (g) |
|---|---|
| Ethylenediaminetetramethylene phosphonic acid | 2.0 |
| Disodium hydrogen phosphate | 5.0 |
| Water | ad. 1,000 ml |
| pH | 7.00 |

*pH was adjusted with hydrochloric acid or sodium hydroxide.

| Reversal Solution: Tank Solution and Replenisher | Amount (g) |
|---|---|
| Pentasodium nitrilo-N,N,N-trimethylene phosphonate | 3.0 |
| Tin (II) chloride dihydrate | 1.0 |
| p-Aminophenol | 0.1 |
| Sodium hydroxide | 8 |
| Glacial acetic acid | 15 (ml) |
| Water | ad. 1,000 ml |
| pH | 6.00 |

*pH was adjusted with hydrochloric acid or sodium hydroxide.

| Color Developer | Tank Soln. (g) | Replenisher (g) |
|---|---|---|
| Pentasodium nitrilo-N,N,N-trimethylene phosphonate | 2.0 | 2.0 |
| Sodium sulfite | 7.0 | 7.0 |
| Trisodium phosphate dodecahydrate | 36 | 36 |
| Potassium bromide | 1.0 | — |
| Potassium iodide | 90 (mg) | — |
| Sodium hydroxide | 3.0 | 3.0 |
| Citrazinic acid | 1.5 | 1.5 |
| N-Ethyl-N-(β-methanesulfonamidoethyl)-3-methyl-4-aminoaniline sulfate | 11 | 11 |
| 3,6-dithiaoctane-1,8-diol | 1.0 | 1.0 |
| Water | ad. 1,000 ml | ad. 1,000 ml |
| pH | 11.80 | 12.00 |

*pH was adjusted by adding hydrochloric acid or potassium hydroxide.

| Bleaching Solution: Tank Solution and Replenisher | Amount (g) |
|---|---|
| Disodium ethylenediaminetetraacetate dihydrate | 10.0 |
| Ferric ammonium ethylenediaminetetraacetate dihydrate | 120 |
| Ammonium bromide | 100 |
| Ammonium nitrate | 10 |
| Bleaching accelerator | 0.005 (mole) |

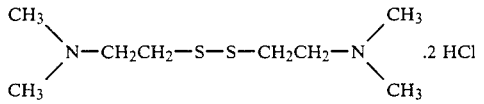

| | |
|---|---|
| Water | ad. 1,000 ml |
| pH | 6.30 |

*pH was adjusted with hydrochloric acid or aqueous ammonia.

| Bleach-fixing Solution: Tank Solution and Replenisher | Amount (g) |
|---|---|
| Ferric ammonium ethylenediaminetetraacetate dihydrate | 50 |
| Disodium ethylenediaminetetraacetate dihydrate | 5.0 |
| Sodium thiosulfate | 80 |
| Sodium sulfite | 12.0 |
| Water | ad. 1,000 ml |
| pH | 6.60 |

*pH was adjusted with hydrochloric acid or aqueous ammonia.

Second Water Washing Solution

Tank Soln. & Replenisher

Tap water was passed through a mixed bed column packed with an H-type strong acidic cation-exchange resin (available from Rohm & Hass Co., Ltd. under the trade name of Amderlite IR-120B) and an OH-type anion-exchange resin (available from the same company under the trade name of Amberlite IR-400) to reduce the concentrations of calcium and magnesium ions to not more than 3 mg/l respectively and then 20 mg/l of sodium dichloroisocyanurate and 1.5 g/l of sodium sulfate were added thereto. The pH value of this solution was in the range of 6.5 to 7.5.

| Stabilization Solution: Tank Soln. and Replenisher | Amount (ml) |
|---|---|
| 37% Formalin | 5.0 |
| Polyoxyethylene p-monononylphenyl ether (average degree of polymerization = 10) | 0.5 |

-continued

| Stabilization Solution: Tank Soln. and Replenisher | Amount (ml) |
|---|---|
| Water | ad. 1,000 ml |
| pH | not controlled |

Then, continuous processing was performed by incorporating an ion-exchange resin into the bleach-fixing bath as in Example 1 except that the amount of the resin packed in a column was changed as in Table II in every processing. After the continuous processing, Sample 201 which had been exposed to light (4800° K.; 100 CMS) was processed and the amount of silver remaining on Sample was determined by means of fluorescent X-rays technique.

TABLE II

| Test No. | Amount of resin (l) | Amount of residual Ag ($\mu g/cm^2$) |
|---|---|---|
| 1* | 0 | 15.6 |
| 2 | 0.024 | 5.0 |
| 3 | 0.24 | 4.8 |
| 4 | 0.50 | 0.8 |
| 5 | 1.00 | 0.3 |

As seen from the results listed in Table II, when the ion-exchange resin was used, the amount of the residual silver is low compared with that observed when it was not used and thus good results are obtained.

Each of Samples was also processed at 38° C. for 4 min. 20 seconds using a fixing solution $N_3$ for processing color negative film CN-16 Process (available from Fuji Photo Film Co., Ltd.). There was observed no change in the amount of residual silver.

EXAMPLE 3

A color photographic light-sensitive material (Sample 301) was prepared by applying in order coating solutions for 1st to 12th layers having the following compositions onto the surface of a paper subatrate whose both sides had been laminated with polyethylene sheets. The polyethlene sheet on the side of the 1st layer contained titanium white as a white pigment and a trace amount of Ultramarine Blue as a bluing dye.

Composition of the Light-sensitive Layer

The numerical values given below are the coated amount of each component expressed in $g/m^2$. The amount of coated silver halide is expressed in the amount of elemental silver.

| | |
|---|---|
| 1st Layer: Gelatin Layer | |
| Gelatin | 1.30 |
| 2nd Layer: Antihalation Layer | |
| Black colloidal silver | 0.10 |
| Gelatin | 0.70 |
| 3rd Layer: Low Sensitive Red-sensitive Emulsion Layer | |
| Silver iodobromide spectrally sensitized with red sensitizing dyes (*1 and *2) (AgI = 4.0 mole %; average grain size = 0.4μ) | 0.12 |
| Gelatin | 1.00 |
| Cyan coupler (*3) | 0.14 |
| Cyan coupler (*4) | 0.07 |
| Antidiscoloring agent (*5, *6 and *7) | 0.10 |
| Solvent for coupler (*8 and *9) | 0.06 |
| 4th Layer: High Sensitive Red-sensitive Emulsion Layer | |
| Silver iodobromide spectrally sensitized with red sensitizing dye (*1 and *2) (AgI = 5.0 mole %; average grain size = 0.7μ) | 0.14 |

-continued

| | |
|---|---|
| Gelatin | 1.00 |
| Cyan coupler (*3) | 0.20 |
| Cyan coupler (*4) | 0.10 |
| Antidiscoloring agent (*5, *6 and *7) | 0.15 |
| Solvent for coupler (*8 and *9) | 0.10 |
| 5th Layer: Intermediate Layer | |
| Magenta colloidal silver | 0.02 |
| Gelatin | 1.00 |
| Color mixing inhibitor (*10) | 0.08 |
| Solvent for color mixing inhibitor (*11 and *12) | 0.16 |
| Polymer latex (*13) | 0.10 |
| 6th Layer: Low Sensitive Green-sensitive Layer | |
| Silver iodobromide spectrally sensitized with green sensitizing dye *14 (AgI = 2.0 mole %; grain size = 0.4μ) | 0.09 |
| Gelatin | 0.80 |
| Magenta coupler (*15) | 0.10 |
| Antidiscoloring agent (*16) | 0.10 |
| Stain resistant agent (*17) | 0.01 |
| Stain resistant agent (*18) | 0.001 |
| Solvent for coupler (*11 and *19) | 0.15 |
| 7th Layer: High Sensitive Green-sensitive Layer | |
| Silver iodobromide spectrally sensitized with green sensitizing dye *14 (AgI = 3.0 mole %; grain size = 0.9μ) | 0.09 |
| Gelatin | 0.80 |
| Magenta coupler (*15) | 0.10 |
| Antidiscoloring agent (*16) | 0.10 |
| Stain resistant agent (*17) | 0.01 |
| Stain resistant agent (*18) | 0.001 |
| Solvent for coupler (*11 and *19) | 0.15 |
| 8th Layer: Yellow Filter Layer | |
| Yellow colloidal silver | 0.20 |
| Gelatin | 1.00 |
| Color mixing unhibitor (*10) | 0.06 |
| Solvent for Color mixing inhibitor (*11 and *12) | 0.15 |
| Polymer latex (*13) | 0.10 |
| 9th Layer: Low Sensitive Blue-sensitive Layer | |
| Silver iodobromide spectrally sensitized with blue sensitizing dye *20 (AgI = 2.0 mole %; grain size = 0.5μ) | 0.13 |
| Gelatin | 0.50 |
| Yellow coupler (*21) | 0.20 |
| Stain resistant agent (*18) | 0.001 |
| Solvent for coupler (*9) | 0.05 |
| 10th Layer: High Sensitive Blue-sensitive Layer | |
| Silver iodobromide spectrally sensitized with blue sensitizing dye *20 (AgI = 2.5 mole %; grain size = 1.2μ) | 0.22 |
| Gelatin | 1.00 |
| Yellow coupler (*21) | 0.40 |
| Stain resistant agent (*18) | 0.002 |
| Solvent for coupler (*9) | 0.10 |
| 11th Layer: Ultraviolet Absorbing Layer | |
| Gelatin | 1.50 |
| Ultraviolet absorber (*22, *6 and *7) | 1.00 |
| Color mixing inhibitor (*23) | 0.06 |
| Solvent for color mixing inhibitor (*9) | 0.15 |
| Oxonol type irradiation inhibiting dye | 0.02 |
| Oxonol type irradiation inhibiting dye | 0.02 |
| 12th Layer: Protective Layer | |
| Fine grain silver chlorobromide (AgCl = 97 mole %; average grain size = 0.2μ) | 0.07 |
| Gelatin | 1.50 |

-continued

| | |
|---|---|
| Gelatin hardening agent (*26) | 0.17 |

(*1) Sodium salt of 5,5'-Dichloro-3,3'-di-(3-sulfobutyl)-9-ethylthiacarbonylcyanine;
(*2) Triethyl ammonium 3-(2-(2-(3-(3-sulfopropyl)-naphtho(1,2-d) thiazoline-2-indenemethyl)-1-butenyl)-3-naphtho(1,2-d) thiazolino)-propane sulfonate;
(*3) 2-(α-(2,4-di-t-amylphenoxy)-hexaneamido)-4,6-dichloro-5-ethylphenol;
(*4) 2-(2-Chlorobenzoylamido)-4-chloro-5-(α-(2-chloro-4-t-amylphenoxy)-octaneamido)-phenol;
(*5) 2-(2-Hydroxy-3-sec-5-t-butylphenyl)-benzotriazole;
(*6) 2-(2-Hydroxy-5-t-butylphenyl)-benzotriazole;
(*7) 2-(2-Hydroxy-3,5-di-t-butylphenyl)-6-chloro-benzotriazole;
(*8) Dioctyl phthalate;
(*9) Trinonyl phosphate;
(*10) 2,5-Di-t-octylhydroquinone;
(*11) Tricresyl phosphate;
(*12) Dibutyl phthalate;
(*13) Polyethyl acrylate;
(*14) Sodium salt of 5,5'-diphenyl-9-ethyl-3,3'-disulfopropyl-oxacarbocyanine;
(*15) 7-Chloro-6-methyl-2-(1-(2-octyloxy-5-(2-octyloxy-5-t-octylbenzene-sulfonamido)-2-propyl)-1H-pyrazolo(1,5-b) (1,2,4)triazole;
(*16) 3,3,3',3'-Tetramethyl 1-5,6,5',6'-tetrapropoxy-1,1'-bis-spiroindane;
(*17) 3-(2-Ethylhexyloxycarbonyloxy)-1-(3-hexadecyloxyphenyl)-2-pyrazoline;
(*18) 2-Methyl-5-t-octylhydroquinone;
(*19) Trioctyl phosphate;
(*20) Triethyl ammonium 3-(2-(3-benzylrhodanin-5-ilydene)-3-benzoxazonyl)-propane sulfonate;
(*21) α-pivaloyl-α-((2,4-dioxo-1-benzyl-5-ethoxyhydantoin-3-yl)-2-chloro-5-(α-2,4-di-t-amylphenoxy)-butaneamido)-acetanilide;
(*22) 5-Chloro-2-(2-hydroxy-3-t-butyl-5-t-octyl)-phenyl-benzotriazole;
(*23) 2,5-Di-sec-octylhydroquinone;
(*24) 1,4-Bis(vinylsulfonylacetamido)-ethane.

| Process | Temp. (°C.) | Processing Time (sec) |
|---|---|---|
| First development (monochromatic development) | 38 | 45 |
| Water washing | 38 | 45 |
| Reversal exposure | not less than 500 Lux | not less than 15 |
| Color development | 38 | 60 |
| Water washing | 38 | 15 |
| Bleach-fixing | 38 | 60 |
| Water washing | 38 | 60 |
| Drying | 75 | 60 |

Composition of Processing Solutions

| | Amount (g) |
|---|---|
| [First Developer] | |
| Pentasodium nitrilo-N,N,N-trimethylene phosphonate | 0.6 |
| Pentasodium diethylenetriaminepentaacetate | 4.0 |
| Potassium sulfite | 30.0 |
| Potassium thiocyanate | 1.2 |
| Potassium carbonate | 35.0 |
| Potassium hydroquinone monosulfonate | 25.0 |
| Diethylene glycol | 15.0 (ml) |
| 1-Phenyl-4-hydroxymethyl-4-methyl-3-pyrazolidone | 2.0 |
| Potassium bromide | 5.0 (mg) |
| Water | ad. 1,000 (pH 9.7) |
| [Color Developer] | |
| Triethanolamine | 8.0 |
| N,N-Diethylhydroxylamine | 4.0 |
| 3,6-Dithia-1,8-octanediol | 0.2 |
| Disodium ethylenediaminetetraacetate dihydrate | 2.0 |
| Sodium sulfite | 0.2 |
| Potassium carbonate | 25.0 |
| N-Ethyl-N-(β-methanesulfonamidoethyl)-3-methyl-4-amino-aniline sulfate | 8.0 |
| Potassium bromide | 0.5 |
| Potassium iodide | 0.1 (mg) |
| Water | ad. 1,000 (pH 10.4) |
| [Bleach-fixing Solution] | |
| 2-Mercapto-1,3,4-triazole | 0.5 |
| Disodium ethylenediaminetetraacetate dihydrate | 5.0 |
| Ferric ammonium ethylenediaminetetraacetate monohydrate | 80.0 |
| Sodium sulfite | 15.0 |

-continued

| Composition of Processing Solutions | Amount (g) |
|---|---|
| Sodium thiosulfate (700 g/l solution) | 160.0 |
| Glacial acetic acid | 6.0 |
| Water | ad. 1,000 (pH 6.0) |

The silver halide color photographic light-sensitive material (Sample 301) thus prepared was imagewise exposed to light and then processed according to the following processes utilizing an automatic developing machine, in which the processing was continued till the cumulative amount of replenisher reached three times the volume of the tank therefor.

| Process | Processing time (second) | Processing Temp. (°C.) | Amount Replenished (l/m$^2$) | Volume of Tank for Mother Liquor (l) |
|---|---|---|---|---|
| First development | 60 | 38 | 330 | 6 |
| First water washing (1) | 30 | 33 | — | 3 |
| First water washing (2) | 30 | 33 | 220 | 3 |
| Color development | 90 | 38 | 330 | 9 |
| Bleaching | 60 | 38 | 120 | 6 |
| Bleach-fixing | 60 | 38 | 80 | 6 |
| Second water washing (1) | 20 | 33 | — | 2 |
| Second water washing (2) | 20 | 33 | — | 2 |
| Second water washing (3) | 20 | 33 | 330 | 2 |
| Drying | 45 | 75 | — | — |

In the above processes, the first and second water washing process were performed by countercurrent replenishing system. More specifically, the first water washing solution was supplemented to first water washing bath (2) and the overflow from the water washing bath (2) was introduced into the first water washing bath (1); on the other hand the second water washing solution was supplemented to the second water washing bath (3), the overflow from the bath (3) was introduced into the second water washing bath (2) and that from the latter was introduced into the second water washing bath (1).

The composition of each processing solution is as follows:

| First Developer | Tank Soln. (g) | Replenisher (g) |
|---|---|---|
| Pentasodium nitrilo-N,N,N-trimethylene phosphonate | 1.0 | 1.0 |
| Pentasodium diethylenetriamine-pentaacetate | 3.0 | 3.0 |
| Potassium sulfite | 30.0 | 30.0 |
| Potassium thiocyanate | 1.2 | 1.2 |
| Potassium carbonate | 35.0 | 35.0 |
| Potassium hydroquinone monosulfonate | 25.0 | 25.0 |
| 1-Phenyl-3-pyrazolidone | 2.0 | 2.0 |
| Potassium bromide | 0.5 | — |
| Potassium iodide | 5.0 (mg) | |
| Water | ad. 1,000 | ad. 1,000 |
| pH | 9.60 | 9.70 |

*pH was adjusted by the addition of hydrochloric acid or potassium hydroxide.

-continued

| First Washing Water: Tank Soln. and Replenisher | Amount (g) |
|---|---|
| Ethylenediaminetetramethylene phosphonic acid | 2.0 |
| Disodium hydrogen phosphate | 5.0 |
| Water | ad 1,000 |
| pH | 7.00 |

*pH was adjusted with hydrochloric acid or sodium hydroxide.

| Color Developer | Tank Soln. (g) | Replenisher (g) |
|---|---|---|
| 3,6-Dithio-1,8-octane-diol | 2.00 | 2.50 |
| Pentasodium nitrilo-N,N,N-trimethylene phosphonate | 0.5 | 0.5 |
| Pentasodium diethylenetriamine-pentaacetate | 2.0 | 2.0 |
| Triethylenediamine-1,4-diazabicyclo(2,2,2)octane | 5.0 | 6.2 |
| N-Ethyl-N-(β-methanesulfonamidoethyl)-3-methylamino-aniline sulfate | 6.0 | 9.0 |
| Ethylenediamine | 10.0 | 12.0 |
| Fluorescent brightener (diamino-stilbene type) | 1.0 | 1.2 |
| Potassium bromide | 0.5 | — |
| Potassium iodide | 1.0 (mg) | — |
| Water | ad. 1,000 | ad. 1,000 |
| pH | 10.60 | 11.00 |

*pH was adjusted by adding hydrochloric acid or potassium hydroxide.

| Bleaching Solution: Tank Solution and Replenisher | Amount (g) |
|---|---|
| Disodium ethylenediaminetetraacetate | 10.0 |
| Ferric ammonium ethylenediaminetetraacetate dihydrate | 120 |
| Ammonium bromide | 100 |
| Ammonium nitrate | 10 |
| Water | ad. 1,000 |
| pH | 6.30 |

*pH was adjusted with acetic acid or aqueous ammonia.

| Bleach-fixing Solution: Tank Solution and Replenisher | Amount (g) |
|---|---|
| Ferric ammonium ethylenediaminetetraacetate monohydrate | 80.0 |
| Disodium ethylenediaminetetraacetate | 5.0 |
| Ammonium thiosulfate (700 g/l) | 160 |
| Sodium sulfite | 15.0 |
| Bleaching accelerator | (see Table III) |
| Water | ad. 1,000 |
| pH | 6.50 |

*pH was adjusted with acetic acid or aqueous ammonia.

Second Water Washing Solution

Tank Soln. & Replenisher

Tap water was passed through a mixed bed column packed with an H-type strong acidic cation-exchange resin (available from Rohm & Hass Co., Ltd. under the trade name of Amberlite IR-120B) and an OH-type anion-exchange resin (available from the same company under the trade name of Amberlite IR-400) to reduce the concentrations of calcium and magnesium ions to not more than 3 mg/l respectively and then 20 mg/l of sodium dichloroisocyanurate and 1.5 g/l of sodium sulfate were added thereto. The pH value of this solution was in the range of 6.5 to 7.5.

Moreover, a column packed with one liter of the ion-exchange resin was incorporated into the bleach-fixing bath as in Example 1.

In the foregoing processing, continuous processing was performed while adding bleaching accelerator to the bleach-fixing solution as shown in Table III. After the continuous processing, Sample 301 which was not exposed to light was processed and the amount of silver remaining on Sample was determined.

TABLE III

| Test No. | Bleaching Accelerator Compound | Amount added (mole/l) | Amount of Residual Ag ($\mu g/cm^2$) |
|---|---|---|---|
| 1* | — | — | 5.4 |
| 2 | (III)-(3) | 0.005 | 1.7 |
| 3 | (IV)-(1) | 0.005 | 1.0 |
| 4 | (V)-(1) | 0.005 | 0.8 |
| 5 | (III)-(5) | 0.005 | 0.7 |
| 6 | (IV)-(3) | 0.005 | 1.2 |

*Comparative Example.

As seen from Table III, good results (low residual silver) were obtained when the bleaching accelerator was added to the bleach-fixing solution, since the bleaching ability of the bath was markedly enhanced.

Each of Samples was also processed as 38° C. for 4 min. 20 sec. using a fixing solution $N_3$ for processing color negative films CN-16 Process (available from Fuji Photo Film Co., Ltd.). There was observed no change in the amount of residual silver.

EXAMPLE 4

A color photographic light-sensitive material (Sample 401) was prepared in the same manner as that for preparing Sample 301 except that the exemplary compound (I)-(2) was added to the first layer of Sample 301 in an amount of $1\times10^{-4}$ mole per 1 $m^2$ of the light-sensitive material. Sample 401 was continuously processed according to the process No. 1 in Example 3. After the continuous processing, unexposed Sample 401 was processed and it was found that the amount of residual silver was low (1.8 $\mu g/cm^2$) which was better than that of Comparative Example (Table III, No. 1; 5.4 $\mu g/cm^2$).

Each of Samples was also processed as 38° C. for 4 min. 20 sec. using a fixing solution $N_3$ for processing color negative films CN-16 Process (available from Fuji Photo Film Co., Ltd.). There was observed no change in the amount of residual silver.

EXAMPLE 5

Sample 103 prepared in Example 1 was continuously processed as in Example 1 utilizing a variety of anion-exchange resins listed in Table IV. The amount of residual silver of the resultant sample was determined in the same manner as in Example 1.

TABLE IV

| Process No. | Anion-exchange resin | Amount of Residual Silver ($\mu g/cm^2$) |
|---|---|---|
| 1* | — | 16.5 |
| 2 | DIAION WA-20 | 10.3 |
| 3 | DIAION PA-318 | 3.5 |
| 4 | DIAION PA-418 | 3.0 |
| 5 | Exemplary Resin (34) | 2.5 |
| 6 | Exemplary Resin (19) | 1.0 |
| 7 | Exemplary Resin (1) | 4.3 |
| 8 | Exemplary Resin (4) | 0.5 |
| 9 | Exemplary Resin (48) | 0.7 |
| 10 | Exemplary Resin (51) | 0.8 |

*Comparative Example.
**"DIAION" is the trade name of the anion-exchange resins manufactured and sold by MITSUBISHI CHEMICAL INDUSTRIES LTD.

As seen from the results listed in Table IV, good results (low residual silver) were obtained when the anion-exchange resin of the present invention was used, since the bleaching ability of the processing bath was markedly enhanced.

Each of Samples was also processed as 38° C. for 4 min. 20 sec. using a fixing solution $N_3$ for processing color negative films CN-16 Process (available from Fuji Photo Film Co., Ltd.). There was observed no change in the amount of residual silver.

EXAMPLE 6

A multi-layered color light-sensitive material (Sample 601) was prepared by applying in order coating solutions having the following compositions on the surface of a substrate of cellulose triacetate to which an underlying layer had been applied.

Composition of the light-sensitive Layer

The numerical values given below are the coated amount of each component expressed in $g/m^2$, that of silver halide is expressed in reduced amount of elemental silver. The coated amount of sensitizing dyes is expressed in moles per mole of silver halide included in the same layer.

| | |
|---|---|
| 1st Layer: Halation Inhibiting Layer | |
| Black colloidal silver | 0.2 |
| Gelatin | 1.0 |
| Ultraviolet absorber UV-1 | 0.05 |
| Ultraviolet absorber UV-2 | 0.1 |
| Ultraviolet absorber UV-3 | 0.1 |
| Dispersion oil Oil-1 | 0.02 |
| 2nd Layer: Intermediate Layer | |
| Fine grain silver bromide (average grain size = 0.07$\mu$) | 0.15 |
| Gelatin | 1.0 |
| 3rd Layer: First Red-sensitive Emulsion Layer | |
| Emulsion A | 1.42 |
| Gelatin | 0.9 |
| Sensitizing dye A | $2.0\times10^{-4}$ |
| Sensitizing dye B | $1.0\times10^{-4}$ |
| Sensitizing dye C | $0.3\times10^{-4}$ |
| Cp-b | 0.35 |
| Cp-c | 0.052 |
| Cp-d | 0.047 |
| D-1 | 0.023 |
| D-2 | 0.035 |
| HBS-1 | 0.10 |
| HBS-2 | 0.10 |
| 4th Layer: Intermediate Layer | |
| Gelatin | 0.8 |
| Cp-b | 0.10 |
| HBS-1 | 0.05 |
| 5th Layer: Second Red-sensitive Emulsion Layer | |
| Emulsion B | 1.38 |
| Gelatin | 1.0 |
| Sensitizing dye A | $1.5\times10^{-4}$ |
| Sensitizing dye B | $2.0\times10^{-4}$ |
| Sensitizing dye C | $0.5\times10^{-4}$ |
| Cp-b | 0.150 |
| Cp-d | 0.027 |
| D-1 | 0.005 |
| D-2 | 0.010 |
| HBS-1 | 0.050 |
| HBS-2 | 0.060 |
| 6th Layer: Third Red-sensitive Emulsion Layer | |
| Emulsion E | 2.08 |
| Gelatin | 1.5 |
| Cp-a | 0.060 |
| Cp-c | 0.024 |
| Cp-d | 0.038 |
| D-1 | 0.006 |
| HBS-1 | 0.12 |
| 7th Layer: Intermediate Layer | |
| Gelatin | 1.0 |
| Cpd-A | 0.05 |
| HBS-2 | 0.05 |

-continued

| | |
|---|---|
| 8th Layer: First Green-sensitive Emulsion Layer | |
| Monodisperse silver iodobromide emulsion (AgI = 3 mole %; average grain size = 0.4μ; coefficient of variation = 19%) | 0.64 |
| Monodisperse silver iodobromide emulsion (AgI = 6 mole %; average grain size = 0.7μ; coefficient of variation = 18%) | 1.12 |
| Gelatin | 1.0 |
| Sensitizing dye D | $1 \times 10^{-4}$ |
| Sensitizing dye E | $4 \times 10^{-4}$ |
| Sensitizing dye F | $1 \times 10^{-4}$ |
| Cp-f | 0.80 |
| Cp-g | 0.084 |
| Cp-k | 0.035 |
| Cp-l | 0.036 |
| D-3 | 0.41 |
| D-4 | 0.018 |
| HBS-1 | 0.25 |
| HBS-2 | 0.45 |
| 9th Layer: Second Green-sensitive Emulsion Layer | |
| Monodisperse silver iodobromide emulsion (AgI = 7 mole %; average grain size = 1.0μ; | 2.07 |
| Gelatin | 1.5 |
| Sensitizing dye D | $1.5 \times 10^{-4}$ |
| Sensitizing dye E | $2.3 \times 10^{-4}$ |
| Sensitizing dye F | $1.5 \times 10^{-4}$ |
| Cp-f | 0.02 |
| Cp-g | 0.009 |
| HBS-2 | 0.088 |
| 10th Layer: Intermediate Layer | |
| Gelatin | 1.2 |
| Yellow colloidal silver | 0.06 |
| Cpd-A | 0.3 |
| HBS-1 | 0.3 |
| 11th Layer: First Blue-sensitive Emulsion Layer | |
| Monodisperse silver iodobromide emulsion (AgI = 3 mole %; average grain size = 0.4μ; coefficient of variation = 20%) | 0.31 |
| Monodisperse silver iodobromide emulsion (AgI = 5 mole %; average grain size = 0.9μ; coefficient of variation = 17%) | 0.38 |

-continued

| | |
|---|---|
| Gelatin | 2.0 |
| Sensitizing dye G | $1 \times 10^{-4}$ |
| Sensitizing dye H | $1 \times 10^{-4}$ |
| Cp-i | 0.63 |
| Cp-j | 0.57 |
| D-1 | 0.020 |
| D-4 | 0.015 |
| HBS-1 | 0.05 |
| 12th Layer: Second Blue-sensitive Emulsion Layer | |
| Monodisperse silver iodobromide emulsion (AgI = 8 mole %; average grain size = 1.3μ; coefficient of variation = 18%) | 0.77 |
| Gelatin | 0.5 |
| Sensitizing dye G | $5 \times 10^{-5}$ |
| Sensitizing dye H | $5 \times 10^{-5}$ |
| Cp-i | 0.10 |
| Cp-j | 0.10 |
| D-4 | 0.005 |
| HBS-2 | 0.10 |
| 13th Layer: Intermediate Layer | |
| Gelatin | 0.5 |
| Cp-m | 0.1 |
| UV-1 | 0.1 |
| UV-2 | 0.1 |
| UV-3 | 0.1 |
| HBS-1 | 0.05 |
| HBS-2 | 0.05 |
| 14th Layer: Protective Layer | |
| Monodisperse silver iodobromide emulsion (AgI = 4 mole %; average grain size = 0.05μ; coefficient of variation = 10%) | 0.1 |
| Gelatin | 1.5 |
| Polymethyl methacrylate particles (average diameter = 1.5μ) | 0.1 |
| S-1 | 0.2 |
| S-2 | 0.2 |

To each layer, there were added a surfactant K-1 and gelatin hardening agent H-1 in addition to the foregoing components.

Sensitizing Dye A

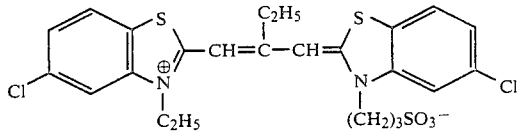

Sensitizing Dye B

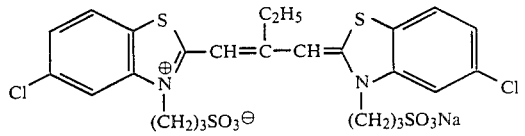

Sensitizing Dye C

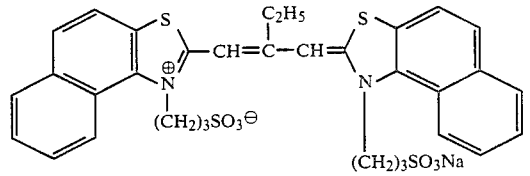

Sensitizing Dye D

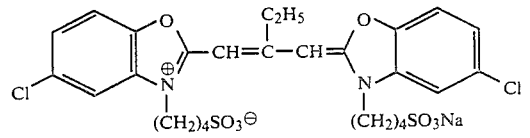

-continued
Sensitizing Dye E
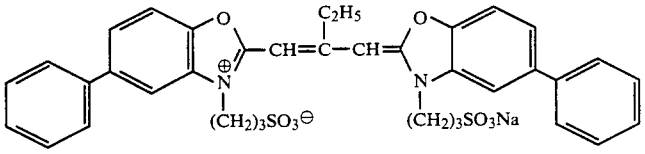
Sensitizing Dye F
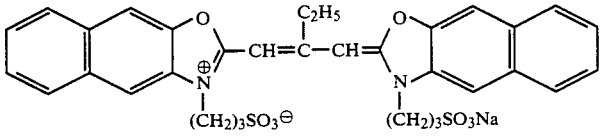
Sensitizing Dye G
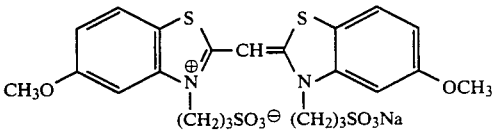
Sensitizing Dye H
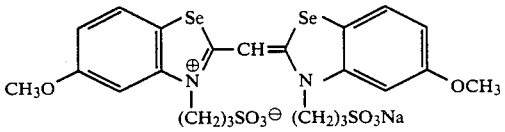
D-1
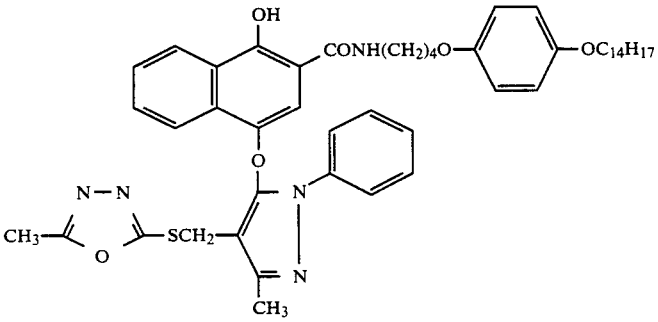
D-2
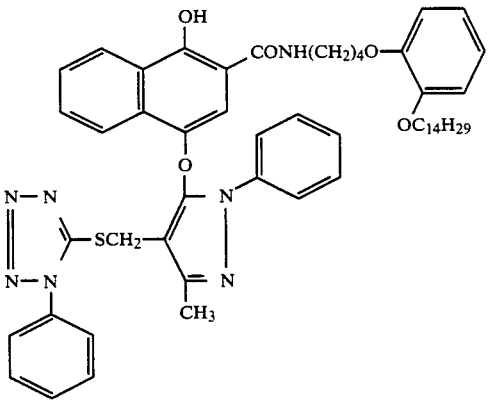

-continued
D-3
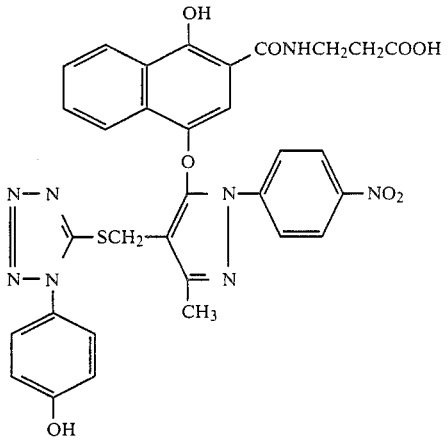
D-4
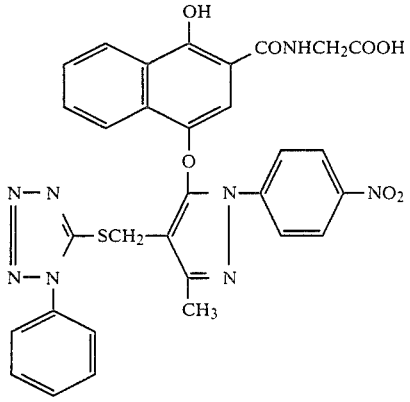
D-5
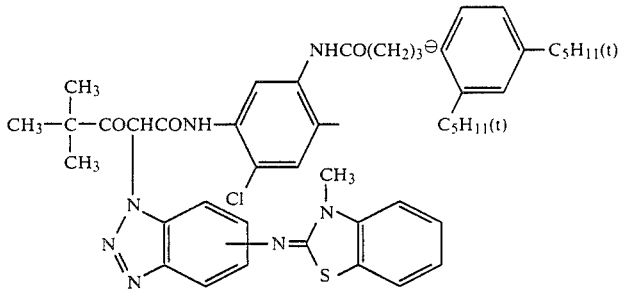
OIL-1
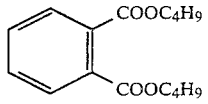
Cp-a
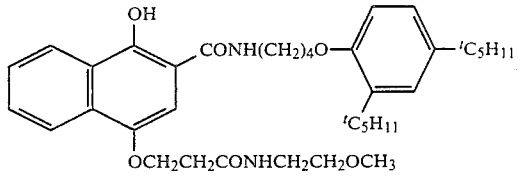
Cp-b
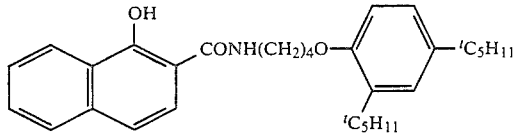

-continued
Cp-c
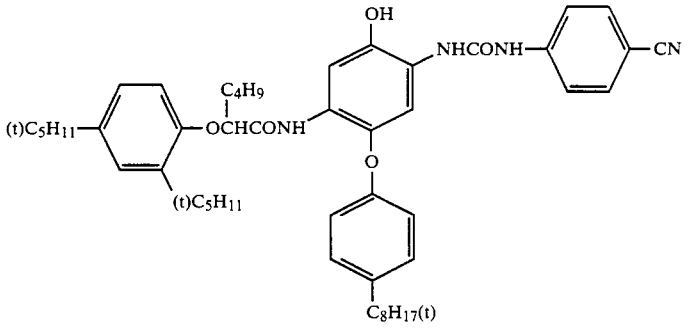
Cp-d
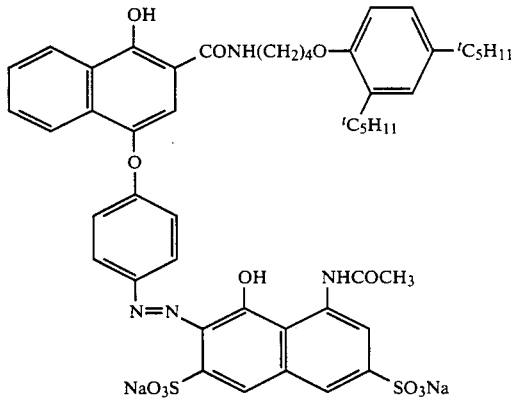
Cp-f
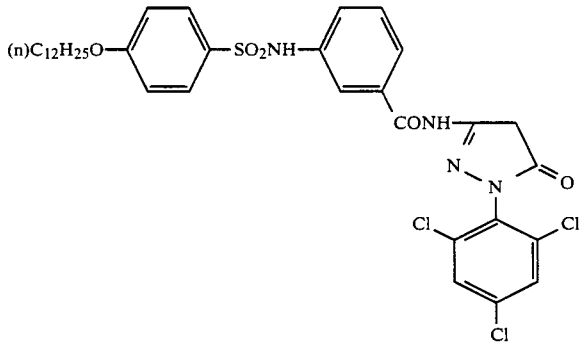
Cp-g
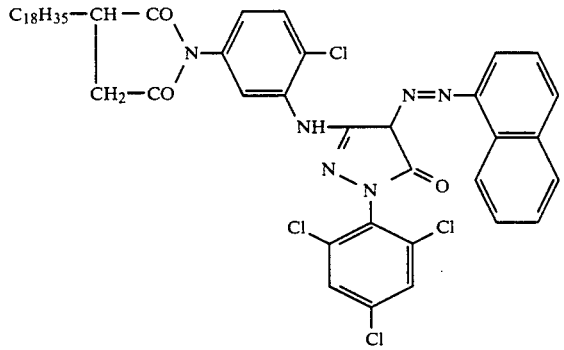

-continued
Cp-i
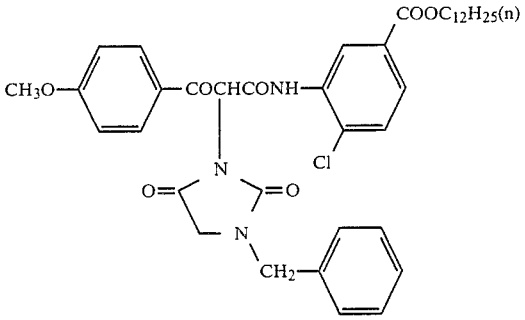
Cp-j
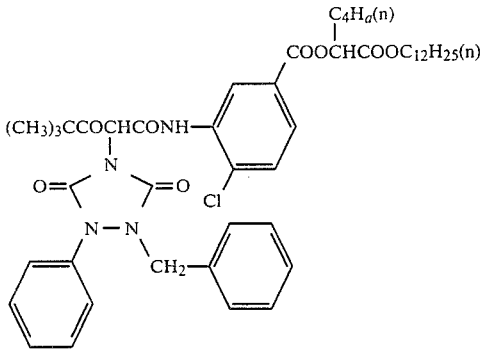
Cp-k
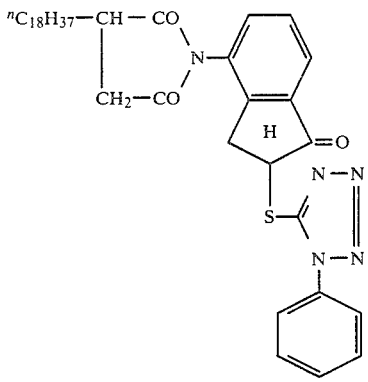
Cp-l
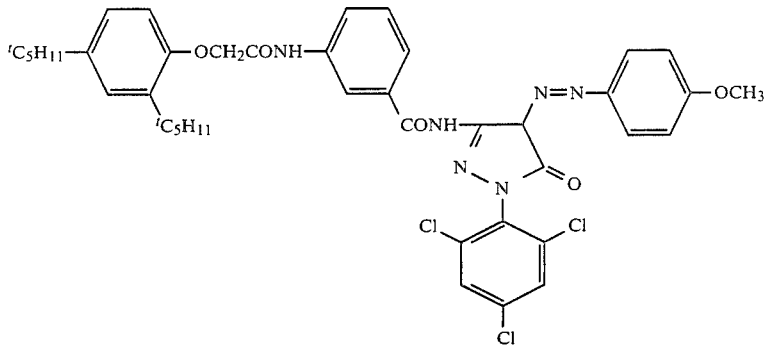
Cp-m
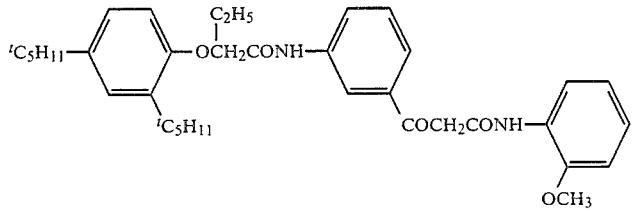

-continued
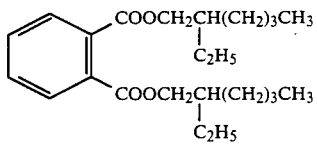
HBS-1
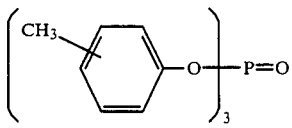
HBS-2
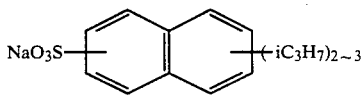
K-1
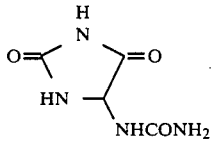
S-1
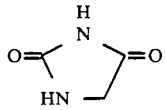
S-2
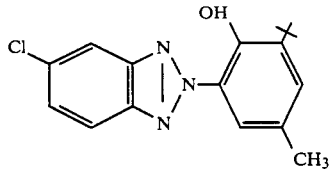
UV-1
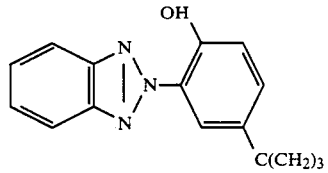
UV-2
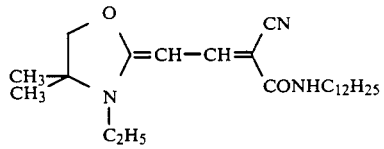
UV-3
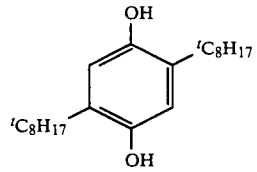
Compound Cpd A
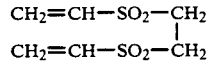
H-1
Then, Samples 602 to 607 were prepared in the same manner as above except that the magenta coupler Cp-f used in the 8th and 9th layers was replaced with the following ones. These couplers were used in the same molar amount.
Sample 602

-continued

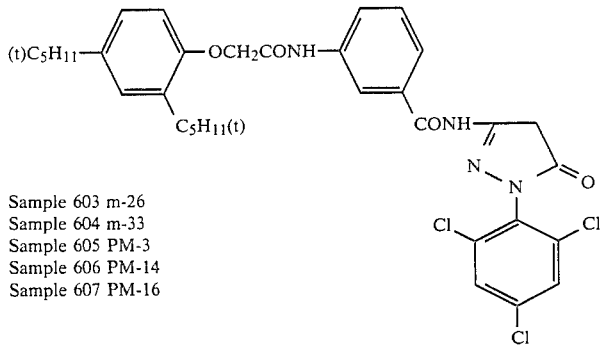

Sample 603 m-26
Sample 604 m-33
Sample 605 PM-3
Sample 606 PM-14
Sample 607 PM-16

Then, Sample 601 was imagewise exposed to light and continuously processed using an automatic developing machine according to the following method until the cumulative amount of the bleach-fixing solution replenished reached three times the volume of the tank for the mother liquor therefor. In the bleach-fixing processing, the processings (methods 6-A to 6-D) were performed on cases wherein the bleaching accelerator was present or absense or 1 l of the amino-exchange resin was present or absense as in Example 1.

| | Processing Method (6-A) | | | |
|---|---|---|---|---|
| Process | Processing Time (sec) | Processing Temp. (°C.) | Amount Replenished (ml) | Tank Volume (l) |
| Color development | 195 | 38 | 45 | 10 |
| Bleach-fixing | 180 | 38 | 15 | 8 |
| Stabilization (1) | 20 | 35 | countercurrent piping system from (2) to (1) | 4 |
| Stabilization (2) | 20 | 35 | countercurrent piping system from (3) to (2) | 4 |
| Stabilization (3) | 20 | 35 | 20 | 4 |
| Drying | 75 | 55 | | |

*The amount replenished is expressed in the amount per 1 m of the light-sensitive material having a wide of 35 mm.

The composition of each processing solution is as follows:

| (Color Developer) | Tank Soln. (g) | Replenisher (g) |
|---|---|---|
| Diethylenetriaminepentaacetic acid | 1.0 | 1.1 |
| 1-Hydroxyethylidene-1,1-diphosphonic acid | 3.0 | 3.2 |
| Sodium sulfite | 4.0 | 4.4 |
| Potassium carbonate | 30.0 | 37.0 |
| Potassium bromide | 1.4 | 0.7 |
| Potassium iodide | 1.5 (mg) | — |
| Hydroxylamine sulfate | 2.4 | 2.8 |
| 4-[N-Ethyl-N-(β-hydroxyethyl)amino]-2-methylamiline sulfate | 4.5 | 5.5 |
| Water | ad. 1.0 l | ad. 1.0 l |
| pH | 10.05 | 10.10 |

-continued

| (Bleach-fixing Solution): Tank Soln. & Replenisher | (unit: g) |
|---|---|
| Ferric ammonium ethylenediaminetetraacetate dihydrate | 100.0 |
| Disodium ethylenediaminetetraacetate | 5.0 |
| Sodium sulfite | 6.0 |
| 70% aqueous solution of ammonium thiosulfate | 280 |
| Paratoluonesulfinic acid | 20.0 |
| 27% Aqueous ammonia | 6.0 (ml) |
| Water | ad. 1.0 l |
| pH | 6.5 |
| **(Stabilization Solution): Tank Soln. & Replenisher** | **(unit: g)** |
| Formalin (37%) | 1.2 (ml) |
| 5-Chloro-2-methyl-4-isothiazoline-3-one | 6.0 (mg) |
| 2-Methyl-4-isothiazolin-3-one | 3.0 (mg) |
| Surfactant $[C_{10}H_{21}—O—(CH_2CH_2O)_{10}—H]$ | 0.4 |
| Ethylene glycol | 1.0 |
| Water | ad. 1.0 l |
| pH | 5.0 ~ 7.0 |

Processing Method (6-B)

The processing (6-B) was the same as the processing method (6-A) except that (IA)-(21) was added to the bleach-fixing solution as a bleaching accelerator in an amount of $5\times10^{-3}$ M.

Processing Method (6-C)

This was the same as the processing method (6-A) except that 1 l of the anion-exchange resin (3) was used in the bleach-fixing solution.

Processing Method (6-D)

This was the same as the processing method (6-A) except that (IA)-(21) as a bleaching accelerator and 1 l of the anion-exchange resin (3) were used in the bleach fixing solution.

Then, Samples 601 to 607 were exposed to light through a continuous tone wedge and processed according to the processing methods (6-A) to (6-D) in a running state to determine the amount of residual silver on portions having the maximum density. In addition, after allowing the processed Samples to stand at 40° C./70% RH for one month, an increase ($\Delta D_G$ min.) in the magenta stain on portions having the minimum density. The results are listed in Table V.

TABLE V

| | Processing | | | | | | | |
|---|---|---|---|---|---|---|---|---|
| | 6-A | | 6-B | | 6-C | | 6-D | |
| Sample | Amount of silver ($\mu g/cm^2$) | $\Delta D_G$ min | Amount of silver ($\mu g/cm^2$) | $\Delta D_G$ min | Amount of silver ($\mu g/cm^2$) | $\Delta D_G$ min | Amount of silver ($\mu g/cm^2$) | $\Delta D_G$ min |
| 601 | 15.1 | +0.15 | 16.1 | +0.15 | 8.5 | +0.12 | 4.8 | +0.10 |
| 602 | 15.3 | +0.16 | 15.8 | +0.15 | 8.6 | +0.14 | 4.7 | +0.10 |
| 603 | 15.6 | +0.22 | 16.2 | +0.21 | 8.8 | +0.20 | 2.1 | +0.09 |
| 604 | 15.6 | +0.20 | 16.3 | +0.18 | 8.9 | +0.19 | 2.0 | +0.09 |
| 605 | 16.0 | +0.23 | 16.5 | +0.21 | 9.0 | +0.21 | 1.8 | +0.08 |
| 606 | 15.9 | +0.25 | 16.5 | +0.23 | 9.0 | +0.23 | 1.8 | +0.08 |
| 607 | 15.8 | +0.24 | 16.4 | +0.21 | 9.1 | +0.22 | 1.9 | +0.07 |
| Note | Comp. Ex. | | Comp. Ex. | | Comp. Ex. | | Present Invention | |

The processing method of this invention (processing 6-D) is excellent in desilvering properties and lowers the increase in magenta density (magenta stain). In particular, Samples 603 to 607 in which preferred magenta couplers were used show marked effects. Each of these Samples was processed at 38° C. for 4 min. 20 sec. using a fixing solution N3 for processing color negative films CN-16 Process (available from Fuji Photo Film Co., Ltd.), but any change in the amount of residual silver was not observed.

EXAMPLE 7

The same procedures as in Example 6 were repeated except that the bleaching accelerator (IA)-(21) used in processing 6-D of Example 6 was replaced with (IA)-(13), (IA)-(15), (IA)-(16), (VA)-(2), (VIA)-(1) or (VA)-(4). Thus, excellent effects were achieved.

EXAMPLE 8

The same procedures as in Example 6 (processing 6-D) were repeated except that the ion-exchange resin (3) used in processing 6-D of Example 6 was replaced with ion-exchange resin (4), (5), (19), (23), (44), (45), (49) or (51) and excellent effects were obtained.

We claim:

1. A method for processing silver halide color photographic light-sensitive materials which comprises color developing an image-wise exposed silver halide color photographic light-sensitive material which contains at least one color coupler and which comprises a substrate provided thereon with at least one silver halide emulsion layer containing silver iodobromide and bleaching the light sensitive material, wherein the bleaching is performed in the presence of a bleaching accelerator and the bleaching is carried out while a part or whole of a bleaching solution is brought into contact with an anion-exchange resin so that the amount of iodide ions in the bleaching solution is maintained at not more than 0.5 g/l expressed in the amount of KI.

2. The method of claim 1 wherein the bleaching is performed using a bleaching solution containing the anion-exchange resin.

3. The method of claim 1 wherein a part or whole of the used bleaching solution is brought into contact with the anion-exchange resin and then used in the bleaching.

4. The method of claim 1 wherein the silver iodobromide content of the silver halide emulsion layer is not less than 1 mole %.

5. The method of claim 4 wherein the silver iodobromide content of the silver halide emulsion layer ranges from 5 to 25 mole %.

6. The method of claim 1 wherein the anion-exchange resin is a basic anion-exchange resin.

7. The method of claim 6 wherein the basic anion-exchange resin is a strong basic anion-exchange resin.

8. The method of claim 1 wherein the bleaching treatment is a bleach-fixing treatment.

9. The method of claim 1 wherein the amount of coated silver of the light-sensitive material ranges from 2 to 10 g/m$^2$.

10. The method of claim 1 wherein the bleaching accelerator is an organic bleaching accelerator.

11. The method of claim 10 wherein the bleaching accelerator is a compound represented by the following general formula (IA):

$$R^{1A}—S—M^{1A} \qquad \text{(IA)}$$

(wherein $M^{1A}$ represents a hydrogen atom, an alkali metal or an ammonium residue; and $R^{1A}$ represents an alkyl, alkylene, aryl or heterocyclic residue).

12. The method of claim 1 wherein the content of the bleaching accelerator in the bleaching solution ranges from $1\times10^{-5}$ to $1\times10^{-1}$ mole/l.

13. The method of claim 6 wherein the basic anion-exchange resin is a resin represented by the following general formula (VIII):

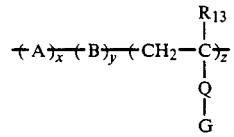

(VIII)

wherein A represents a monomer unit obtained by copolymerizing copolymerizable monomers having at least two ethylenically unsaturated copolymerizable groups at least one of which is present in a side chain; B represents a monomer unit obtained by copolymerizing ethylenically unsaturated copolymerizable monomers; $R_{13}$ represents a hydrogen atom, a lower alkyl group or an aralkyl group; Q represents a single bond, an alkylene, phenylene or aralkylene group, or a group represented by —CO—O—L—, —CO—NH—L— or —CO—NR—L— (wherein L is an alkylene, arylene or aralkylene group and R is an alkyl);

G represents

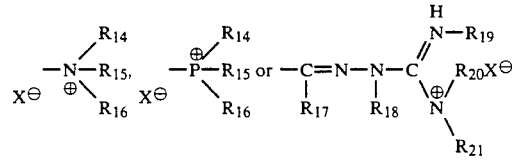

wherein $R_{14}$ to $R_{21}$ may be the same or different and may be substituted and each represents a hydrogen atom, or an alkyl, aryl or aralkyl group; and $X^{\ominus}$ represents an anion, at least two of Q, $R_{14}$, $R_{15}$ and $R_{16}$, or Q, $R_{17}$, $R_{18}$, $R_{19}$, $R_{20}$ and $R_{21}$ may be bonded to form a ring structure together with the nitrogen atom, x,y and z represent molar percentage, x ranges from 0 to 60, y from 0 to 60 and z from 30 to 100).

14. The method of claim 13 wherein the basic anion-exchange resin is a resin represented by the general formula (IX):

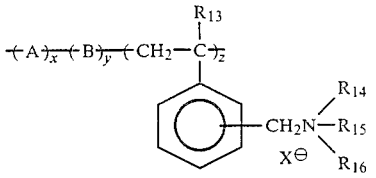

(IX)

wherein A, B, x, y, z, $R_{13}$ to $R_{16}$ and $X^{\ominus}$ are the same as those in the foregoing formula (VIII).

15. The method of claim 13 wherein G in the formula (VIII) is

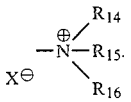

16. The method of claim 15 wherein the total number of carbon atoms of $R_{14}$, $R_{15}$ and $R_{16}$ is not less than 12.

* * * * *